US006102665A

United States Patent [19]

Centers et al.

[11] Patent Number: 6,102,665

[45] Date of Patent: Aug. 15, 2000

[54] COMPRESSOR SYSTEM AND METHOD AND CONTROL FOR SAME

[75] Inventors: Steven D. Centers; Paul G. Moffat, both of Daphne, Ala.

[73] Assignee: Coltec Industries Inc

[21] Appl. No.: 09/179,523

[22] Filed: Oct. 27, 1998

Related U.S. Application Data

[60] Provisional application No. 60/066,008, Oct. 28, 1997.

[51] Int. Cl.[7] ..... F04B 49/00

[52] U.S. Cl. ..... 417/18; 417/17; 417/32; 417/44.4; 417/53; 417/286

[58] Field of Search ..... 417/53, 15, 17, 417/18, 19, 20, 32, 44.2, 44.3, 44.4, 286, 279

[56] References Cited

U.S. PATENT DOCUMENTS

| | | | |
|---|---|---|---|
| 4,227,862 | 10/1980 | Andrew et al. | 417/12 |
| 4,335,582 | 6/1972 | Shaw et al. | 62/196 |
| 4,336,001 | 6/1982 | Andrew et al. | 417/63 |
| 4,502,833 | 3/1985 | Hobino et al. | 415/17 |
| 4,502,842 | 3/1985 | Currier et al. | 417/8 |
| 4,516,914 | 8/1985 | Murphy et al. | 417/282 |
| 4,519,748 | 5/1985 | Murphy et al. | 417/45 |
| 4,548,549 | 10/1985 | Murphy et al. | 417/53 |
| 4,609,329 | 9/1986 | Pillis et al. | 417/282 |
| 4,674,463 | 6/1987 | Duckwerth et al. | 123/570 |
| 5,224,836 | 7/1993 | Gunn et al. | 417/14 |
| 5,362,207 | 11/1994 | Martin et al. | 417/243 |
| 5,384,697 | 1/1995 | Pasucci | 364/139 |
| 5,713,724 | 2/1998 | Centers et al. | 417/53 |

*Primary Examiner*—Charles G. Freay
*Assistant Examiner*—Robert Z. Evora
*Attorney, Agent, or Firm*—Cummings & Lockwood

[57] ABSTRACT

An electronic control system is disclosed to control and to prevent damage to a standalone or a network of oil free, two stage compressor packages. The electronic control system uses pressure and temperature sensors to detect actual shutdown conditions or predict shutdown conditions based on the operating state of the compressor package and the current temperatures or pressures of the air at strategic locations in the compressor package. It has been determined through experimentation that, if the pressure at the inlet of the stage two compressor is less than the discharge pressure of the stage two compressor by more than an allowable value, then a high temperature condition will occur in the stage two compressor and cause the compressor to seize. It has also been determined the pressure differential occurs first in this situation and that the electronic control system can predict the failure based on the pressure differential data and to shut the compressors down before the stage two compressor failure occurs. The electronic control system then records the shutdown event in an area of nonvolatile memory and displays the reason for the shutdown on a LCD display visible to the compressor operator. A plurality of electronic control systems can be connected in a peer-to-peer network to coordinate control of a plurality of compressors connected to the same air distribution system. A modem connected to the electronic control system supports remote diagnostics, monitoring, and control. Methods for controlling the operation of the compressor packages using the electronic control system are also disclosed.

20 Claims, 47 Drawing Sheets

| Fig. 3A-1 | Fig. 3A-2 | Fig. 3A-3 |
|---|---|---|

| Fig. 4A-1 | Fig. 4A-2 |
|---|---|

| Fig. 5G-1 | Fig. 5G-2 |
|---|---|

| Fig. 5J-1 | Fig. 5J-2 | Fig. 5J-3 |
|---|---|---|

COMPRESSOR SYSTEM AND METHOD AND CONTROL FOR SAME

RELATED APPLICATIONS

This application is a continuation-in-part of commonly owned U.S. Provisional Patent Application Serial No. 60/066,008, filed Oct. 28, 1997, of Centers et al., the disclosure of which is herein incorporated by reference.

BACKGROUND OF THE INVENTION

The present application relates generally to electronic control systems and control methods for operating one or more machines. More specifically, it relates to electronic control systems and control methods for operating one or more oil free compressors. Most specifically, it relates to electronic control systems and control methods for controlling one or more oil free two stage screw compressors.

Rotary screw compressors, such as the compressor disclosed in U.S. Pat. No. 4,435,119, have long been used to provide compressed air in industry. Such rotary screw compressor typically comprises two rotors mounted in a working space limited by two end walls and a barrel wall extending there between. The barrel wall takes the shape of two intersecting cylinders, each housing one of the rotors. Each rotor is provided with helically extending lobes and grooves that are intermeshed to establish chevron shaped compression chambers. In these chambers, a gaseous fluid is displaced and compressed from an inlet channel to an outlet channel by way of the screw compressor. Each compression chamber during a filling phase communicates with the inlet, during a compression phase undergoes a continued reduction in volume, and during a discharge phase communicates with an outlet.

Rotary screw compressors of this kind are designed to control a single stage oil flooded rotary screw compressor. The oil in the compressor does several things. First, it provides lubrication to prevent the moving parts from making contact and wearing. Second, it acts as a sealing agent to fill in all of the possible leak paths for the compressed air to escape through. Thirdly, it acts as a thermal transfer medium to absorb some of the heat of compression. The oil is discharged from the compressor with the compressed air into an oil separator tank where the oil is removed from the air. Although there is still some oil remaining in the compressed air, it is only at a level of parts per million.

It is known that these compressors may be controlled by electronic circuits, such as those disclosed in U.S. Pat. Nos. 4,336,001 and 4,227,862 to Andrew et al., which show electronically controlled startup and shutdown routines and control of a bypass slide valve to vary compressor output to maintain pressure at a selected setpoint.

U.S. Pat. Nos. 4,519,748, 4,516,914, and 4,548,549 to Murphy et al. and U.S. Pat. No. 4,609,329 to Pillis et al. show additional electronic control systems for compressors. However, the operating modalities of these systems are primarily designed for refrigerant compression.

U.S. Pat. No. 4,502,842 to Currier et al., assigned to Colt Industries Operating Corp., discloses a single electronic control system which can be connected to control a plurality of variably sized compressors. The system gathers data on the operating characteristics of the controlled compressors during a calibration phase and then uses this information to load and unload the compressors during operation, maintaining a preset pressure which can be programmed to vary with time. High and low pressure set points are programmed into the electronic control system and the compressors are selective loaded and unloaded in a predetermined sequence. However, centralized master controllers of this type represent a single point of failure for the entire pressurized air system, and are lacking in versatility since they provide only a limited selection of control modalities.

U.S. Pat. No. 4,335,582 to Shaw et al. shows a system for unloading a helical screw compressor in a refrigeration system. A slide valve is connected so that upon compressor shutdown, the slide valve is automatically driven to a full unload position. This operation is accomplished with air pressure rather than with an electronic control system.

Recently issued commonly owned U.S. Pat. No. 5,713,724 to Centers et al., the disclosure of which is herein incorporated by reference, solved a significant number of the control problems for such single stage oil flooded rotary screw compressors by providing a complete and versatile solution to the control and maintenance problems experienced when operating one or more compressors in a variety of facility installations with a variety of air storage capacities.

Oil flooded screw compressor technology has been used with great success for many years. However, the need for an oil free version of this technology is becoming more and more prevalent. Oil free compressors can provide clean air that, in most cases, requires only that any moisture content therein be removed in order to use the compressed air in many sensitive applications. Since the EPA has been diligently working to rid all manufacturing processes of any type of contamination in the environment, the fact that oil free compressors can provide air without contaminating oil. As is known, some level (at least deminimus) of oil is present in the compressed air produced by all known oil flooded screw compressors. However, an oil free compressor produces compressed air without even deminimus oil therein.

As is also known, oil free screw compressors by their very nature are complicated machines. Because of the lack of lubricant in the compressor compression chamber, timing gears are used at the ends of the rotors to prevent the rotors from rubbing together in oil free compressors. To seal the small clearances that remain after machining the compressor, all of the internal parts in the compression chamber must be coated with a material that can be worn in and also act as a lubricant in some locations inside the compression chamber. Because there is no oil in the compression chamber of an oil free compressor, there is no oil to absorb some of the heat of compression, as in oil flooded compressors. The absence of the oil or other heat absorbing material makes the oil free compressor very susceptible to rapid, uncontrolled internal temperature increase.

Further, if the oil free compressor is a two-stage compressor, the compressor control must simultaneously control both stages. Controlling a two stage compressor is very similar to controlling two separate single stage compressors. Controlling an oil free, two stage compressor or a network of oil free, two stage compressors requires a much more complex control regime than the single compressor control or a control for a network of single stage compressors, as disclosed in the aforementioned '724 patent. Each stage of oil free, two stage compressor is unloaded different from other two stage compressor design. The reason for unloading both stages is to achieve the lowest unloaded horsepower possible. By unloading both stages instead of just the first stage, unless the control regime is sufficiently advanced to detect or predict a failure condition and shut the compressor down before a compressor failure occurs, the risk of a compressor failure resulting to significant compressor damage is greatly increased.

For example, there are a number of failure modes/conditions that could result in severe compressor damage if not detected or predicated in a timely manner. One such condition is if one of the unloader valves were to fail to operate due to a condition, such as, for example, an electrical or mechanical failure. Another such condition is if one of the blowdown valves failed to operate due to an electrical or mechanical failure and caused the compressor to fail. Still another compressor failure mode would result if a coolant system failure occurred. Yet another compressor failure mode would result if the pressure of the lubricating oil used to lubricate the bearings and gears in and oil free compressor fell below a minimum pressure. Another compressor failure mode would result if the interstage pressure between the two compressor stages fell outside the normal operating parameters for the compressor. Because the interstage pressure changes, depending on whether the compressors are in a loaded or an unloaded state, a control has to determine, based on the state of the compressors, whether the interstage pressure is acceptable to continue operation or that the compressors must be shut down to avoid damaging the compressors.

Thus, there is a need for electronic control systems and control methods for operating/controlling the one or more oil free two stage compressor(s). Such systems and methods should control both stages of a oil free, two stage compressor. Such systems and methods should provide for the timely detection and/or predication of failure modes/conditions that could result in sever compressor damage. Such systems and methods should provide for the timely detection and/or predication of the failure of one of the unloader valves to fail to operate due to a condition, such as, for example, an electrical or mechanical failure. Such systems and methods should provide for the timely detection and/or predication of failure of one of the blowdown valves to operate due to an electrical or mechanical failure. Such systems and methods should provide for the timely detection and/or predication of the failure of a coolant system. Such systems and methods should provide for the timely detection and/or predication of failure of the lubricating oil to lubricate the bearings and gears in an oil free compressor and the pressure fell below a minimum pressure. Such systems and methods should provide for the timely detection and/or predication of the interstage pressure between the two compressor stages falling outside the normal operating parameters for the compressor.

SUMMARY OF THE INVENTION

It is a primary object of the present application to provide novel electronic control systems and control methods for controlling/operating one or more oil free rotary screw compressors.

Another object of the present application is to provide novel electronic control systems and control methods for coordinating the operation of a plurality of electronic compressor control units.

Yet another object of the present application is to provide novel systems and methods for electronically controlling a compressor.

A further object of the present application is to provide novel systems and methods for interconnecting a plurality of electronic compressor control units to coordinate control of a plurality of compressors.

A still further object of the present application is to provide novel electronic control systems and control methods for interactively controlling a plurality of oil free rotary screw compressors in a peer-to peer network where each compressor has a controller that communicates with the other controllers in the network and controls its associated compressor in accordance with predetermined network control algorithms.

Another object of the present application is to provide electronic control systems and control methods with a control algorithm which shuts the compressor down with a certain parameter is exceeded.

In accordance with these and further objects, one aspect of the present application includes an electronic control system for a single or a network of oil less, two stage compressor packages, operatively connected to a pressure system in which pressure is to be maintained within a desired pressure range, for controlling the operation of the single or the network of compressor packages, the system comprising: measuring means, operatively connected to the first and the second compressor stages, for determining the pressure exiting the first and the second compressor stages; processing means, operatively connected to the measuring means for receiving signals from the measuring means, for comparing the determined pressure exiting the first compressor and the second compressor stages with a predetermined range of possible pressures; and means, operatively connected to the oil free, two stage compressor package and the processing means, for shutting down the compressor package before the compressor package is damaged.

Yet another aspect of the present application includes a method for controlling a single or a network of oil less, two stage compressor packages, operatively connected to a pressure system in which pressure is to be maintained within a desired pressure range, for controlling the operation of the single or the network of compressor packages, the method comprising the steps of: operatively connecting an electronic control system to at least one two stage compressor package; determining the pressure exiting the first and the second compressor stages; comparing the determined pressure exiting the first compressor and the second compressor stages with a predetermined range of possible pressures; and if the determined pressure exiting either the first or the second compressor stages equals or exceeds the predetermined range of possible pressures, shutting down the compressor package before the compressor package is damaged.

Other objects and advantages of the application will be apparent from the following description, the accompanying drawings and the appended claims.

DETAILED DESCRIPTION

Figure 1A:
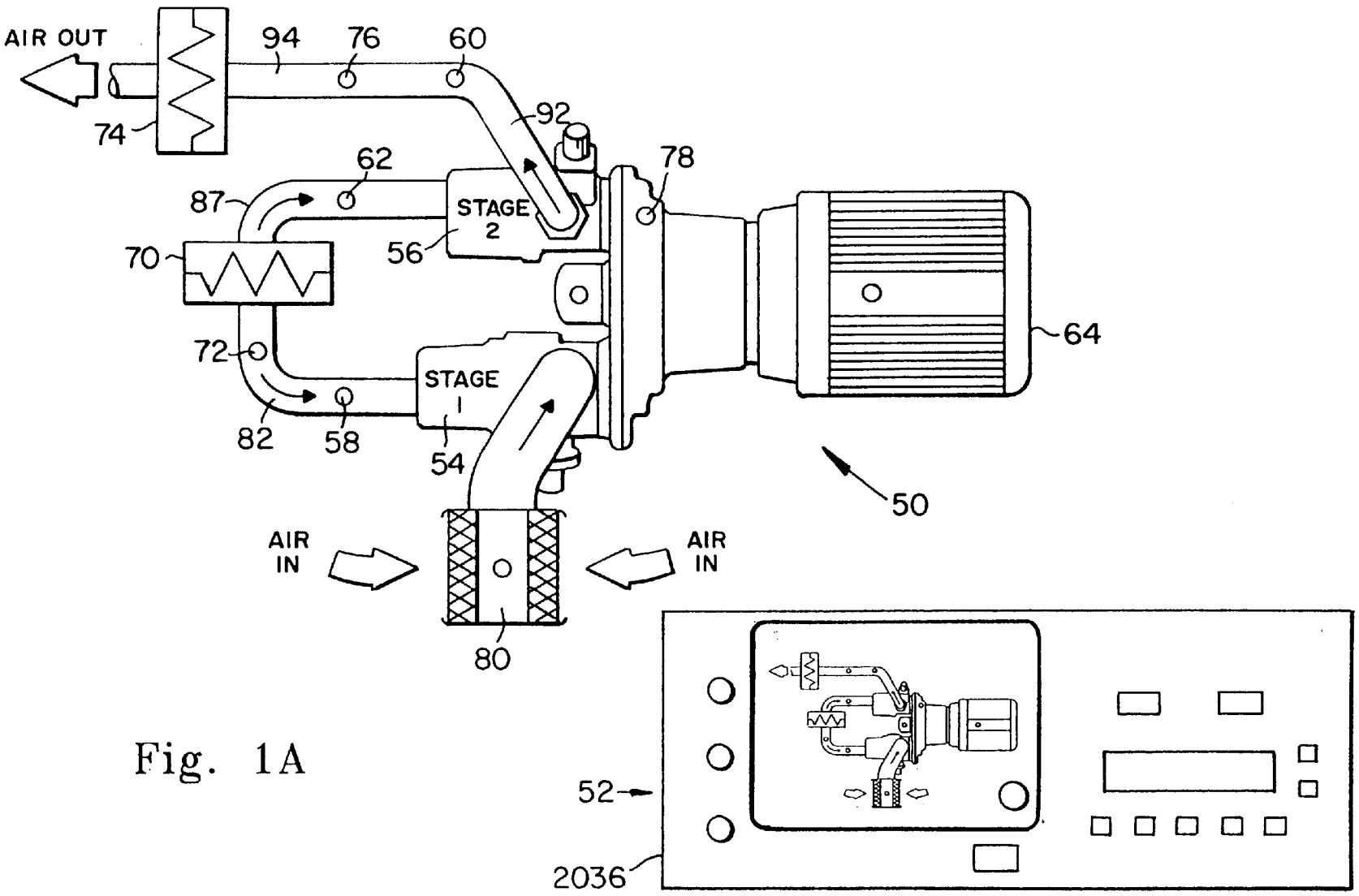
FIG. 1A is a semi-schematic diagram of an oil free two stage compressor package useful with the control system and methods of the invention.

FIG. 1A schematically illustrates a general embodiment of an oil free two stage compressor package 50 that is controlled by the POWER$YNC® II control system or electronic control system 52. The POWER$YNC® II control system 52 as disclosed in the present application is similar in some ways to the POWER$YNC® control system used in U.S. Pat. No. 5,713,724, but is also different in many ways due to the fact that the POWER$YNC® II control system is controlling an oil free two stage compressor package 50 and not an oil flooded single stage compressor of the '724 patent.

The POWER$YNC® II control system 52 of the present application is similar because like the POWER$YNC® control system, it is used to control a screw type air compressor. The POWER$YNC® II control system 52 controls the compressor package 50 based on temperature and pressure measurements at strategic locations. The POWER$YNC® II control system 52 uses a modified version of the microprocessor board used for the POWER$YNC® control system with a daughter card operatively connected to the main circuit board for determining the extra temperature and pressure inputs needed to effectively control the more complex oil free, two stage compressor 50. The POWER$YNC® II control system 52 uses the same relay and display/keypad boards as used in the POWER$YNC® control system. However, a new annunciator circuit board was designed to handle the extensive annunciator graphic required for this compressor package as will be explained below. The POWER$YNC® II control system 52 also has a menu system that is similar in look and feel to the POWER$YNC® control system, but displays much more information than the POWER$YNC® control system. The very nature of the design differences between the compressors, i.e., an oil free compressor package as opposed to an oil flooded compressor, requires a different type of control regime.

As stated above, the POWER$YNC® control system was designed to control a single stage oil flooded rotary screw compressor or a network of a plurality of single stage oil flooded rotary screw compressors. The oil in this type compressor accomplishes several objectives. First, the oil provides lubrication to prevent the moving parts of the compressor from making contact and wearing. Second, the oil acts as a sealing agent to fill in all of the possible leak paths for the compressed air to escape through the rotating screws. Third, the oil acts as a thermal transfer medium to absorb some of the heat resulting from the compression of the air. In an oil flooded compressor, the oil is discharged from the compressor with the compressed air into an oil separator tank where the oil is removed from the air. Although there is still some oil remaining in the compressed air, it is only present at a level of parts per million.

The illustrated two stage oil free compressor package 50 is basically two compressors driven from one input shaft where the discharge from the first compressor 54 is fed to the inlet of the second compressor 56. Oil is not used inside the air compression chamber(s) of the oil free compressor package 50 so the moving parts in each of the two compressor chambers are coated with a wear reducing material, such as, for example, Fluorinated Ethylene Propylene (FEP), also known as Teflon®. Since there is no oil to absorb any of the heat generated by air compression in this type compressor package, the air discharge temperatures are much higher than the air discharge temperature of an oil flooded compressor. There is also no separator tank because there is no oil to separate from the air.

Controlling a two stage compressor is somewhat similar to controlling two separate compressors. One of the big differences between the POWER$YNC® control system and the POWER$YNC® II control system 52 is the requirement to control not just one, but two compressor stages. Also, since this two stage compressor is an oil free compressor package 50, it is more complicated than a standard single stage oil flooded screw compressor.

The POWER$YNC® II control system 52 of the present application measures the discharge temperature from each of the two compressors 54, 56, at 58 and 60 respectively, as well as the inlet temperature to the second stage 56 at 62 and the compressor package discharge temperature (not shown). These temperatures are more critical to the effective operation of an oil free, two stage compressor package than to an oil flooded single stage compressor because these temperatures are typically at a higher level than are the temperatures of a standard oil flooded compressor and these temperatures are subject to more rapid change. If any of these temperatures rise above defined limits as are defined in a manufacturing setup menu, that is hidden from the user, and may be targeted to appropriate values, such as, for example, airend discharge temperature being typically set to about four hundred thirty five degrees Fahrenheit (435° F.), with the input temperature to the second stage compressor and the compressor package discharge temperatures being set to about one hundred twenty degrees Fahrenheit (120° F.), the POWER$YNC® II control system 52 will shut the compressor package down. After shutting down the compressor package, the POWER$YNC® II control system 52 will record which of the four measured temperatures was responsible for shutting the compressor package down, and at what time and date the shutdown occurred. The POWER$YNC® II control system 52 has a more extensive annunciator graphic than the POWER$YNC® control system and will indicate at what location on the graphic the shutdown occurred. The more extensive annunciator graphic is used to very quickly indicate what major shutdown occurred, without the operator needing to read the displayed message on the LCD screen.

Because of the higher temperatures of the oil free compressor package 50, a cooler 70 for the interstage air is required. The interstage air is the air coming from the discharge of the first stage compressor 54 to the inlet of the second stage compressor 56. Because of the potential that a catastrophic failure in cooler 70 might block the flow of air, the POWER$YNC® II control system 52 measures the air pressure at the discharge of the first stage compressor at 72. If this interstage air pressure goes above an established limit of about fifty (50) psi, the POWER$YNC® II will shut down the compressor package.

A cooler 74 is positioned at the discharge of the second stage compressor 56. Because of the potential that a catastrophic failure in cooler 74 might block the flow of air, the POWER$YNC® II control system 52 measures the air pressure at the discharge of the second stage compressor 56 at 76. If the air flow is blocked and the air pressure rises to an unsafe limit for a high pressure compressor package model of at about or above one hundred forty two (142) psi, the POWER$YNC® II control system 52 will shut down the compressor package 50. If the compressor package is a standard pressure model and if the air pressure rises to the unsafe limit at about or above one hundred twelve (112) psi, the POWER$YNC® II control system 52 will shut down the compressor package 50.

While the oil free compressor package 50 was designed to provide oil free compressed air, there are parts in each compressor stage compression chamber, isolated from the compressed air, that require lubricating oil. Because of the lubricating oil, the POWER$YNC® II control system 52 measures oil pressure on the oil free compressor package at 78 while the original POWER$YNC® control system did not measure oil pressure on the single stage air compressor. The loss of oil pressure on the two stage compressor package 50 can result in a rapid rise of the temperature of the bearing in the compressor. If the oil pressure drops below a predefined limit, POWER$YNC® II control system 52 will shut down the compressor package before a bearing failure occurs.

The POWER$YNC® II control system 52 also measures the pressure, as well as the temperature, after the second stage cooler 74. This temperature and this pressure is referred to as the package discharge pressure and discharge temperature. The package discharge pressure is used to determine when to unload and load the two compressors. The package discharge temperature is conveniently displayed so that the end user can easily see the air temperature coming out of the compressor package. If the package discharge temperature or pressure exceeds a predetermined limit, the POWER$YNC® II control system 52 will shut down the compressor package.

The two stage oil free compressor package 50 used with the control system 52 of the present application is different from any other two stage compressor package believed to be currently available, as it is designed to allow each stage to be unloaded. Current two stage compressor packages, known by the inventors to be available, are only designed to unload the first stage. Unloading only the first stage works by closing off airflow to the first stage compressor and then starving the second stage. The disadvantage of this approach is that there is still some load on the compressors because of the built in compression ratios.

The two stage oil free compressor package 50 of the present application uses liftvalve technology with a single liftvalve placed at the discharge of each of the stages 54, 56, as will be explained later. The liftvalve technology useful with the present application is disclosed in commonly assigned U.S. Pat. No. 5,556,271, issued to Jan Zuercher, the disclosure of which is incorporated by reference. The liftvalves in this design, destroy the compression ratio when they are opened. The POWER$YNC® II control system 52 is designed to unload both stages simultaneously. Specifically when the package pressure reaches the unload point, the POWER$YNC® II control system 52 unloads both stages simultaneously. Once unloaded, the POWER$YNC® II control system 52 opens a solenoid valve to dump any trapped pressure in the interstage piping, when the interstage pressure drops to a designed level a pneumatic blowdown valve at the discharge of the second stage is triggered to open by the interstage pressure and any trapped pressure at the second stage discharge is dumped. A package check valve isolates the compressor package from the end user's compressed air system. This unload process reduces the compressor package's unloaded horsepower to the absolute minimum or to just about a value equaling mechanical losses.

When the package pressure (the end user's system pressure) drops to the load pressure point, the pressure transducer at the package check valve senses the drop and the control system loads the compressor as follows. The liftvalve for stage one and stage two are closed simultaneously. The interstage blowdown valve is closed and the interstage pressure begins to rise. A pressure signal from the interstage pressure drop triggers the stage two pneumatic blowdown valve to close at a designed pressure level and air pressure builds at the discharge of stage two until it overcomes any back pressure at the package check valve. At this point, compressed air is delivered into the end user compressed air system. This load methodology is unlike anything used for a single stage compressor and unlike anything the POWER$YNC® control system does on a single stage compressor.

The two stage oil free compressor package used in the present application is not a partial load compressor package. The oil free compressor package runs either fully loaded or fully unloaded. The compressors controlled by the POWER$YNC® control system by contrast are designed as part load compressors. In other words, the compressors are not only designed to produce full load capacity, but also some level of air capacity that is between full load and unload.

The POWER$YNC® II control system 52 uses pressures along with temperatures to determine if a shutdown condition exists during operation of the oil free two stage compressor package. It has been determined that, in some cases, a pressure condition is a much faster indication of an imminent high temperature shutdown condition than an actual temperature measurement. For example, since air pressure is measured in the interstage piping and the pressure at the discharge of the second stage compressor package, such measurement can readily determine if there is a high delta pressure across the second stage compressor. A high delta pressure across the stage two compressor will cause a very high temperature rise across the second stage compressor. This temperature rise can occur very rapidly and in some cases might occur too fast for the current POWER$YNC® II control system 52 temperature measuring circuits to detect and respond to such temperature rise before there is damage to the second stage compressor. By measuring the critical pressures, it is possible to predict when a high temperature condition might occur and shutdown the compressor package before any damage can occur. The POWER$YNC® control system is not capable of using pressure to predict that a high temperature shutdown will occur on a single stage compressor.

The control system used with the oil free compressor package uses pressure and temperature sensors to detect actual shutdown conditions or predict shutdown conditions based on the operating state of the compressor package and the current temperatures or pressures of the compressors.

For example, it has been determined through experimentation that if for some reason the pressure at the inlet of the stage two compressor is less than the discharge pressure of the stage two compressor by more than an allowable value, then a high temperature condition will occur in the stage two compressor and cause the compressor to seize. The pressure differential occurs first in this situation and the control system predicts the failure based on the measured pressure differential data and shuts the compressor packages down before the stage two compressor failure can occur. The limit is established by computing a value. The value is computed by measuring the second stage compressor discharge pressure and the first stage compressor discharge pressure. When the second stage compressor discharge pressure is greater than about eighty psi (>80 psi) AND the first stage compressor discharge pressure is less than about ten psi (<10 psi), for a period of about ten (10) seconds, an alarm is flagged and the control system will shut down the compressor package. The control system then records the shutdown event in an area of nonvolatile memory and displays the reason for the shutdown on a LCD display visible to the compressor operator.

Another shutdown condition that was discovered through experimentation occurred if the compressors cycled loaded and unloaded too frequently. This condition is likely to occur if the compressor installation has inadequate air storage. Since the compressor package does not include a sump to separate the oil from the compressed air, being an oil free air compressor package, an air storage tank is required to limit cycling. The control system is not designed to shut down the air compressor because of rapid cycling, but it does record the number of cycles per minute that are taking place. However, rapid cycling will cause a high air temperature shutdown of the compressor package under certain conditions, and this may be unavoidable because of the installation. But if a high air temperature shutdown does occur, the record of the cycling condition of the compressor just before it shutdown will to be displayed for the compressor operator.

Other shutdown conditions are low oil pressure, high air temperature from either the first stage discharge, the second stage inlet, the second stage discharge, or the package discharge, high second stage discharge pressure, high package discharge pressure, and possible reverse rotation motor overload and loss of cooling water flow.

DETAILED DESCRIPTION OF THE ORIGINAL AND THE IMPROVED EMBODIMENT

Figure 1B:
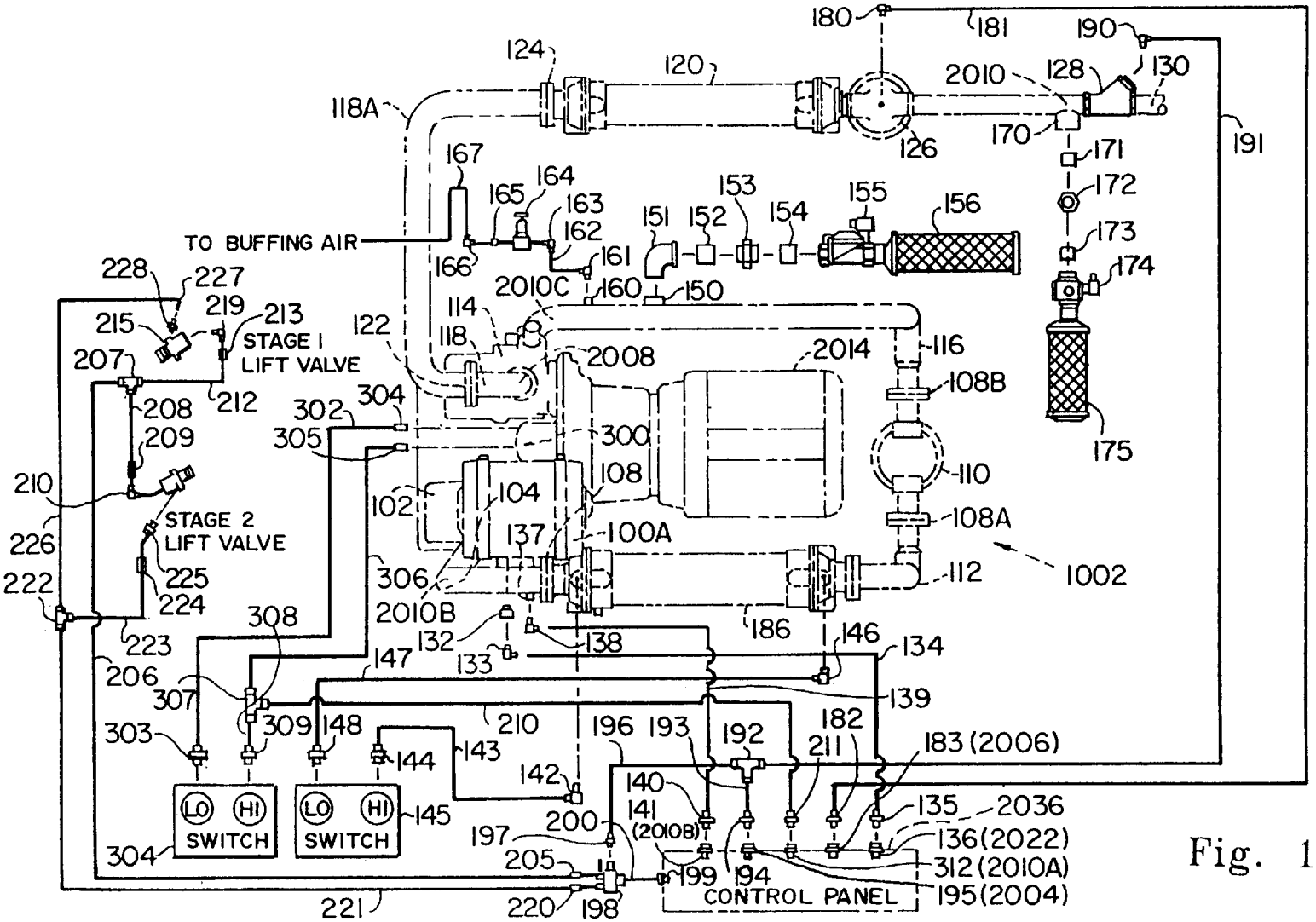
FIG. 1B is a diagram of an earlier version of the operative connections of a control system to the compressor package of FIG. 1A.

Referring now to FIG. 1B, one embodiment of a compressor system package 1002 is illustrated in detail. The compressor package 1002 is connected to a drive motor 100 that provides rotation to the compressor input shaft (not shown) and that in turn transmits it to gears(not shown). The compressor package 1002 begins turning and air is drawn in to the inlet filter 100A. The filter 100A provides protection from contaminates in the air going into the compressor package 1002.

The first-stage compressor 102 compresses the air to approximately thirty (30) psi. The compressed air is transmitted from the first stage compressor 102 into the innerstage piping 104. The compressed air flows through the piping 104 to an innerstage cooler 106. The cooler 106 drops the air temperature by approximately three hundred degrees Fahrenheit (300° F.). The cooler 106 is connected to the discharge of the first stage compressor 102 via a coupling plate 108.

The compressed air is transmitted through the innerstage cooler 106 into another innerstage pipe 112. The pipe 112 is connected to a moisture trap 110 via coupling plates 108A. The moisture trap 110 is connected to the innerstage piping that leads to the second stage compressor 114 via innerstage pipe 116, which is also connected to the moisture trap 110 via coupling plates 108B. Any moisture that might collect in the compressed air from the first stage compressor 102 is collected and processed in the moisture trap 110. Such processing is conventional and is known to those skilled in the art.

This compressed air is transmitted into the inlet of the second stage compressor 114. The second stage compressor 102 compresses the air approximately another seventy (70) psi, which brings the air up to approximately one hundred (100) psi. The compressed air is transmitted from the second stage compressor 114 into the second stage compressor discharge pipe 118. The pipe 118 is connected to another discharge pipe 118A leading to a compressor package discharge cooler 120. Connecting plates 122, 124, operatively connect the second stage compressor 114 to the package discharge cooler 120. The cooler 120 again drops the temperature of the compressed air transmitted therethrough by approximately three hundred degrees Fahrenheit (300° F.). The cooled compressed air is transmitted through another moisture trap 126 and then through other piping connected to a compressor package, illustrated as compressor package 1002, check valve 128. The purpose of the check valve 128 is to isolate the compressor package 1002 from the end user's air system such that air back flow through the compressor package 1002 is prevented when the compressor package 1002 unloads or is idle.

The back flow would be checked and there would be no leakage path to the location of the end user's air supply. The check valve 128 is connected by the end user to the end user's compressed air system through a pipe 130 supplied by the end user, as is known to those skilled in the art.

The air cleaner 100A has a pipe fitting adapter 132 at the throat of the air cleaner leading into the compressor package 1002. The adapter 132 is connected to a tubing elbow 133, which is connected to tubing 134, which is in turn connected to tubing connector 135. The tubing connector 135 is threaded into a bulkhead adapter 136. The bulkhead adapter 136 is the connection point for a vacuum switch that monitors the level of restriction through the air cleaner to provide an alarm condition to indicate that the filter needs to be replaced.

Pipe 104, which is the discharge of the first stage compressor 102, has a pipe bung 137 located or welded on its side. A tubing elbow 138, connected to the bung 137, provides air through tubing 139 to a tube fitting 140. The tube fitting 140 is threaded into a bulkhead adapter 141, which is connected to a pressure transducer that monitors the discharge pressure of the first stage compressor 102. The innerstage air cooler 106 has a pipe port on it where there is an elbow connection 142. The elbow connection 142 passes air pressure through tubing 143 to a tube fitting 144, which is connected to a delta pressure switch 145.

A tube fitting 146 operatively connects tube 147 with the cooler 106. The tube 147 is operatively connected to a tube fitting 148. The tube fitting 148 is connected to the delta pressure switch 145. The delta pressure switch 145 monitors restriction across, or the delta pressure across, the innerstage cooler 106 and provides a warning indication when the cooler 106 may require service.

Innerstage pipe 116 has a bung 150 welded thereto, which connects the innerstage pipe 116 to a blowdown solenoid valve 155. The connection is through a pipe elbow 151, pipe nipple 152, pipe coupling 153, and pipe nipple 154. The purpose of the solenoid valve 155 is to exhaust any trapped pressure at shutdown or unload of the two stage compressor that might be trapped in innerstage pipe 116. A muffler 156 is attached to the discharge of the blowdown solenoid valve 155. The purpose of the muffler 156 is to reduce the amount of noise that would be created when any trapped air pressure is vented to atmosphere.

A bung 160 is located on or welded to innerstage pipe 116.

The bung 160 is connected to a tube fitting elbow 161, which is connected to tubing 162, which is connected to another tubing elbow 163. The tubing elbow 163 is connected to a regulating valve 164, which is connected to a pipe bushing 165, which has a tube elbow 166 connected thereto. The tube elbow 166 is connected to tubing 167. The regulating valve 164 allows a controllable level of air pressure to pass into the two stage compressor package, when air pressure, or buffing air, is used as an aid to the internal sealing of the compressor.

The discharge pipe 130 that is attached to the moisture trap 126 has a bung 170 welded thereto. A pipe nipple 171 is connected to the bung 170, which is threaded onto a coupling 172, which is connected to pipe nipple 173. A blowdown valve 174, either a solenoid or a pneumatic valve, is connected to the pipe nipple 173. The valve 174 has an exhaust muffler 175 operatively connected thereto. The valve 174 vents any trapped pressure that might be in the discharge piping 120 from the second stage compressor 114 when the compressor package is shut down or unloaded. The muffler 175 reduces the amount of noise created when any trapped air pressure is vented to atmosphere.

The moisture trap 126 has a pipe thread on its body to which is attached a tubing elbow 180. Tubing 181 is connected to the elbow 180. The tubing 181 provides pressure to another tube fitting 182, which is threaded into a bulkhead adapter 183, which is connected to a pressure transducer which monitors the discharge pressure of the second stage compressor 114.

Tube fitting 190 is operatively connected to check valve 128 via a pipe thread. As shown in FIG. 1B, the original embodiment, tubing 191 is connected to tube fitting 190 and to tubing T 192. There are two paths for the tubing to take from the tubing T 192. First, tubing 192 leads to a tube fitting 194, which is threaded into a bulkhead adapter 195, which has a pressure transducer operatively connected thereto. The pressure transducer monitors the pressure of the end user's compressed air system. Because the tube fitting 190 is connected to the end user side of the check valve, even when the compressor package 1002 is stopped there is still pressure at this location which represents the end user's pressure.

Figures 1, 2A:
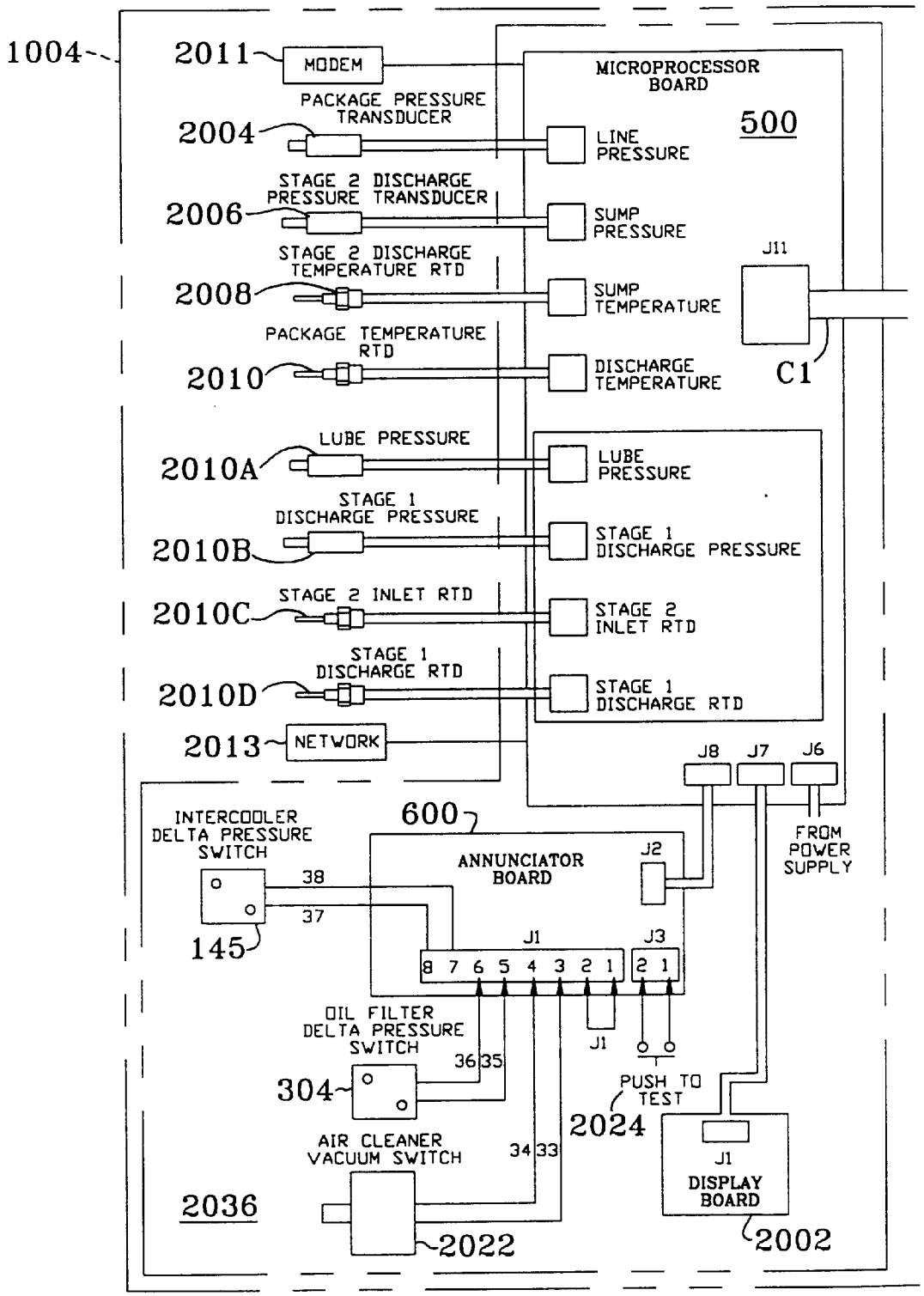
FIG. 2A is a block schematic diagram showing the electrical control elements in an early embodiment of the inventive electronic control system, connected for wye-delta operation of the compressor package motor.

Second, tubing T 192 is also connected to tubing 196, which is connected to a tube fitting 197, which in turn is threaded into a solenoid valve 198. The solenoid valve 198 is wired with wiring 200 through bulkhead adapter 199, which allows the wiring 200 to be connected to the control system 50 (FIG. 1). Solenoid valve 198 is also connected to a tube fitting 205, which is connected to tubing 206, which is connected to tubing T 207, which has tubing 208 running therefrom. The tubing 208 has a orifice 209 at the end thereof. The orifice 209 regulates, or restricts, rapid changes in air flow through tube fitting 210, which is attached to lift valve 211. The orifice 209 prevents the lift valve 211 from closing too rapidly and hammering inside the compressor package.

Figure 1C:
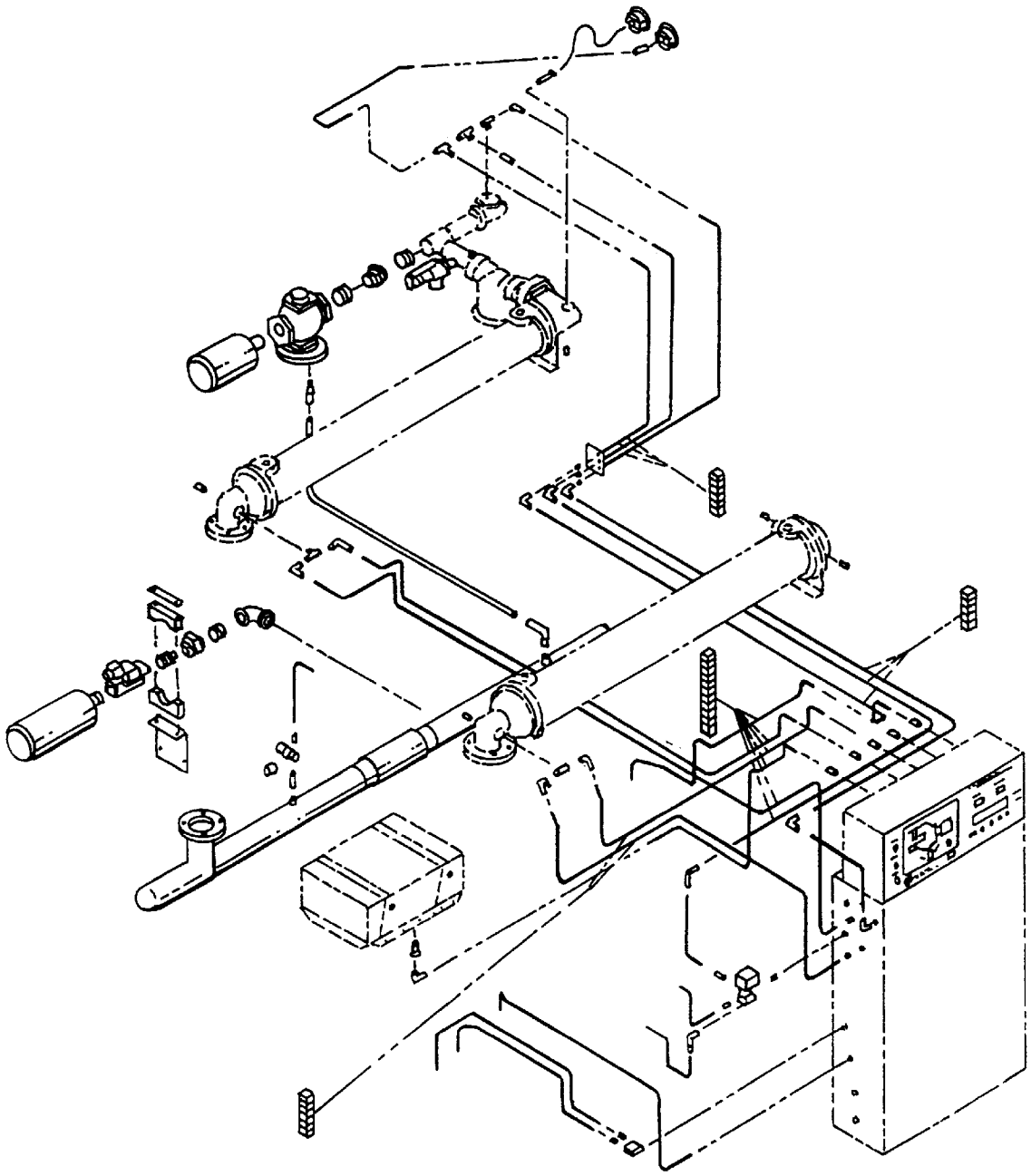
FIG. 1C is a partial exploded view of the improved operative connections of the improved control system to the compressor package of FIG. 1A.

In the improved embodiment, as illustrated in FIG. 1C, tubing 191 is connected to tube fitting 190 and to tubing 196, which is connected to a tube fitting 197, which in turn is threaded into a solenoid valve 198. The solenoid valve 198 is wired with wiring 200 through bulkhead adapter 199, which allows the wiring 200 to be connected to the control system 50 (see FIG. 1A). Solenoid valve 198 is also connected to a tube fitting 205, which is connected to tubing 206, which is connected to tubing T 207, which has tubing 208 connected thereto. Tubing 208 has a orifice 209 operatively connected thereto. Orifice 209 regulates, or restricts, rapid changes in air flow through tube fitting 210, which is connected to lift valve 211. Orifice 209 prevents the lift valve 211 from closing too rapidly and hammering inside the compressor package. In both embodiments, the first stage and the second stage compressors are controlled together Tubing T 207 also has another piece of tubing 212 operatively connected thereto, which allows the same air pressure to pass through as tubing 206. Tubing 212 has an orifice 213 operatively connected thereto for the same purposes as orifice 209.

Tubing 212 is connected to tube fitting 214 to another lift valve 215. Lift valve 215 is placed in first stage compressor 102 of the two stage compressor package. Lift valve 211 is placed in the second stage compressor 1446 of the two stage compressor package. The purpose of these lift valves 211, 215 are to allow the compressor to compress (or not to compress) air which allows the compressor to be loaded or unloaded.

A solenoid valve 198 also has a tube fitting 220, which is attached to tubing 221, which is routed to tube fitting 222, which has two paths for the transmitted pressure. One path is through tubing 223, which has an orifice placed in the end of the tubing 223. This orifice serves the same purpose as orifices 209, and 213. Tubing 223 is connected to the tube fitting 225 which is attached to lift valve 211, the second stage compressor lift valve. The purpose of tube 223 is to open the lift valve 211.

The tubing T 222 also has a piece of tubing 226 operatively connected thereto, which has an orifice 227 placed at the end thereof, which serves the same purpose as the other orifices, 209 and 213. Tubing 226 is connected to a tube fitting 228, which is connected to lift valve 215, the first stage compressor lift valve. Tubing 226 provides the same air pressure as before which is to open the lift valve.

Opening lift valves 211, 215 will again cause the compressor to unload, and closing lift valves 211, 215 will cause the compressor to load. Solenoid valve 198 controls the direction of air flow to determine whether the compressors will be loaded or unloaded. Specifically, solenoid valve 198 controls the lift valve direction, as the valve actuator is bi-directional, i.e. open or closed.

The two stage compressor package 1002 includes an oil filter 300. The oil filter 300 filters the oil used to lubricate the internal bearings and gears, which are isolated from the compression chambers of each of the two stage compressors 102, 114. Oil passes through the oil filter 300 which includes some threaded ports used to operatively connect a tube fitting 301. Tubing 302 is routed to a tube fitting 303 which is connected to a delta pressure switch 304.

There is another threaded port operatively connected to the oil filter where a tube fitting 305 is connected into tubing 306, which is connected to a tubing T 307. One of the paths for the pressure from the T 307 is to a piece of tubing 308, which is connected to a tube fitting 309, which is also threaded into delta pressure switch 304. The purpose of the delta pressure switch 304 is to determine when the oil filter 300 becomes sufficiently loaded with contaminates from the oil to require servicing and replacement. The control system 52 senses a signal from the delta pressure switch 304 to indicate this condition.

From the T 307, there is another pressure path to tubing 310, which in turn is connected to tube fitting 311, which is, operatively connected, such as, for example, by being threaded into a bulkhead adapter 312. The bulkhead adapter 312 has a pressure transducer operatively connected thereto. The pressure transducer is used for monitoring the oil pressure at this location and for providing a shutdown signal should that oil pressure fall below about ten (10) psi for the oil free two stage compressor package 1002.

As can be seen with reference to FIG. 1C, a partial exploded view of the improved embodiment, certain portions of the control system sensors have been eliminated as redundant or have been rerouted or configured more effectively. Specifically, tubing 147 and the related hardware for delivering the pressure the cooler 106 to the delta pressure switch 145 has been eliminated in the latest, improved embodiment since it was been determined that sensing the delta pressure at the cooler exit was not necessary for proper system control. Further, the T 192 has been eliminated as well as the tubing 193 and the associated hardware connecting the T 192 to a pressure transducer in the control panel. The tube fitting 190 is replaced by a T which operatively connects two separate tubes, replacing tubes 191, 196 and 193, directly to tube fittings 194, 195, respectively FIG. 2A is a block schematic diagram illustrating the electrical control elements of the original embodiment of the electronic control system 1004 or the POWER$YNC® II control system 52 as shown in FIG. 1A. As shown in FIG. 2A, electronic control system 1004 includes relay board 400, microprocessor board 500, annunciator board 600, display board 2002, package pressure transducer 2004, second stage compressor discharge pressure transducer 2006, first stage compressor discharge temperature transducer 2008, package temperature transducer 2010, modem 2011, power and relay connections 2012, network connection 2013, oil filter delta pressure switch 304, air cleaner vacuum switch 145, and lamp test button 2024. The microprocessor board 500 also includes lube pressure transducer 2010A, first stage compressor discharge pressure transducer 2010B, second stage compressor inlet temperature transducer 2010C, and first stage compressor discharge temperature transducer 2010D.

Electronic control system 1004 is connected to motor 2014 which, as illustrated, is powered by three phase AC power supply lines L1, L2, and L3. The power supply lines are connected to motor 2014 through appropriate conventional overcurrent protection circuits (not shown). A fan and a fan motor 2016 is provided for both water and air cooled versions. For the water cooled version, the fan keeps the cabinet at a reasonable temperature by exhausting the motor's heat, and heat from other sources.

Preferably, microprocessor board 500, annunciator board 600, and display board 2002 are installed in a control housing 2036 (see FIG. 1B) and connected to relay board 400 and the temperature probes (2008, 2010, 2010C, 2010D) and pressure transducers (2004, 2006, 2010A, 2010B) by appropriate cables. Relay board 400, along with power and relay connections 2012, are preferably installed in housing 1006. Modem 2011 may be installed in control housing 2036 or may be a standalone component. Network connection 2013 provides a network interface connection for linking multiple electronic control systems 1004 at a site. Preferably, network connection 2013 provides an ARCNET standard peer-to-peer network interface.

Microprocessor board 500 has a connector J11 which is connected by a cable to connector JP3 of relay board 400. Microprocessor board 500 is also connected to package pressure transducer 2004 and package temperature probe 2010, via connections 2004L and 2010L, respectively. Package pressure transducer 2004 measures the pressure in the end users compressed air line being serviced by compressor package system 50, and package temperature probe 2010 measures the temperature of the package discharge air. Similarly, microprocessor board 500 is operatively connected to second stage discharge pressure transducer 2006, via line 2006L which measures pressure at the discharge of the second stage compressor, and second stage discharge temperature probe 2008 via line 2008L which measures the discharge temperature at the second stage compressor. Temperature probes 2010, 2008, 2010C and 2010D are preferably resistance temperature measurement devices, such as, for example those manufactured by Minco. Thus, microprocessor board 500 can monitor all pressures and temperatures at the various states of the compressor package and control the operation of the compressor package system accordingly.

Microprocessor board 500 has another connector, identified as J7, which is connected through a cable to connector J1 of display board 2002. Display board 2002, presently preferably, includes a four line by 40 character liquid crystal display (LCD) installed on a front panel of housing 2036, and also includes driver circuits for displaying information on the liquid crystal display. The connection of microprocessor board 500 to display board 2002 permits microprocessor board 500 to activate the driver circuits of display board 2002 and thus control the liquid crystal display to provide information to the compressor package system operators and maintenance personnel.

Microprocessor board 500 is provided with a serial interface for connecting to modem 2011, which may be a conventional wire line telephone modem. Modem 2011 permits communication between electronic control system 1004 and remotely located stations for purposes of real time operations monitoring, maintenance and service diagnosis, transmission of status reports, and downloading operating firmware for electronic control system 1004 (see FIG. 8). In a modem mode of operation, electronic control system 1004 can be called by a phone line from a remotely located personal computer. When a connection is made, the remote PC can access all information of electronic control system 1004 that can be accessed by a local operator. All operating parameters, service information, and shutdown records stored in electronic control system 1004 are transmitted to the remote PC. All sensor input information, including sensed temperatures and pressures, are transmitted to the PC on a real time basis. The information displayed for the operator of electronic control system 1004 is also displayed on the remote PC. All of the stored operating parameters of electronic control system 1004 can be modified by the operator of the PC through transmissions over the link established through modem 2011.

In addition, new control firmware may be downloaded to electronic control system 1004 from the remote PC, and stored in flash memory provided for that purpose on microprocessor board 500. To cause entry into a firmware download mode, a local operator must power down electronic control system 1004, and hold down the F3 button in switch array 704 while powering up electronic control system 1004. During and after the firmware downloading process, electronic control system 1004 is also programmed to perform integrity checks on downloaded firmware, such as byte-by-byte verification and/or checksum verification, to ensure integrity of the new firmware before permitting restarting of compressor package 1002. The details of the operation of the remote PC will be described later with respect to FIG. 8.

A local RS232 port, P1 in FIG. 5*g*, will also be provided as part of microprocessor board 500 in a manner which will be described in more detail. This local RS232 port can be used to connect electronic control system 1004 to a local PC. Electronic control system 1004 will provide the same control, monitoring, and firmware updating functionality via the local RS232 port, the only difference being that the PC will be directly connected to electronic control system 104 rather than being connected via modem 2011.

Connector J8 of microprocessor board 500 is connected through a cable to connector J2 of annunciator board 600. Annunciator board 600 is connected through connector J1 to oil filter delta pressure switch 304 and air cleaner vacuum switch 145. Oil filter delta pressure switch 304 is connected across lubricant filter 300 (shown in FIG. 1) to provide an indication when there is a significant difference in pressure before and after filter 300, indicating that filter 300 requires service. There is a lamp test button 2024 to J3 in order to test the annunciator lamps on the annunciator board 600.

As part of power and relay connections 2012, a power supply 2018 is provided for the electronic components on relay board 400, microprocessor board 500, annunciator board 600, and display board 2002. Power supply 2018 is connected to microprocessor board 500 through connector J6.

Power and relay connections 2012 also include a normally open start button 2026, a normally closed stop button 2028, and a mode switch 2030 (SS1). Mode switch 2030 allows the operator to select an automatic operation mode, using the microprocessor of electronic control system 1004, or a back-up operation mode. A set of contracts 2030C are provided by switch 2030 to remove power from relay board 400 when back-up mode is selected. The back-up mode is provided in case of failure of electronic control system 1004 or any of its sensors or switches. The piping of compressor package system 50 includes a redundant pneumatic/mechanical control system which operates based on pressure switches. Thus, if electronic control system 1004 fails and continued operation of compressor package 1002 is essential, compressor package system 50 can be operated in a back-up, non-electronic control mode to maintain an air supply to the service air system while awaiting repair of electronic control system 1004. The lift valves 211 and 215 (See FIG. 1B) are connected to be open in the absence of control signals, so that in case of a control failure, the lift valves will automatically remain open so the compressor package 1002 is unloaded.

Vent fan motor contactor M2 is connected in series with the start button 2026, stop button 2028, compressor motor contactor M1, and overload detection OL2 and is activated whenever compressor motor 2014 is operating, as long as there is no overload of fan motor 2016. There is also a power line 2032 from relay board 400 connected to overload detection OL2, OL1 and relay CR2 in parallel with the connection of start button 2026, stop button 2028, and compressor motor contactor M1. Thus, the circuit maintains power to fan motor contactor M2 whenever the contactor M1 contacts are closed. Preferably, the circuit maintains power to fan motor contactor M2 after the stop button is pushed or a shutdown command is received, until the system detects an actual shutdown of compressor motor 2014. The inventors have found that if the compressor motor contactor becomes stuck in a closed condition, so that the motor continues to operate despite pressing of stop button 2028 or issuance of an automatic shutdown command, there is a danger of overheating if fan motor 2016 obeys the shutdown command. Thus, the system of the present invention is designed to maintain operation of vent fan motor 2016 through contactor M1 auxiliary contacts until shutdown of compressor motor 2014 is accomplished by removal of the main power.

FIG. 2A shows the original method provided to ensure that there is water flow through all water cooled coolers. These are used on the innerstage as well as the discharge of the illustrated compressor package. Start button 2026 has in parallel a relay contact labeled as CR1, a timer contact, labeled as TR4, and a flow switch, labeled as FS1. The flow switch FS1 is in the water stream and will close if flow is present. The control also has a water shutoff valve shown in the body of the circuit which, when the unit is stopped, will shut all water flow off to conserve water usage. When the unit is started there is no water flow, so timer TR4 provides a momentary delay to allow the water shut-off solenoid valve to be energized and therefore allow flow of water into the cooler system. When this is accomplished, flow switch FS1 will close and shortly after that, TR4 timer relay contact in parallel with start button 2026 will open providing for a safety circuit should flow switch FS1 open because of water flow not being present. This will shut the compressor package down.

Figures 2, 2A:
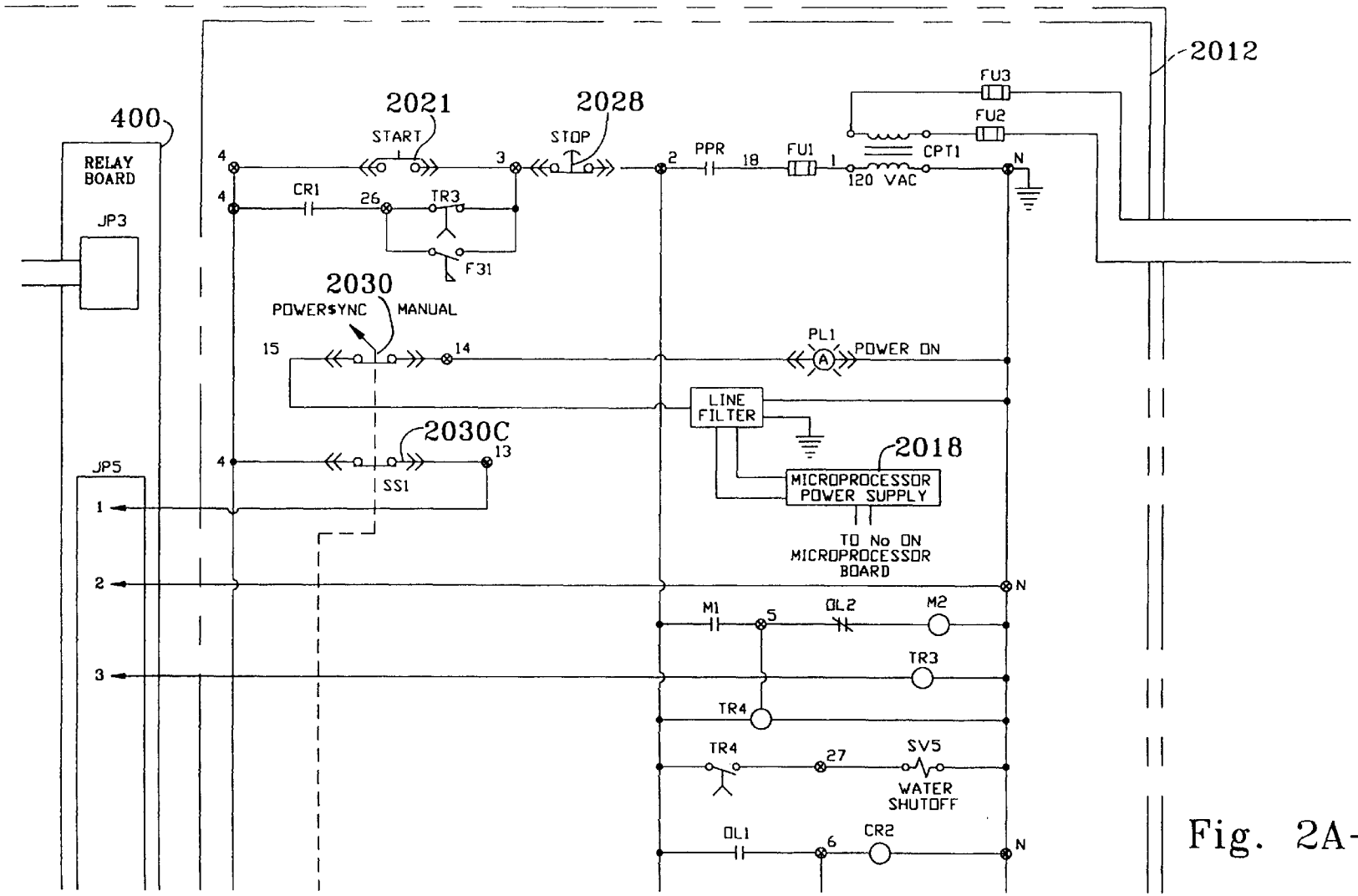
Figure 2A:
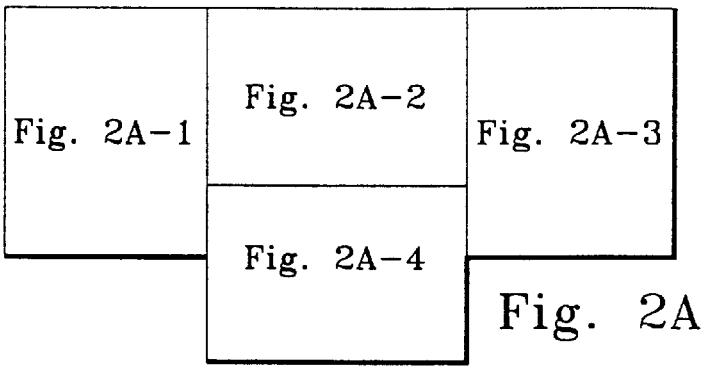
Figures 2, 2A, 3:
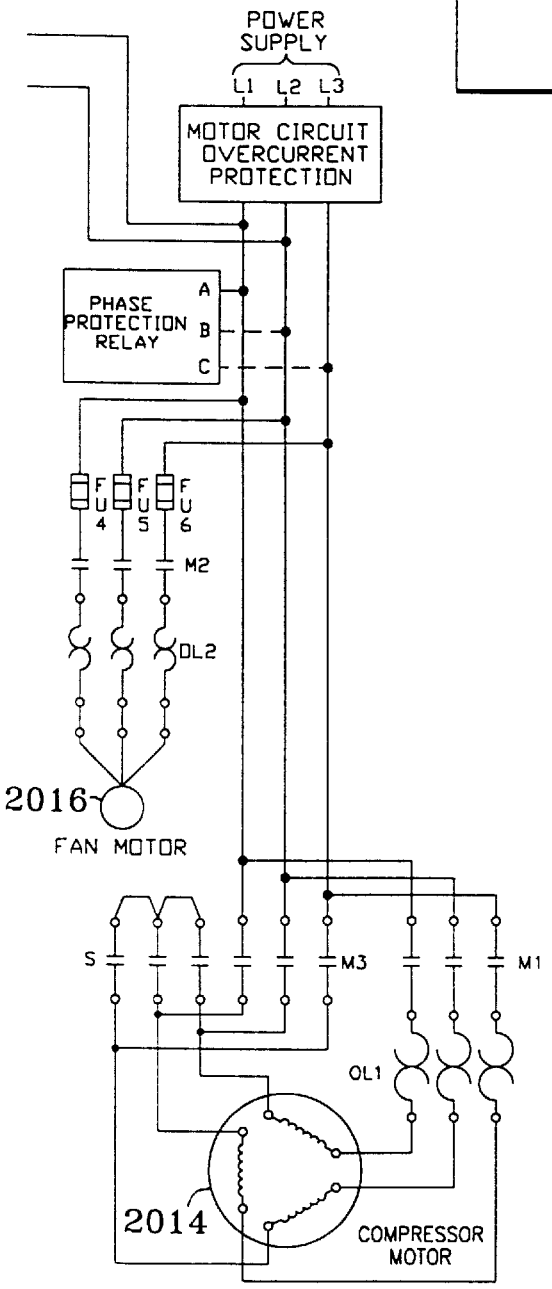
Figures 2, 2A, 3, 4:
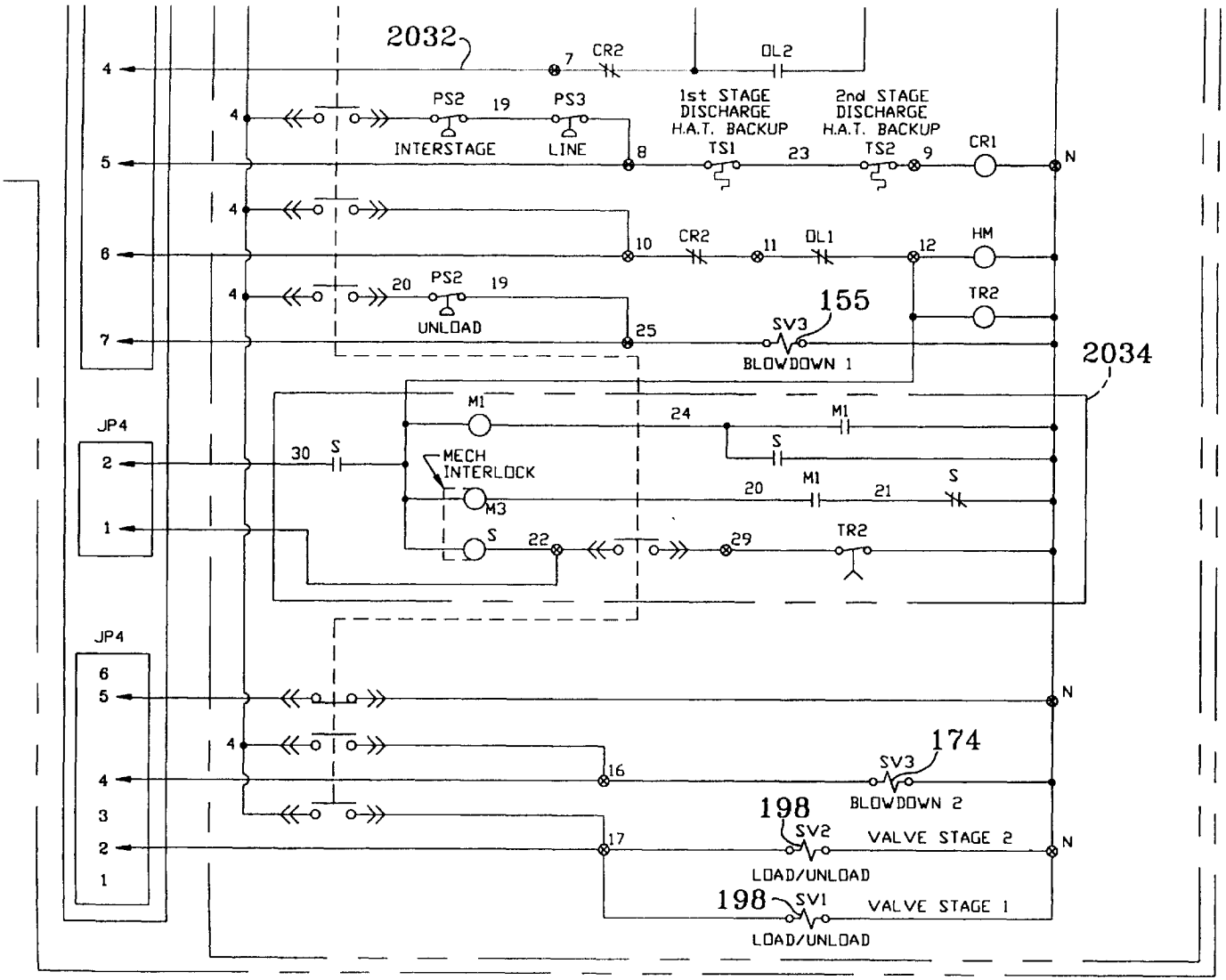
Figures 1, 2B:
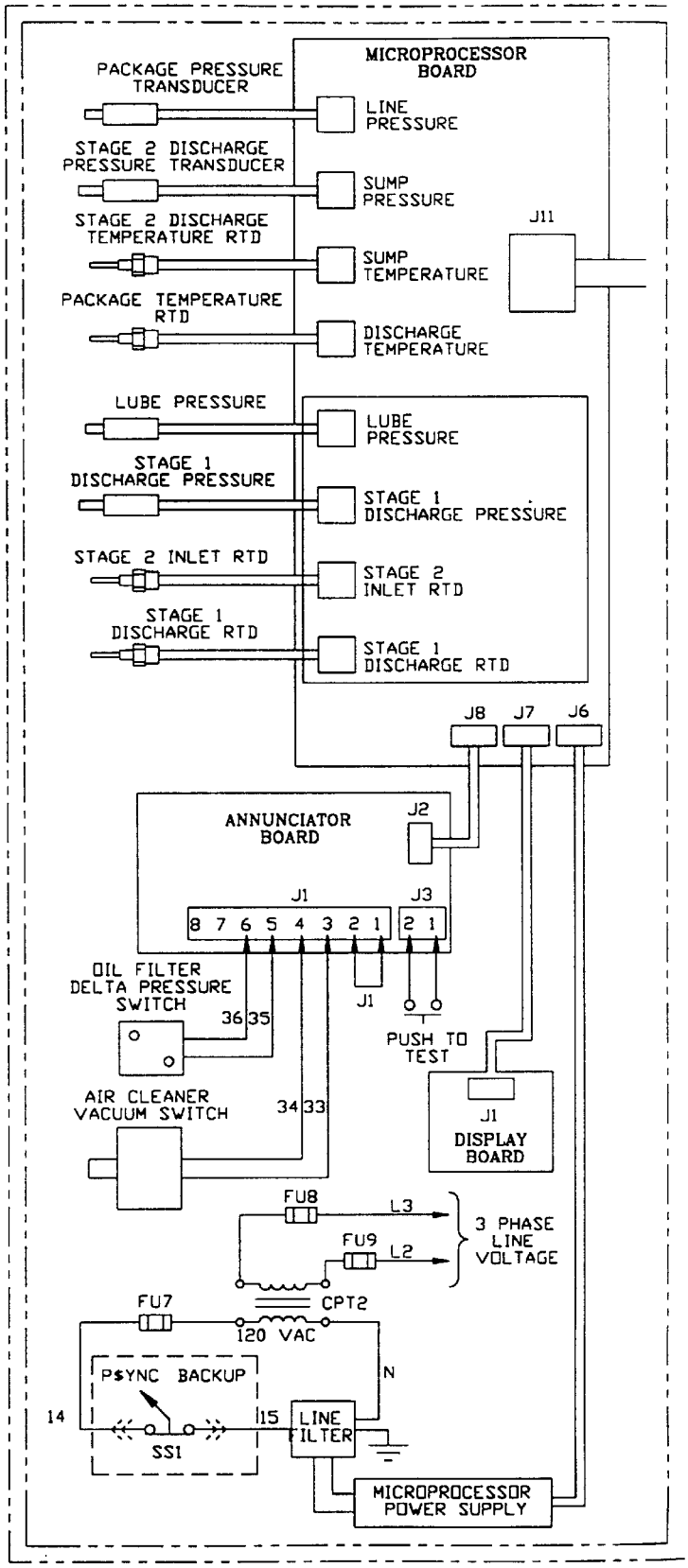
FIG. 2B is a block schematic diagram showing the electrical control elements in the presently preferred embodiment of the inventive electronic control system, connected for wye-delta operation of the compressor package motor.
Figures 2, 2B:
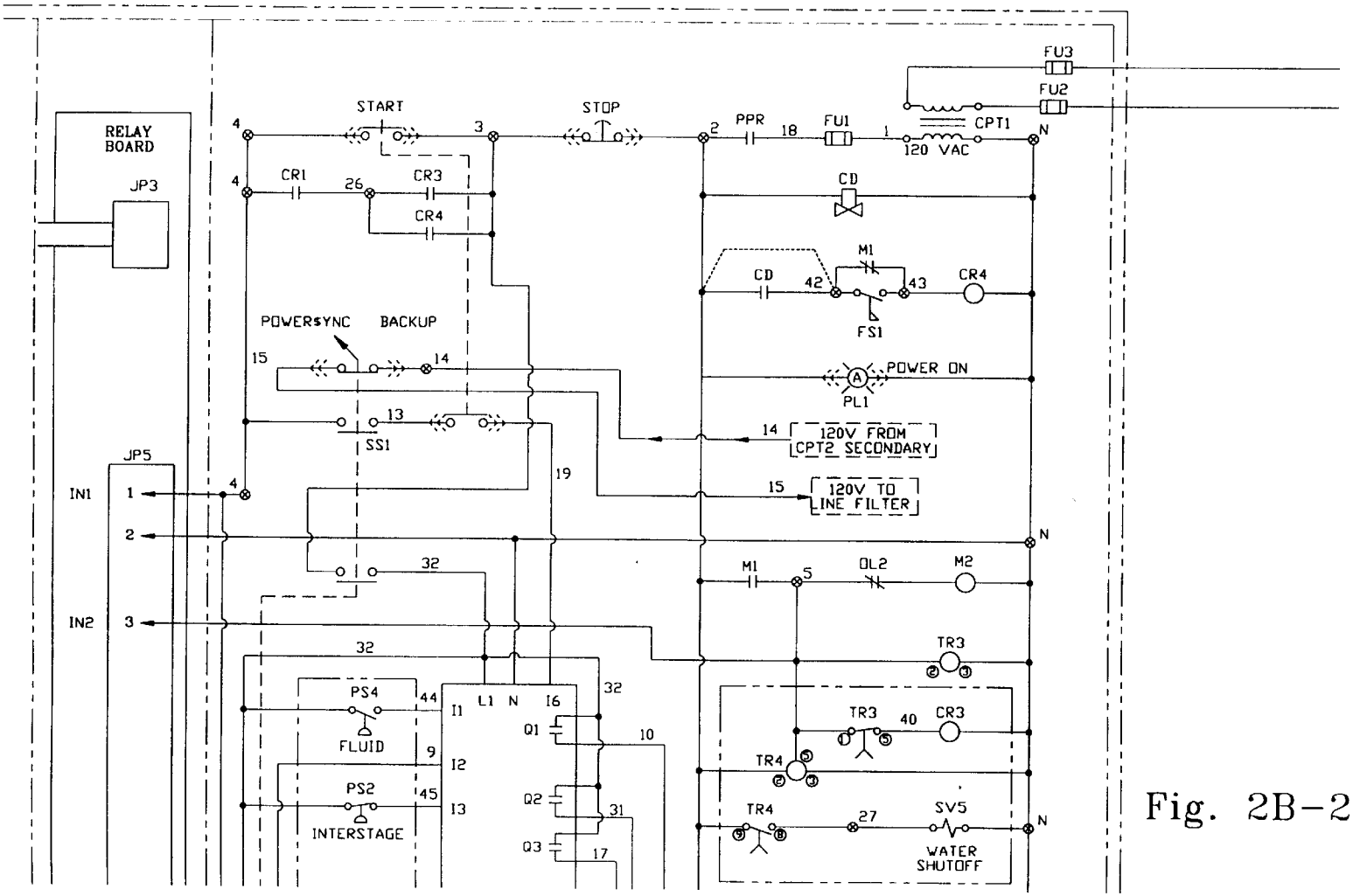
Figures 2, 2B, 3:
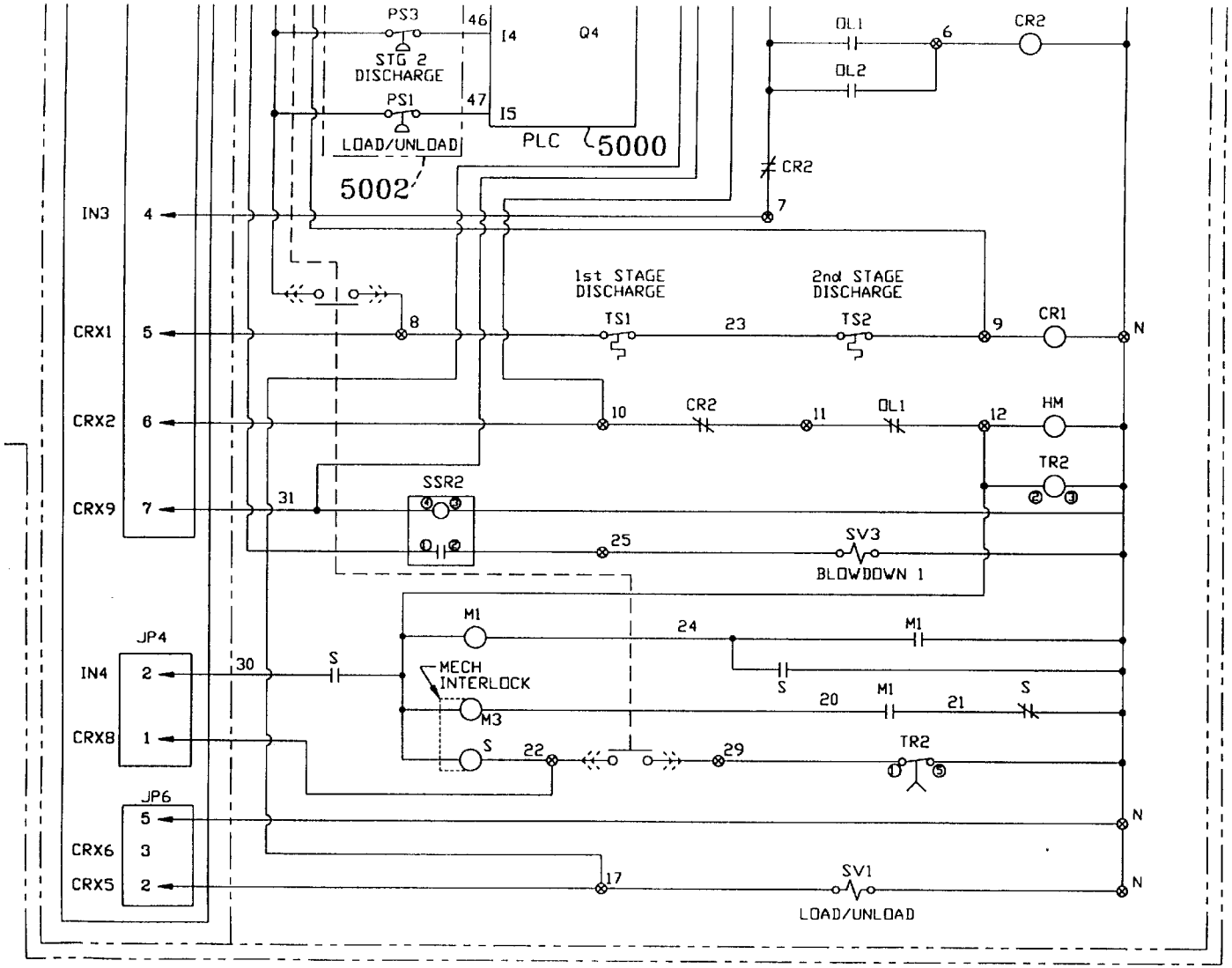
Figures 2, 2B, 3, 4:
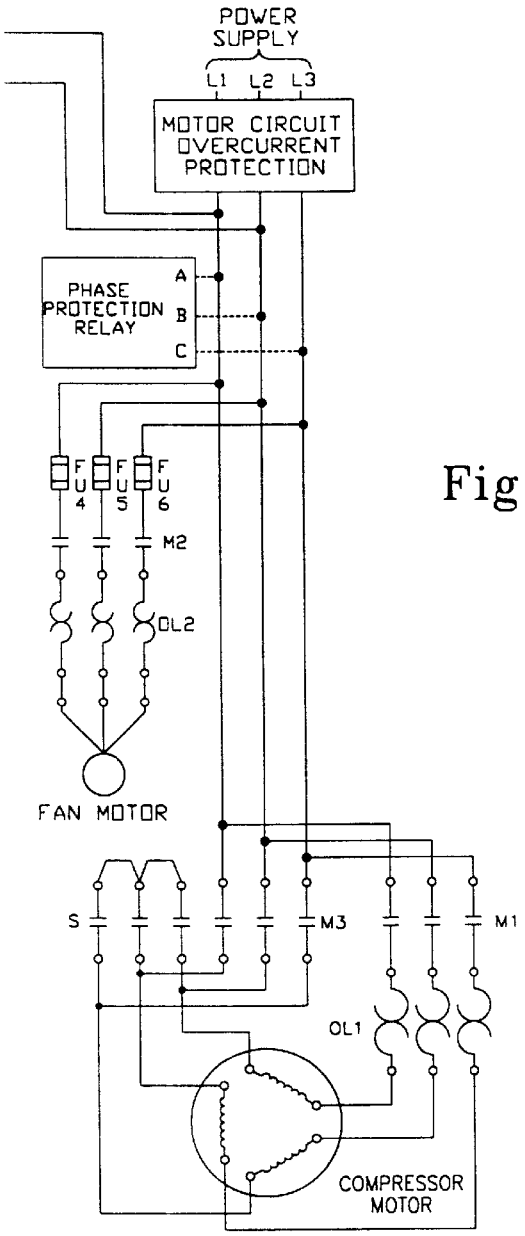
Figure 2B:
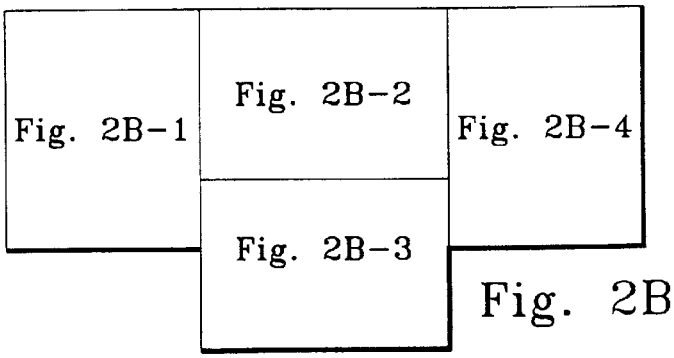

In the embodiment shown in FIG. 2B, the relay connections 2012 are connected to control changeover of power connections to the compressor motor so that compressor motor 2014 can be operated in a wye-delta configuration. Connector JP4 of the relay board is connected to a wye-delta switching circuit 2034 that controls contactors M1, S, and M3 to selectively switch between wye and delta power connections for compressor motor 2014. If wye-delta operation is not desired, the circuit could be modified to provide an across-the-line control and power configuration, as shown in FIG. 3. In this alternative configuration, wye-delta switching circuit 2034 is eliminated and compressor motor 2014 operates using only contactor M1, which connects the three power phases through overload protection OL1 to compressor motor 2014. In this alternative configuration, no connections are made to connector JP4 of relay board 400. Timing relay TR2 is eliminated. Instead of being connected to control relay TR2 and to power hour meter HM, the connection of pin 6 of connector JP5 through normally closed contacts of relays CR2 and OL1 controls contactor M1 and powers hour meter HM, and has no connection to wye-delta switching circuit 2034.

In another embodiment (not shown), it is possible to use a remote starter with compressor motor 2014 by inserting a remote starter between the three phase power supply and compressor motor 2014. In this embodiment, a control relay is provided to actuate the remote starter. The control relay is connected in place of contactor M1, in the same manner shown in FIG. 2 to provide a two-wire control of the remote starter.

A later, improved embodiment is illustrated in FIG. 2B, The differences between the embodiment of FIG. 2A, an early version of the control system useful with the compressor package of the present application, and FIG. 2B, a production version of the wye delta start condition configuration, is primarily the addition of the backup controller and the water shutoff circuitry. The backup controller is labeled 5000 in FIG. 2B. The backup controller includes four pressure switches labeled PS1 through PS4 at 5002, which are used with the backup controller 5000 to operate the compressor in a temporary manner in the event that the microprocessor control should fail. Additionally, there is new water shutoff circuitry having a water shutoff solenoid labeled SV5.

A timer labeled TR4 is operatively positioned in the circuit and is operatively connected to a circuit having another timer labeled TR3. A coil labeled CR3 is operatively connected to the timer TR3 and to a set of contacts. When the compressor package is shut down and the normally closed solenoid valve SP5 is de-energized, there is no water flow. In order for the flow switch to see any water flow, the flow switch circuitry must delay the signal that the solenoid valve SP5 is shut down. This is accomplished by using the timers to energize relay CR3 that allows the compressor package to start. Once the compressor package starts, the water shutoff valve is energized and is open so that there is water flow to the compressor package. At this point, the timer times out and de-energizes CR3. Once CR3 is de-energized, there should be water flow. If there is no water flow, then CR4, which is connected to the flow switch FS1, would also open. The CR4 relay was added to the circuit because the contacts provided with the flow switch FS1 were not sufficiently heavy duty to carry the current load. A further advantage was the use of a set of normally closed M1 contacts across flow switch FS1 to initially energize the CR4 relay and then to open the CR4 relay once the compressor package was started. If there was no flow, the set of normally closed M1 contacts would de-energize the CR4 relay.

Figures 1, 3A:
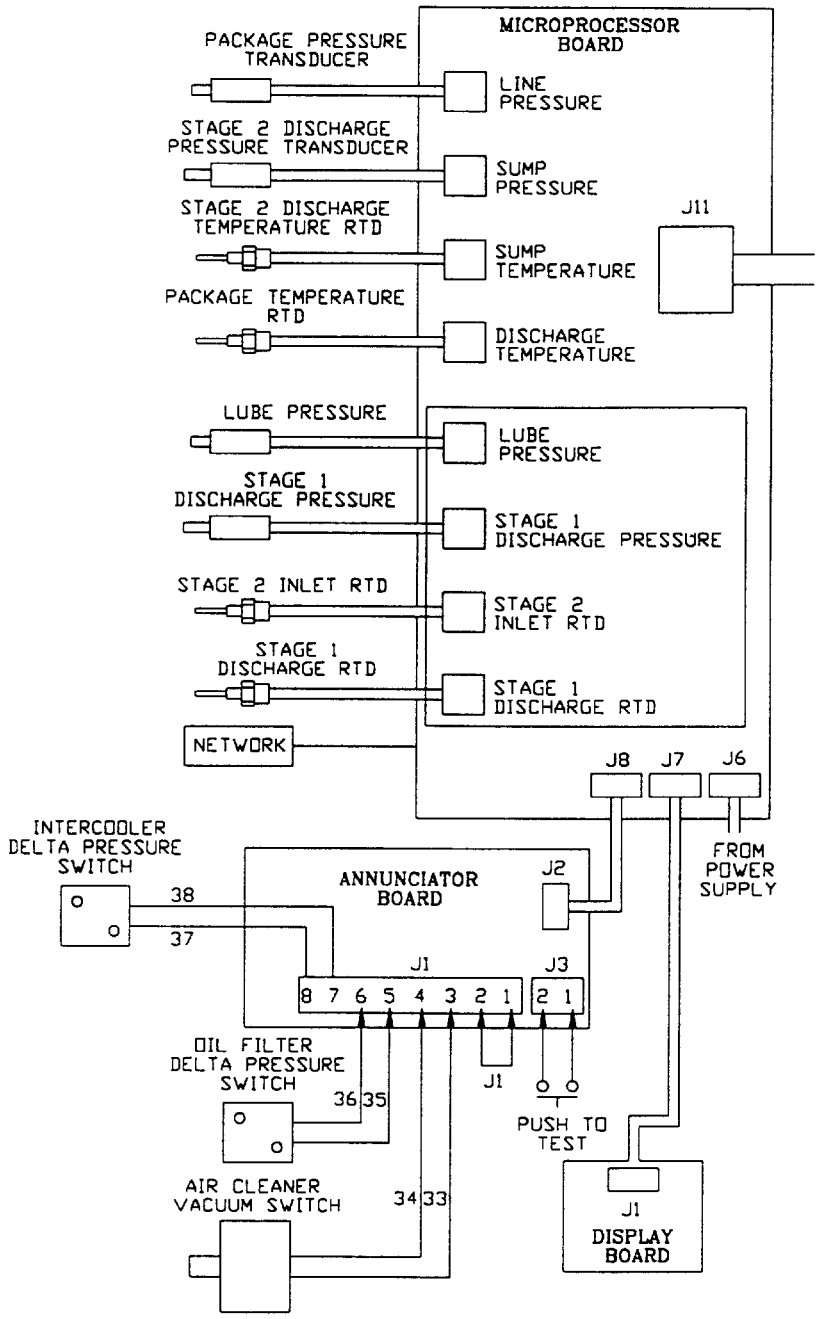
FIG. 3A is a block schematic diagram showing the electrical control elements in an early embodiment of the inventive electronic control system, connected for non-wye-delta operation of the compressor package motor.
Figures 2, 3A:
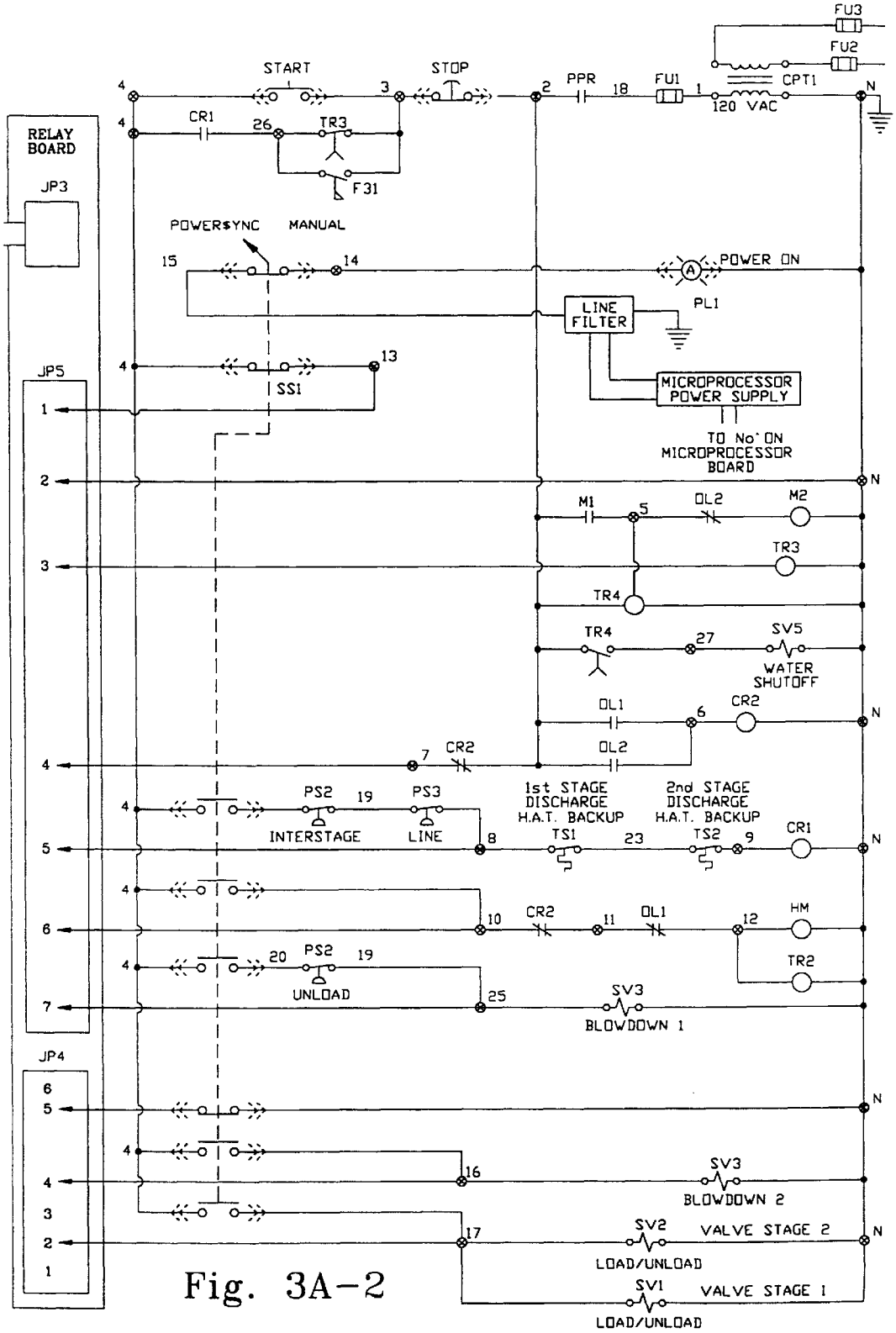
Figures 3, 3A:
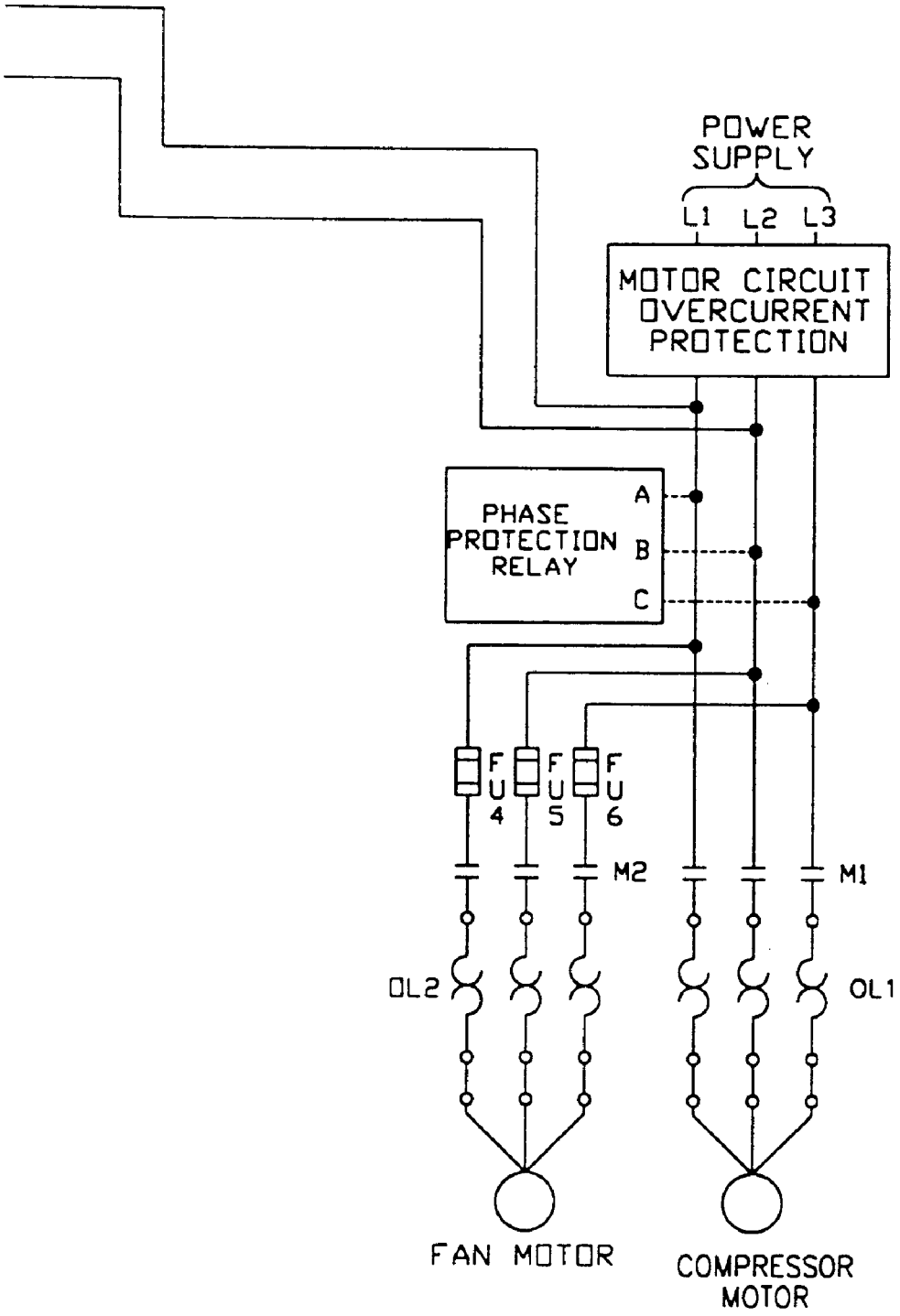
Figures 1, 3B:
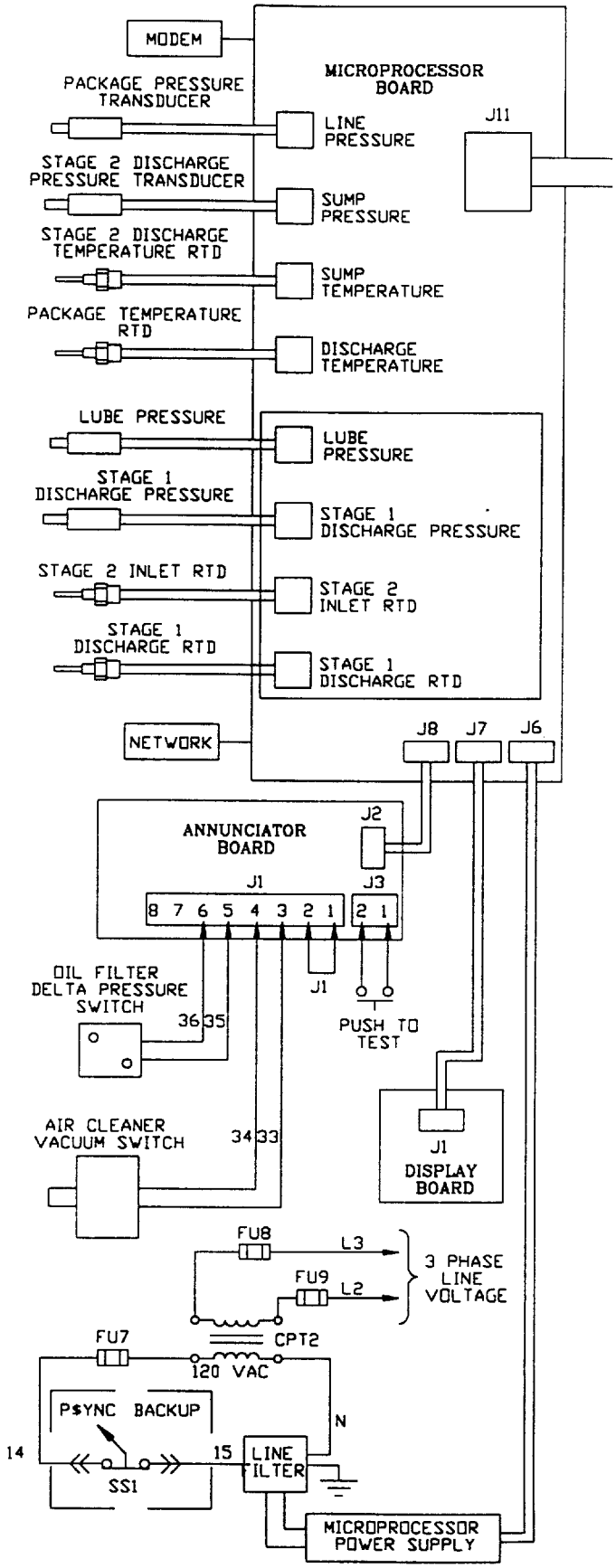
FIG. 3B is a block schematic diagram showing the electrical control elements in the presently preferred embodiment of the inventive electronic control system, connected for non-wye-delta operation of the compressor package motor.
Figures 2, 3B:
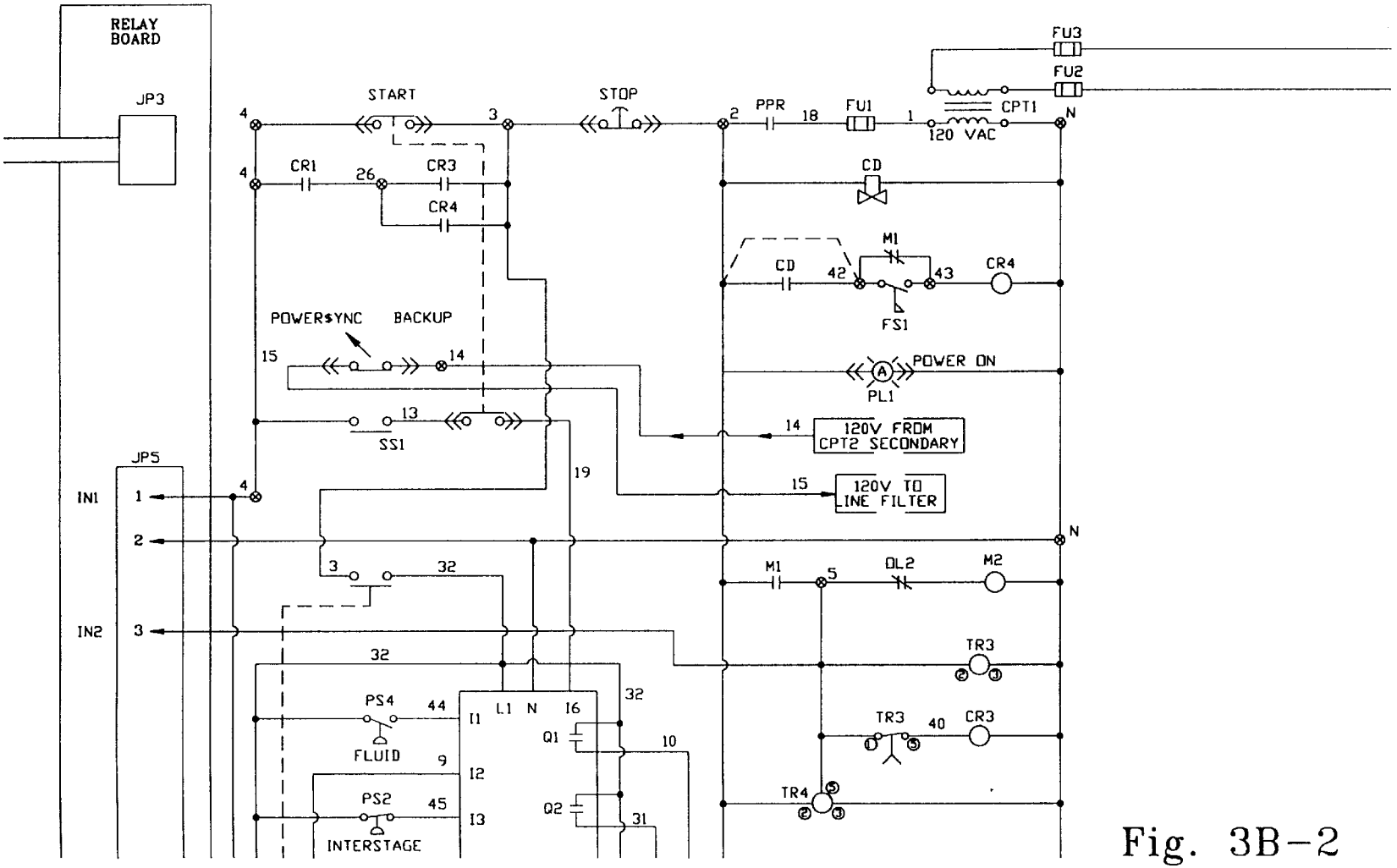
Figures 3, 3B:
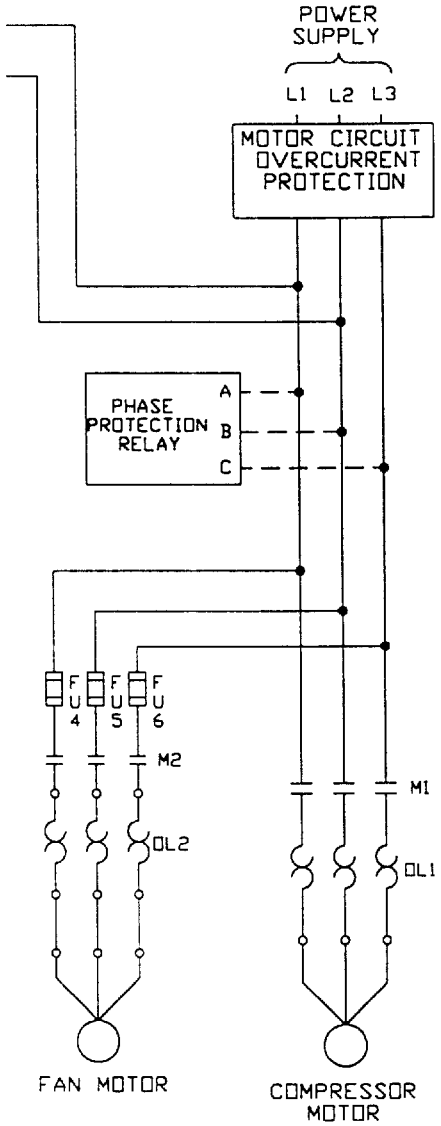
Figure 3B:
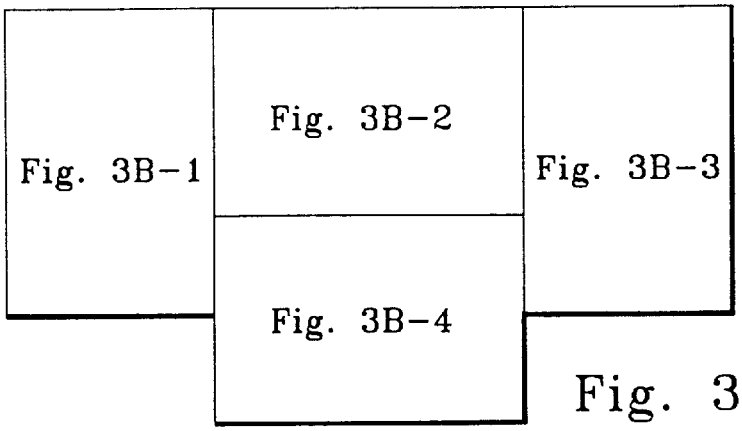
Figures 3, 3B, 4:
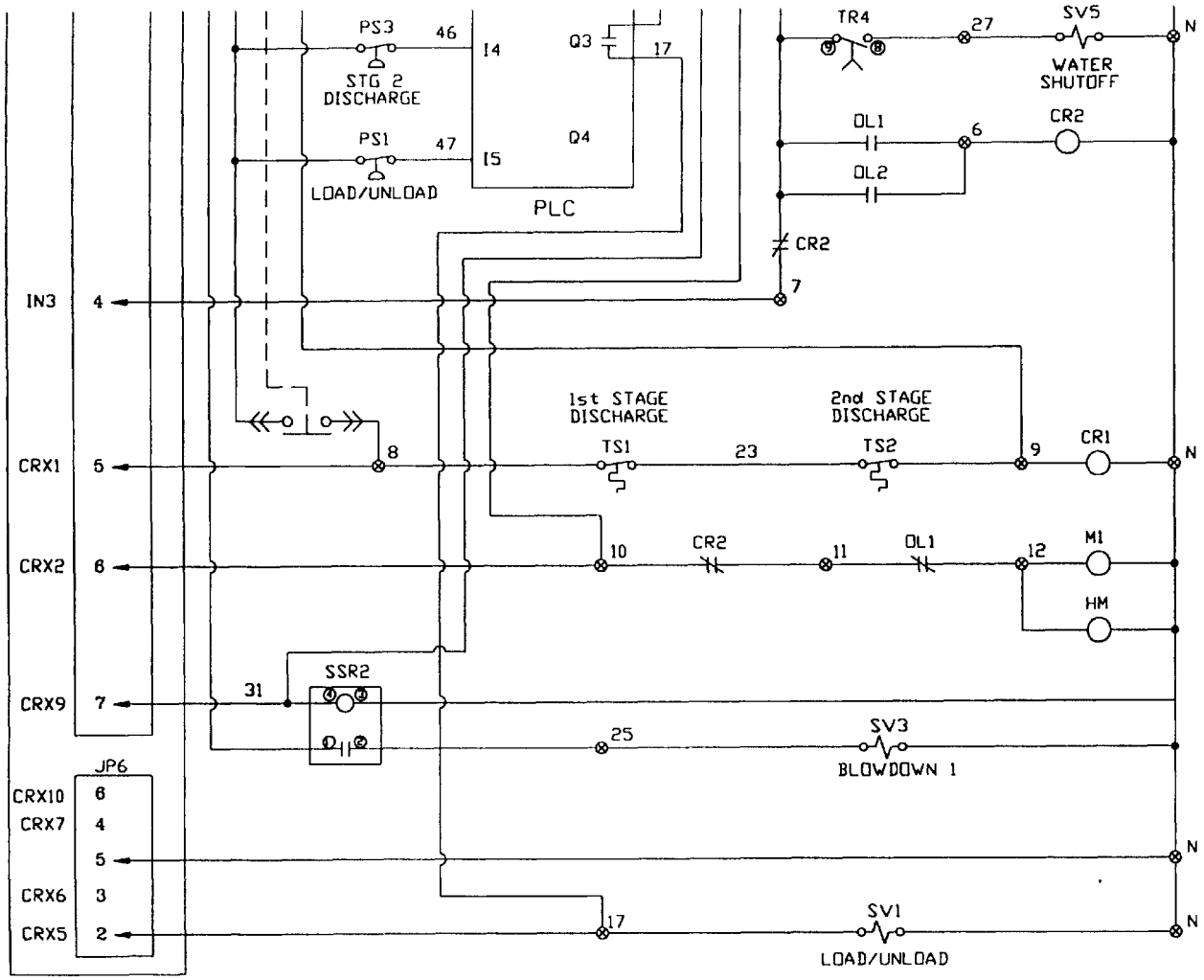

FIGS. 3A and 3B are identical to FIGS. 2A and 2B respectively except that FIGS. 3A and 3B illustrate the configuration for non-wye-delta operation of the compressor package motor.

Figures 1, 4A:
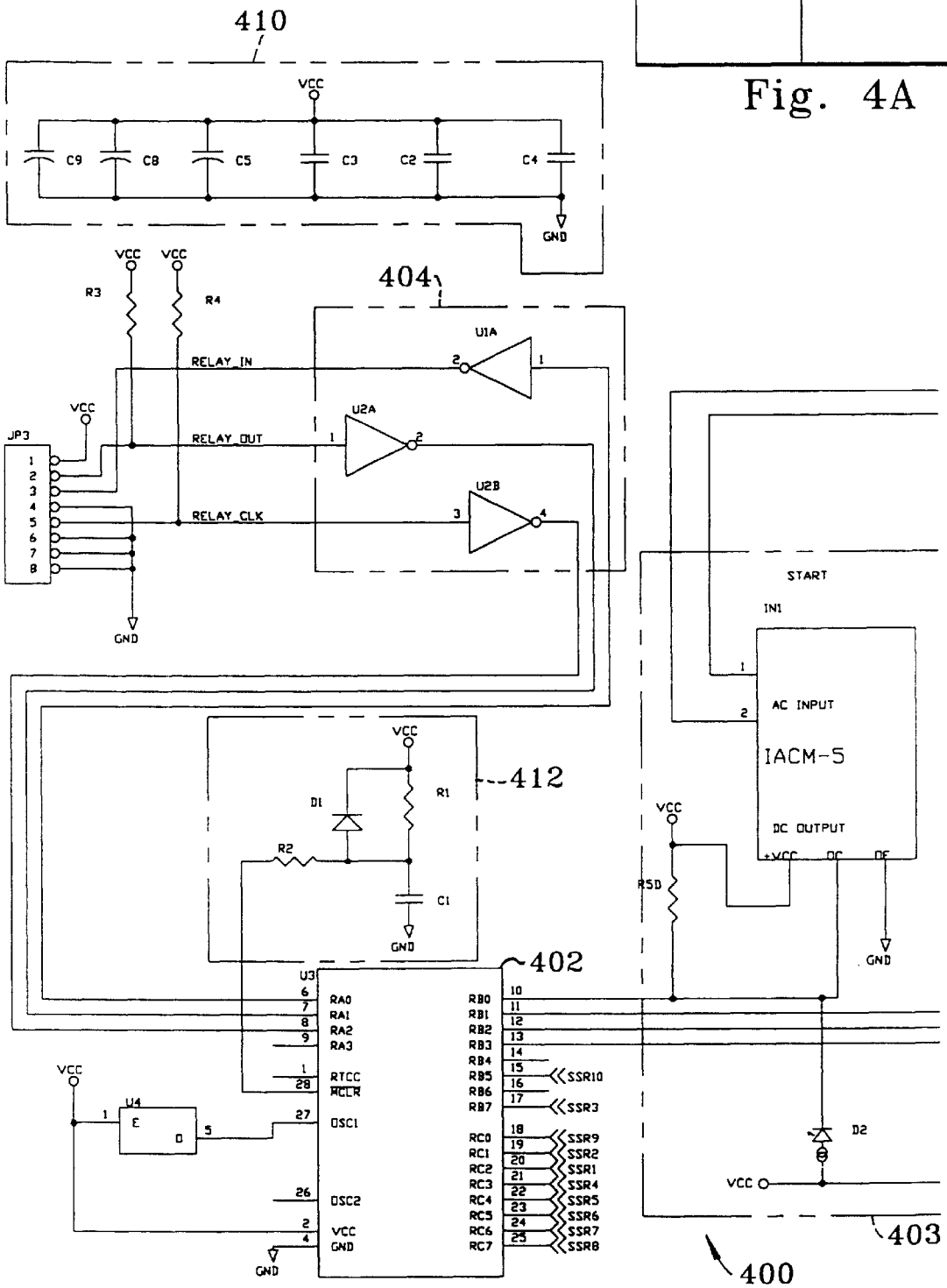
FIGS. 4*a* and 4*b* are schematic diagrams of the relay circuits used in the relay board of the electronic control system used with the present application.
Figures 2, 4A:
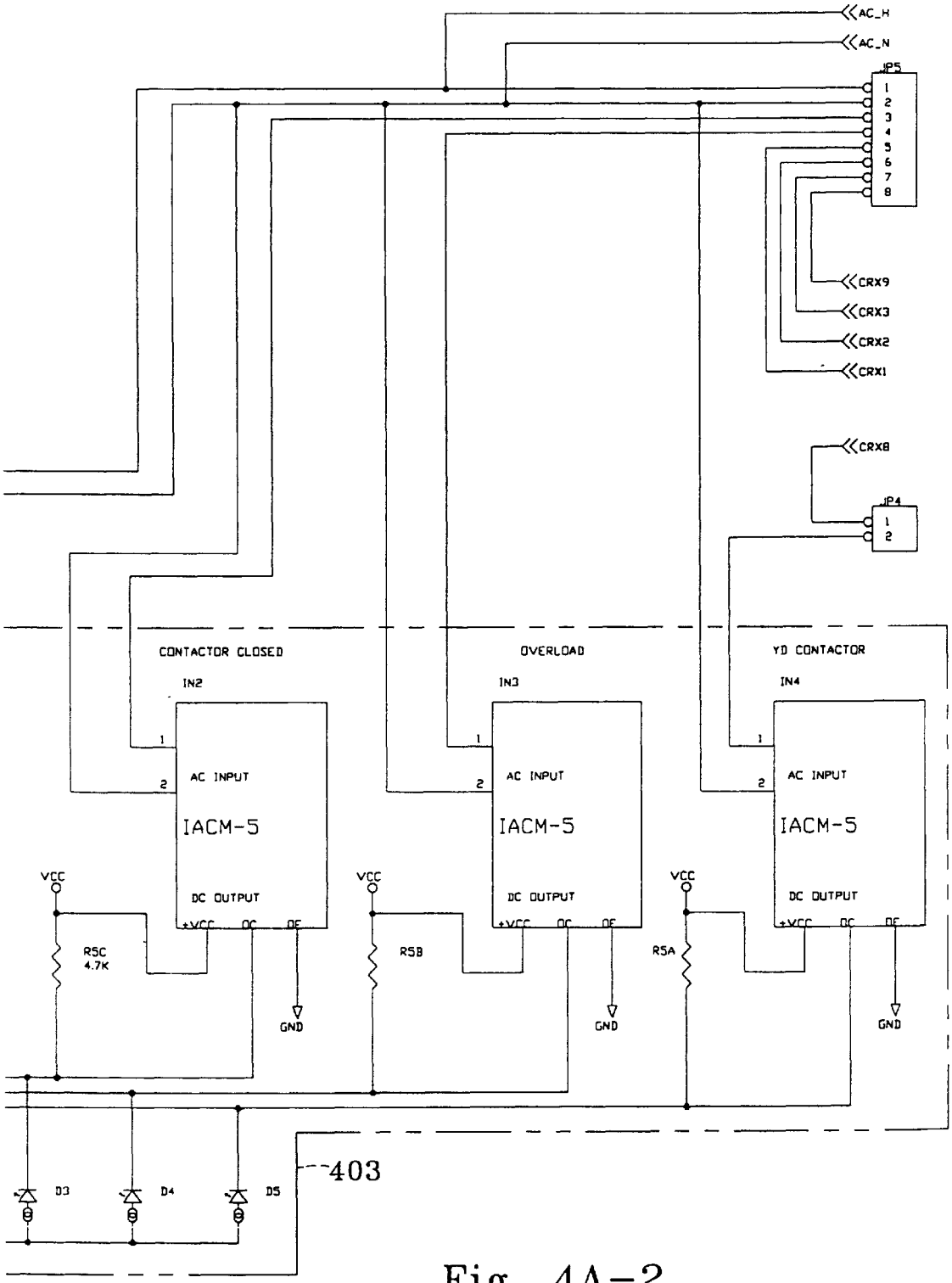
Figure 4B:
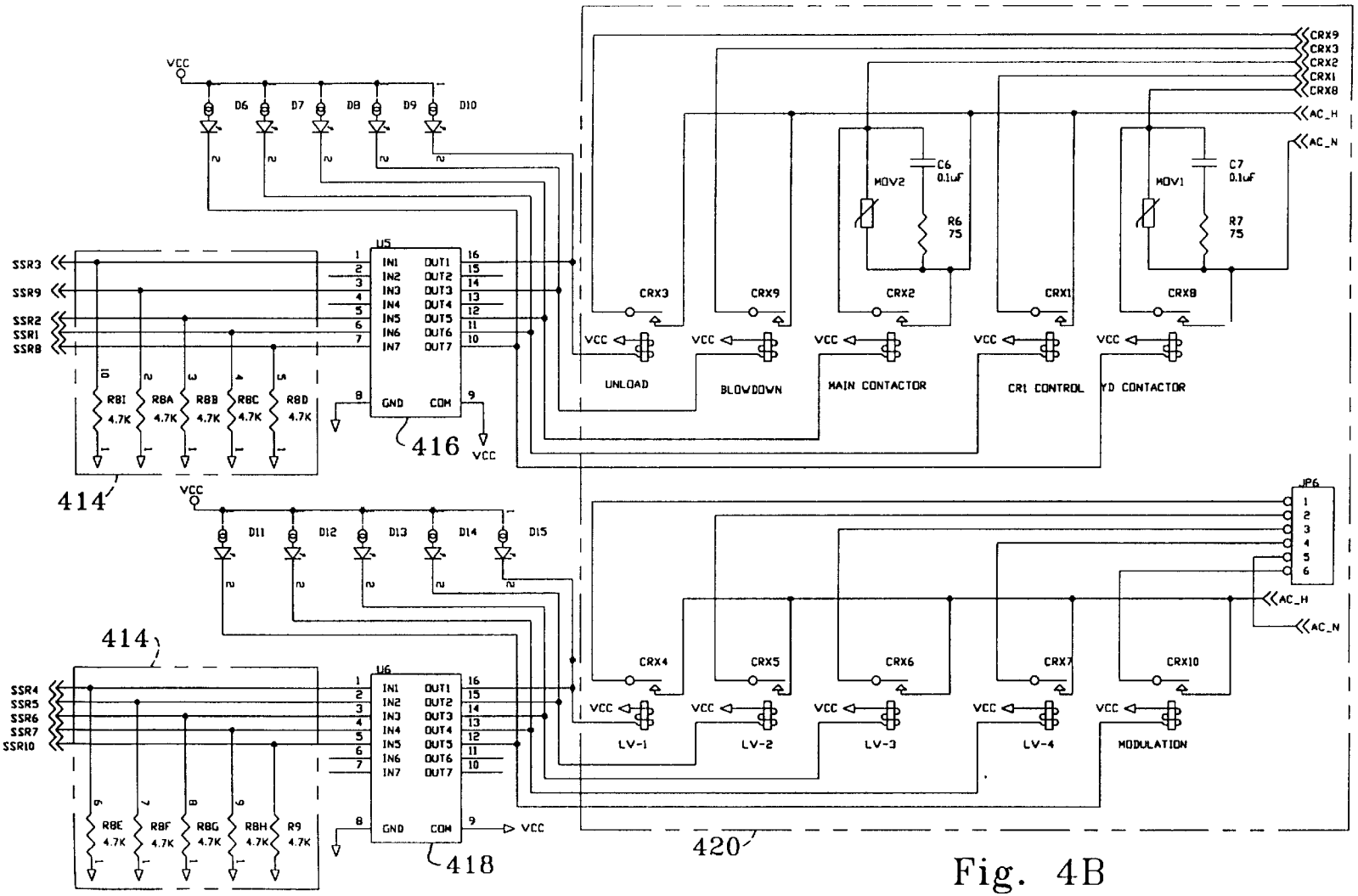

FIG. 4, consisting of FIGS. 4*a* and 4*b*, is a schematic diagram of the relay circuits used in the relay board 400 of electronic control system 1004. Referring now to FIG. 4*a*, a serial communications processor 402 is provided on relay board 400. Serial communications processor 402 may be a PIC16C57/HS/P microcontroller manufactured by Microchip or other processor providing at least equivalent functions. Processor 402 is connected to and clocked by a twenty (20) MHz oscillator 406. A conventional 5 VDC power source Vcc (not shown in schematic detail) is provided through the serial communications cable C1 (FIG. 1) and connector JP3 for serial communications processor 402 and other elements on relay board 400. A capacitor array 410 and a protective diode circuit 412 are connected between Vcc and ground.

Serial communications processor 402 is connected through buffers 404 to connector JP3, which is connected through cable C1 to the microprocessor board 500 of the present application (described in detail below with reference to FIG. 5). Pins 2, 3, and 5 of connector JP3 are used to carry serial data in a TTL logic drive arrangement. Pins 4 and 6–8 of connector JP3 are grounded and pin 1 is connected to Vcc.

Four input/output ports of processor 402, RB0 through RB3, are connected to the DC outputs of input modules 408 (IN1 through IN4). Input modules 408 are connected to sense the presence of AC current at specified points in the system and provide a digital signal indicating the presence or absence of current. Processor 402 conveys information about these sensed signals to the microprocessor board 500 upon a request from that board which may take control action based on the sensed signals. For example, in the preferred embodiment, input modules 408 may be connected to sense power applied by a system start button, presence of AC power overload, engagement of the motor contactor, and shorting of the motor contactor, respectively, and processor 402 transmits status information derived from these sensed signals to the microprocessor board 500. Input modules 408 are connected to elements of compressor system 100 (e.g., start button 2026, contactor M1, etc. external to relay board 400 by connectors JP4 and JP5.

Ten additional output ports of processor 402, labeled SSR1 through SSR10 in FIG. 4*a*, are connected to relays CRX1–CRX10 on relay board 400 via devices as is explained below. FIG. 4*b* shows the connections of these ten ports in more detail. As shown in FIG. 4*b*, each of the ports SSR1 through SSR10 is connected to ground by one of the 4.7 KΩ pulldown resistors 414. SSR1–SSR10 are further connected to respective inputs of integrated circuit drivers 416 and 418. The outputs of drivers 416 and 418 corresponding to SSA1 through SSA10 are connected individually to ten 5 VDC actuated AC power relays 420. Relay CRX2 and CRX8 are protected by a snubber circuit consisting of a resistor and capacitor in series across the power terminals of the relay. In parallel with the snubber circuit, there is also a metal oxide varistor to protect against power surges. One of the power terminals of each relay 420 is connected to either an AC hot or AC neutral line. The other power terminal of each relay is connected to other components of system 100 through connectors JP4, JP5, and JP6.

FIG. 5, consisting of FIGS. 5*a* through 5*j*, is a schematic diagram of microprocessor board 500, described generally above with reference to FIG. 2. Microprocessor board 500 contains a special purpose computing system for controlling system 100.

Figures 1, 5A:
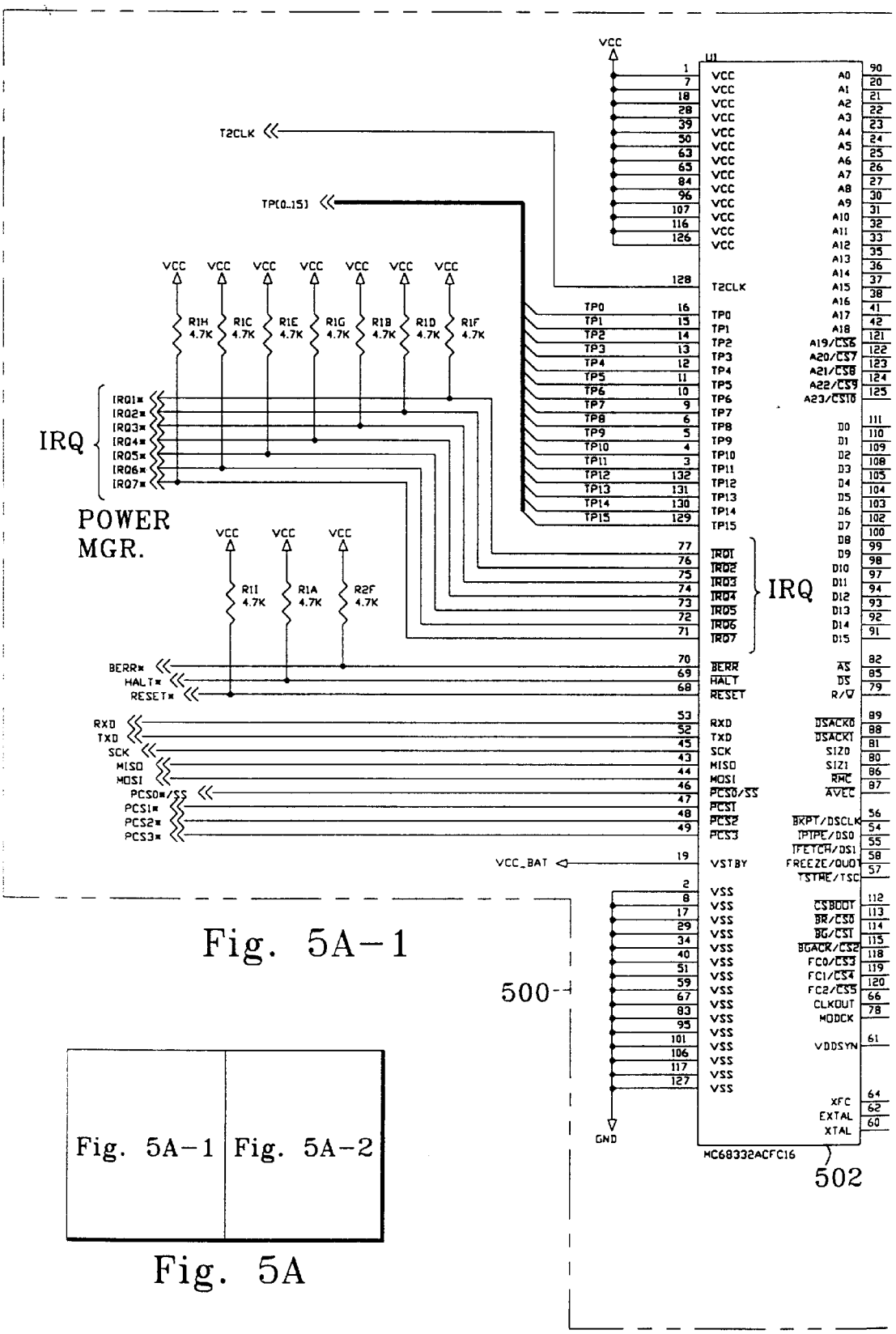
FIGS. 5*a*–5*j* are schematic diagrams of the microprocessor board described in FIGS. 2A and 2B.
Figures 2, 5A:
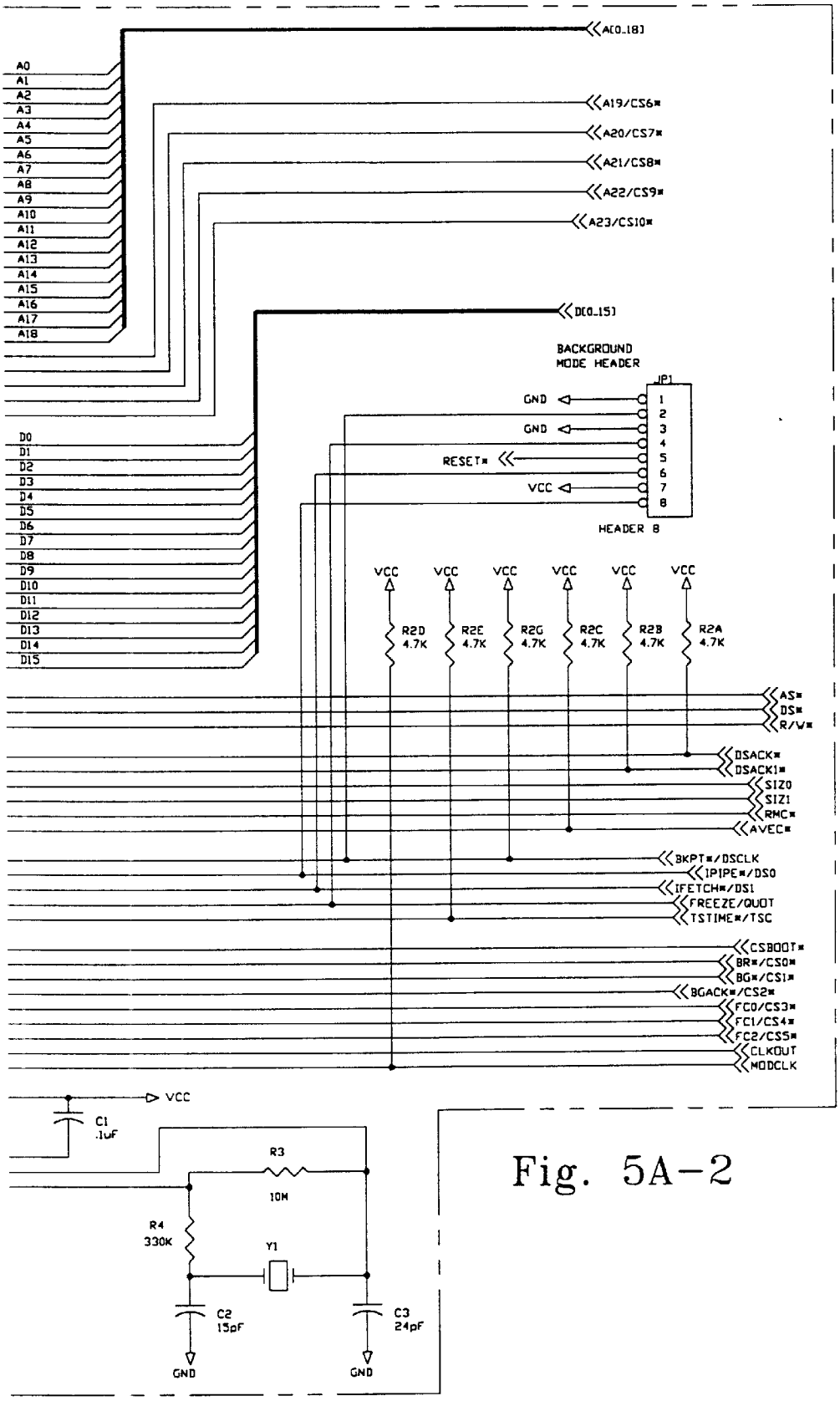

FIG. 5*a* shows the system processor 502, which is the main processing device for electronic control system 1004. System processor 502 is a digital processor with input/output ports capable of running a program stored in firmware to monitor compressor system operation and generate appropriate control signals to control the compressor system. In the preferred embodiment shown, system processor 502 is an MC68332 microcontroller manufactured by Motorola, Inc. of Schaumberg Ill. System processor 502 is connected to other components on microprocessor board 500 by a bus comprising address (A0–A18), data (D0–D15), and control (A×D, T×D, IRQ1–IRQ7, IRQ1*IRQ7*) lines. In FIGS. 5*a* through 5*j*, like designations of lines on different sheets are used to indicate a connection between the identically designated terminals.

Figure 5B:
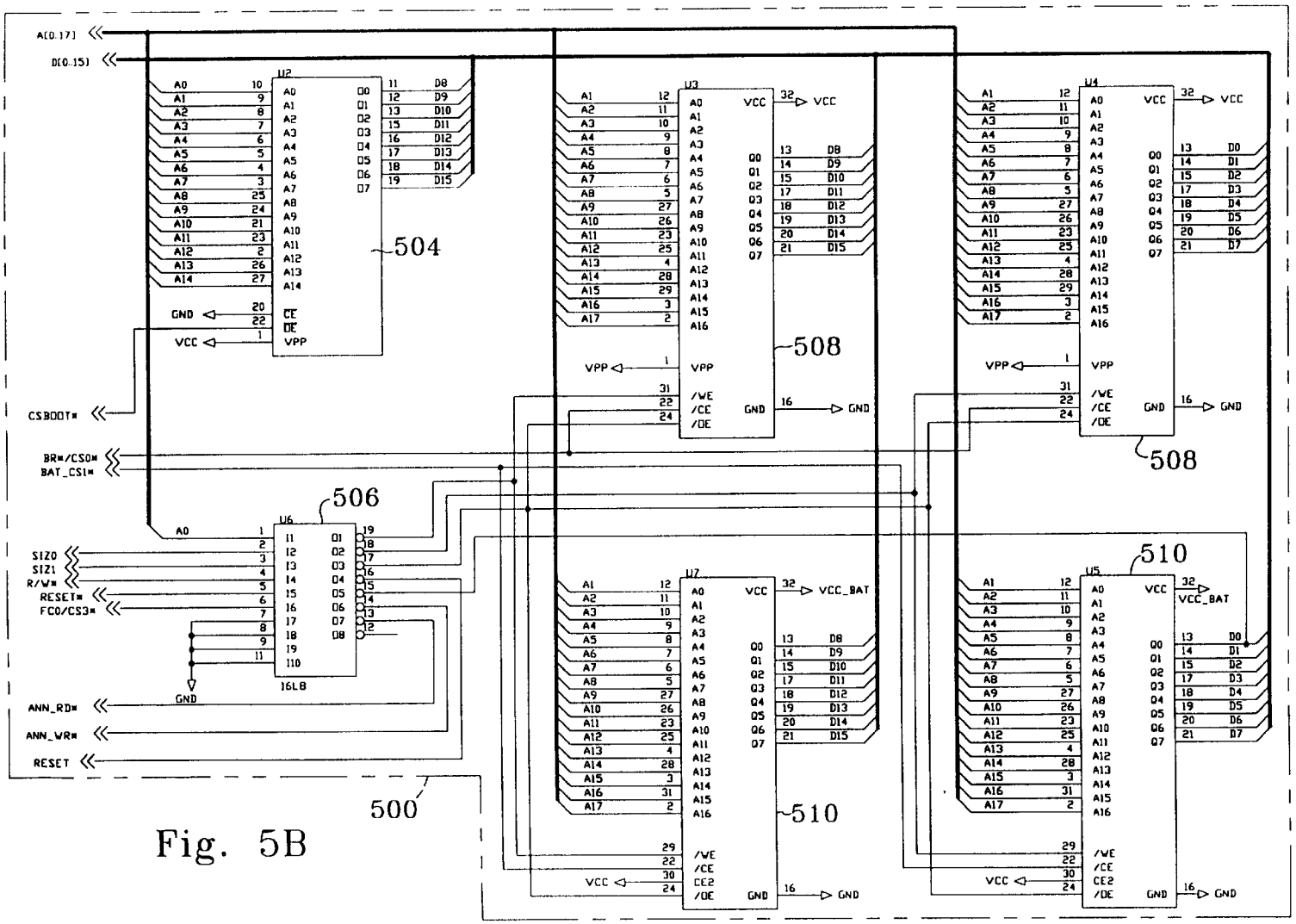

FIG. 5*b* shows connections of integrated memory circuits connected to system processor 502 by the bus. A boot ROM 504 contains firmware instructions for initializing system processor 502 and its connected components. Boot ROM 504 may be an AM27C256-150DC 150 nanosecond CMOS EPROM manufactured by AMD. An address decoding integrated circuit 506, which may be a model number PEEL 18CV8P-15 chip, is connected to generate and transmit addressing signals to two firmware storage chips 508 and two random access memory chips 510. Preferably, firmware storage chips 508 are flash-upgradable memories to allow updating of the system operating firmware. Firmware updates may be transmitted from a remotely located station at the system manufacturer or a maintenance center, if system 50 is equipped with modem 2011 as described previously. Firmware storage chips 508 may be AT 29C010-12PC 120K×8 flash EEPROMs with 120 nanosecond access time. Random access memory chips 510 are preferably SRM20100LC100 low power 128K×8 static RAM integrated circuits with 100 ns access time, which provide more memory than is used in the present embodiment, leaving room for future expansion of system functions. If desired, 32K×8 RAM chips may be substituted, as a lesser amount of memory is sufficient for operation of the embodiment disclosed herein.

Random access memory chips 510 are used for storage of operating data, history data, sequence and schedule data for network multiple machine control, and intermediate calculating results during operation of electronic control system 1004. Operating firmware implementing the features described in this specification is stored in boot ROM 504 and firmware storage chips 508. Documented source code for a preferred embodiment of this firmware is provided in the appendix which is part of this specification. Upon reviewing the source code, in conjunction with the description and drawing figures in the main part of the specification, those skilled in the art will fully understand the features and operating characteristics of the present invention.

Figure 5C:
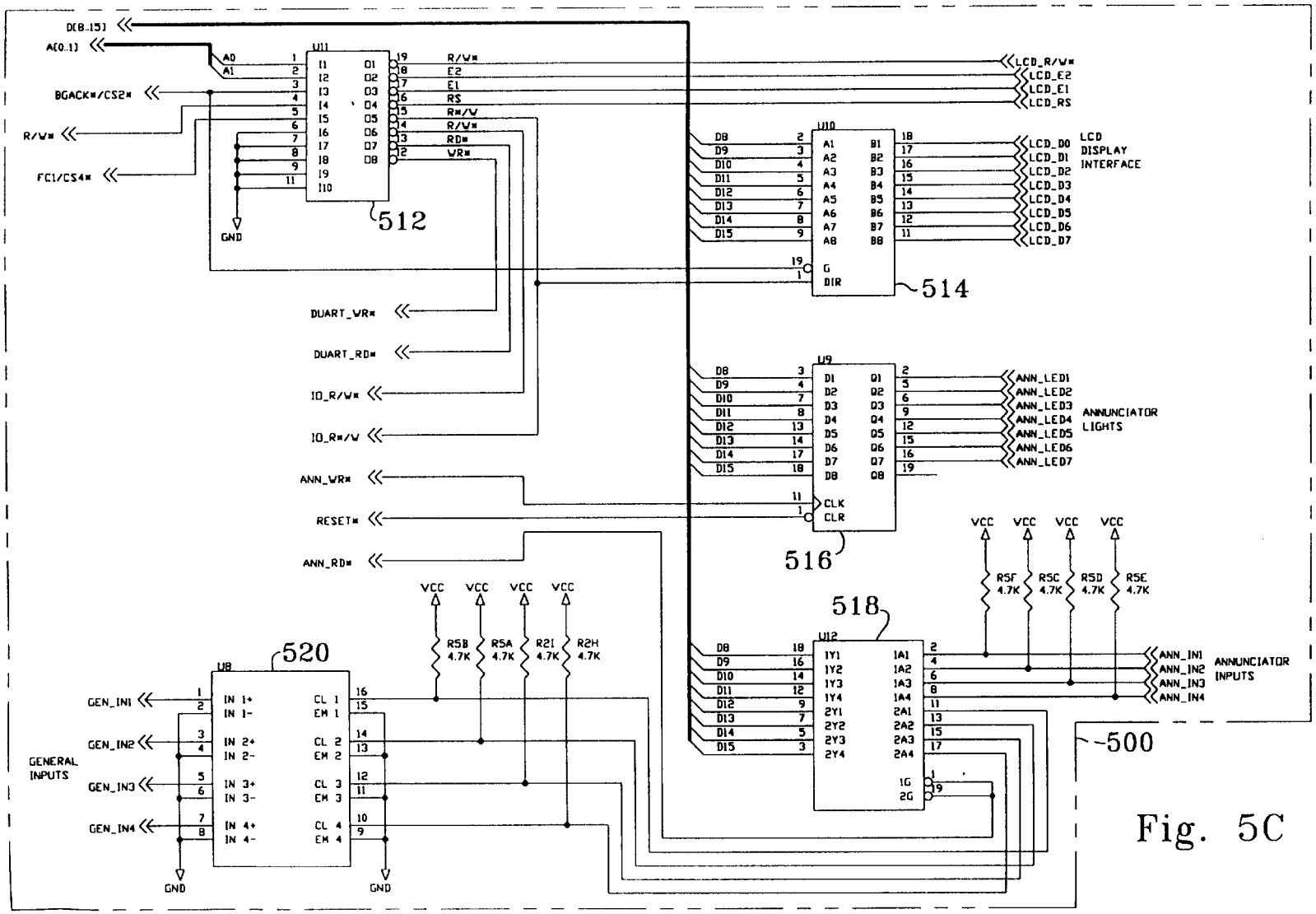

FIG. 5*c* shows additional decoding and driver circuitry of microprocessor board 500 providing an interface to annunciator board 600 and display board 202. Address decoding chip 512 (which may be a PEEL 18CV8P-15) generates addressing signals for the liquid crystal display interface. A gating chip 514 (which may be a SN74LS245N) selectively transmits data to the LCD interface under the control of system processor 502. Driving circuit 516 (which may be a SN74LS273N) is connected to selectively transmit driving signals for the annunciator LEDs, LCD E1 and LCD_A\W, which are described in more detail below with reference to FIG. 6.

Input processing chip 518 (which may be a model number SN74LS244N chip) receives information inputs from annunciator board 600 and makes the input information available in digital form to system processor 502. Specifically, input processing chip 518 is connected to receive the status of the annunciator board inputs—that is, air cleaner vacuum switch 2022, oil filter delta pressure switch 304, and inner stage cooler delta pressure switch 145 (all shown in FIG. 2). Input processing chip 518 is also connected to receive and forward the status of four general inputs GEN IN1–GEN IN4 transmitted through optical isolator 520, which may be a model number PS2502-4 integrated circuit manufactured by NEC. The general inputs are not connected in this embodiment, but are provided to permit future expansion.

Figure 5D:
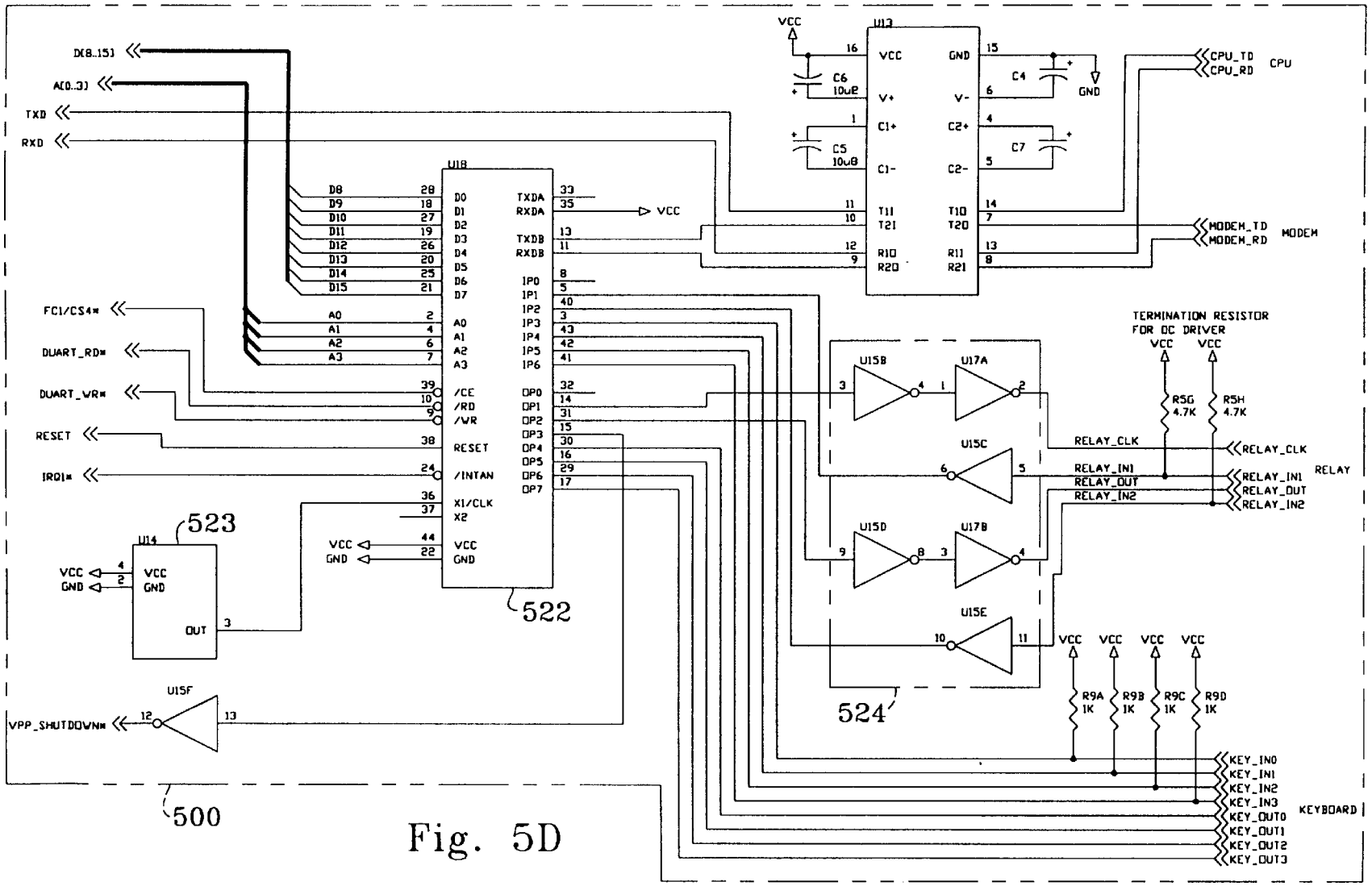

FIG. 5*d* shows serial data transmission and polling circuitry on microprocessor board 500 associated with system processor 502. A dual universal asynchronous receiver transmitter (DUART) 522 is connected via the bus to system processor 502. The bus comprises data lines D0–D15 and addresses lines A0–A3. DUART 522 is connected to an associated 3.6864 Mhz oscillator 523. DUART 522 is also connected to keyboard input and output lines KEYIN0–KEYIN3 and KEYOUT0–KEYOUT3, respectively, which are used to poll operator keyswitches, as described in more detail below with reference to FIG. 7, which shows the polled switches.

DUART 522 is further connected, through inverter and driver circuits 524 (comprising a 74LS14 chip and a 7406 chip) to transmit and receive serial data communications between microprocessor board 500 and processor 402 of relay board 400. Finally, an RS232 conditioning circuit 526 (which may be a MAX 232CPE chip) connects DUART 522 to receive and transmit lines of modem 2011 (shown in FIG. 2) to facilitate serial data communication by the system with computers at different locations from that of system 50. RS232 conditioning circuit 526 also connects DUART 522 to receive and transmit lines CPU_TD and CPU_RD of a local RS232 port to facilitate communications with a directly attached computer for diagnostic, repair, and/or operation monitoring purposes.

Figure 5E:
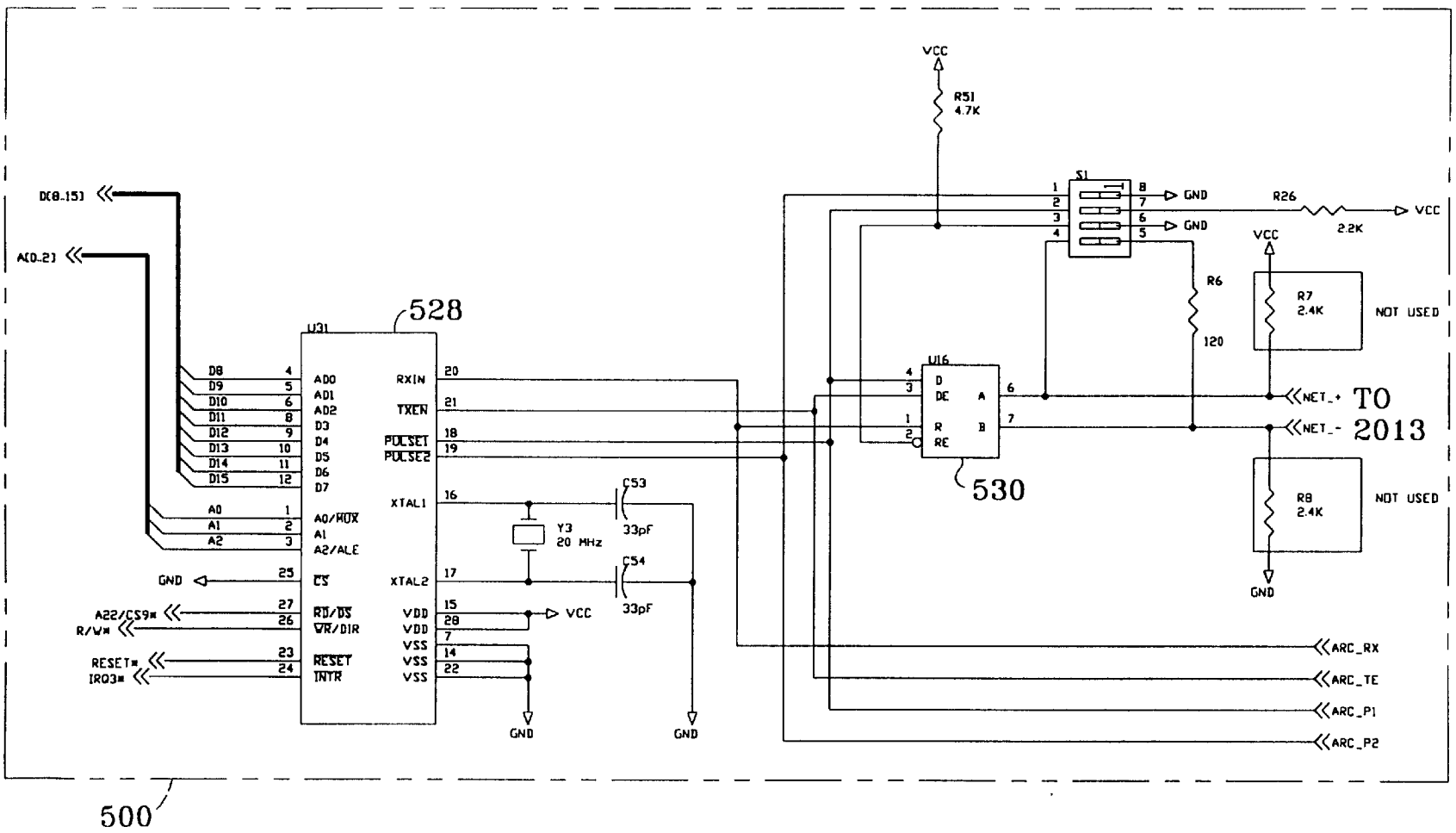

FIG. 5*e* shows the ARCnet communications interface circuits which are connected to system processor 502 and mounted on microprocessor board 500. A standard ARCnet interface is provided by ARCnet interface circuit 528 (which may be a COM20020LJP ARCnet controller), together with RS485 interface circuit 530 (which may be a SN75176AP RD422/485 transmitter/receiver). This interface is connected to network connection 2013 (shown in FIG. 2) to allow ARCnet peer-to-peer communication among a plurality of machines equipped with electronic control system 52.

Figure 5F:
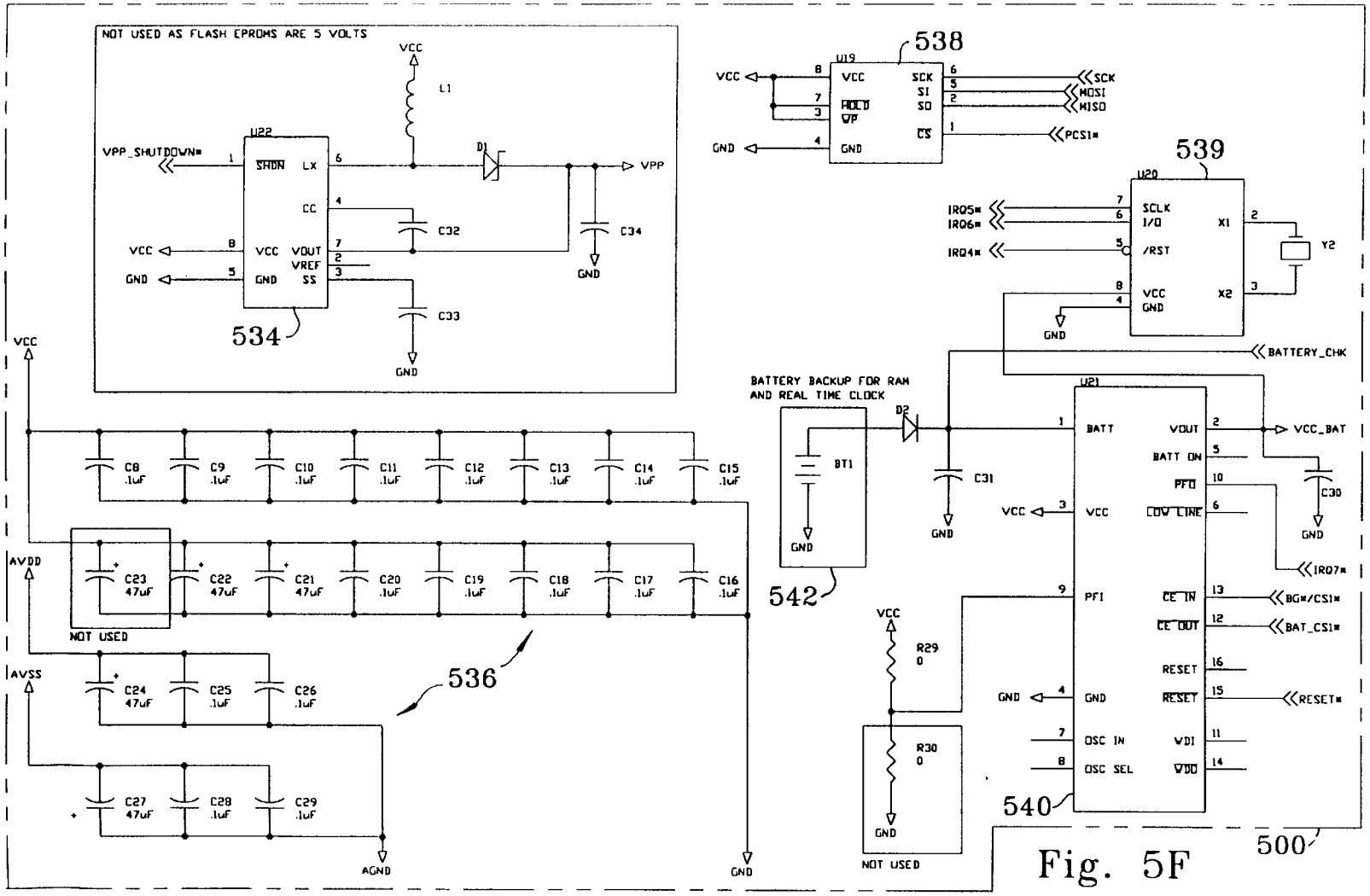

FIG. 5*f* shows power and information backup circuits for microprocessor board 500. Voltage generator circuit 532 generates a 12 VDC voltage Vpp which could be used for programming flash memory firmware storage chips 508 (shown in FIG. 5*b*) if the chips used require this programming voltage. Voltage generator circuit 532 is based on an integrated circuit 534, Maxim part number MAX 732. Capacitor arrays 536 are connected to minimize transients in Vcc, AVdd, and AVss which are supply voltages used in the system.

An EEPROM 538 provides non-volatile storage for system status information, all operating parameters, the system serial number and configuration information such as available memory size. EEPROM 538 may be used to store transducer offset values, configuration information, and default parameter values including pressure set points and activation windows. In addition, upon system shutdown due to a detected fault, EEPROM 538 can be used to store system status information, along with date and time information. This information can then be retrieved to help pinpoint the exact time and cause of a shutdown or failure. Preferably, critical information on the last sixteen shutdowns is stored in EEPROM 538. A complete memory address list for EEPROM 538, specifying the information stored in EEPROM 538, is provided in module EEPROM.C of the appendix.

Preferably, all of this information can be retrieved via modem 2011 by a maintenance technician at a remote location, to aid in diagnosis of the problem and to ensure that the proper service parts are brought along if a service trip is required. EEPROM 538 may be a X25040P integrated circuit 8-bit serial EEPROM.

A real time clock 539, which may be a DS1202 integrated circuit, is connected to system processor 502. Supervisory circuit 540 monitors voltages in the system and applies backup battery power from a battery 542 to real time clock 539 and random access memory (such as random access RAM chips 510 shown in FIG. 5*b*) if the power supply fails to maintain adequate voltage. Supervisory circuit 540 is preferably a Maxim MAX 691 ACPE integrated circuit.

Figures 1, 5G:
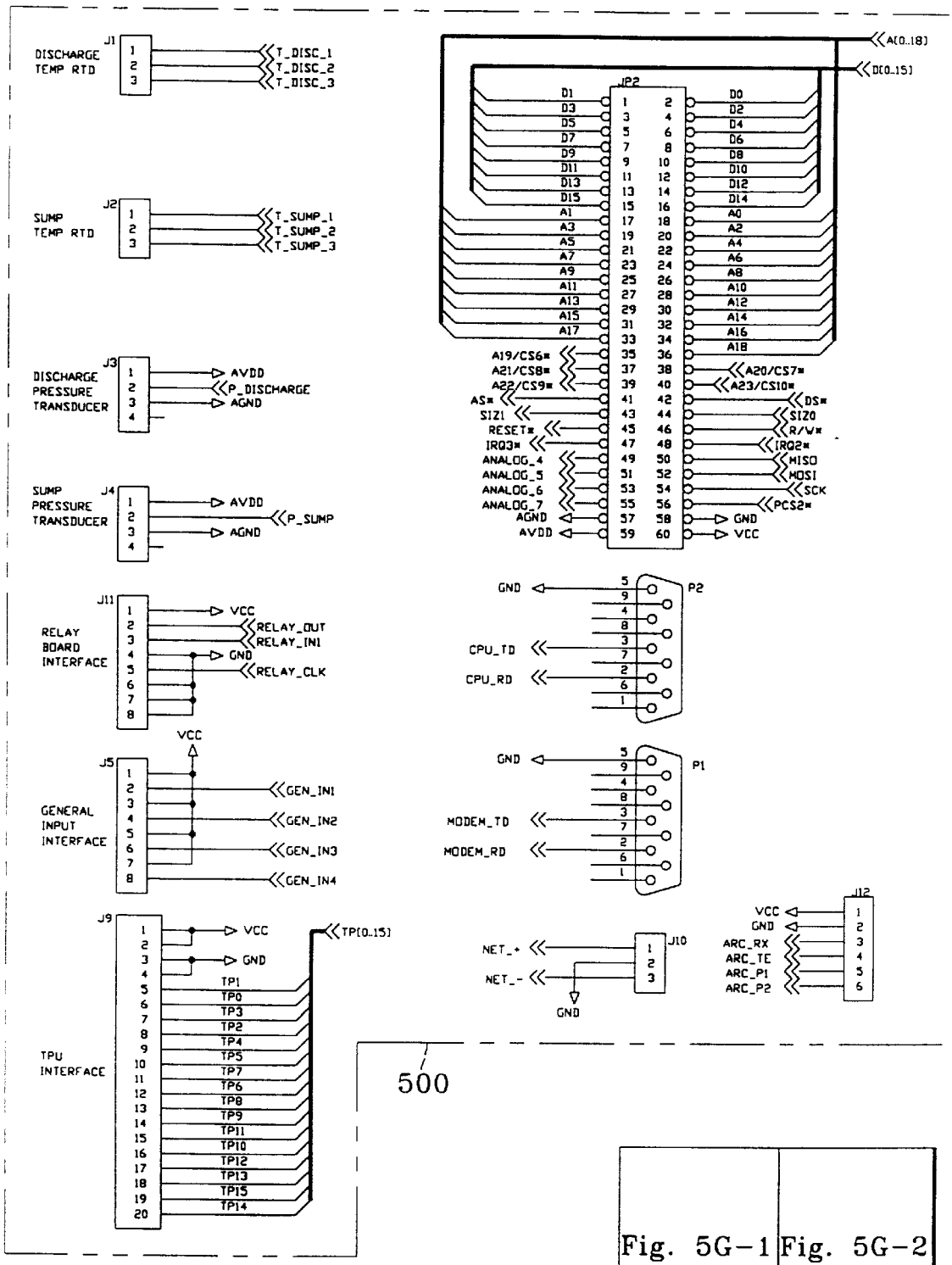
Figures 2, 5G:
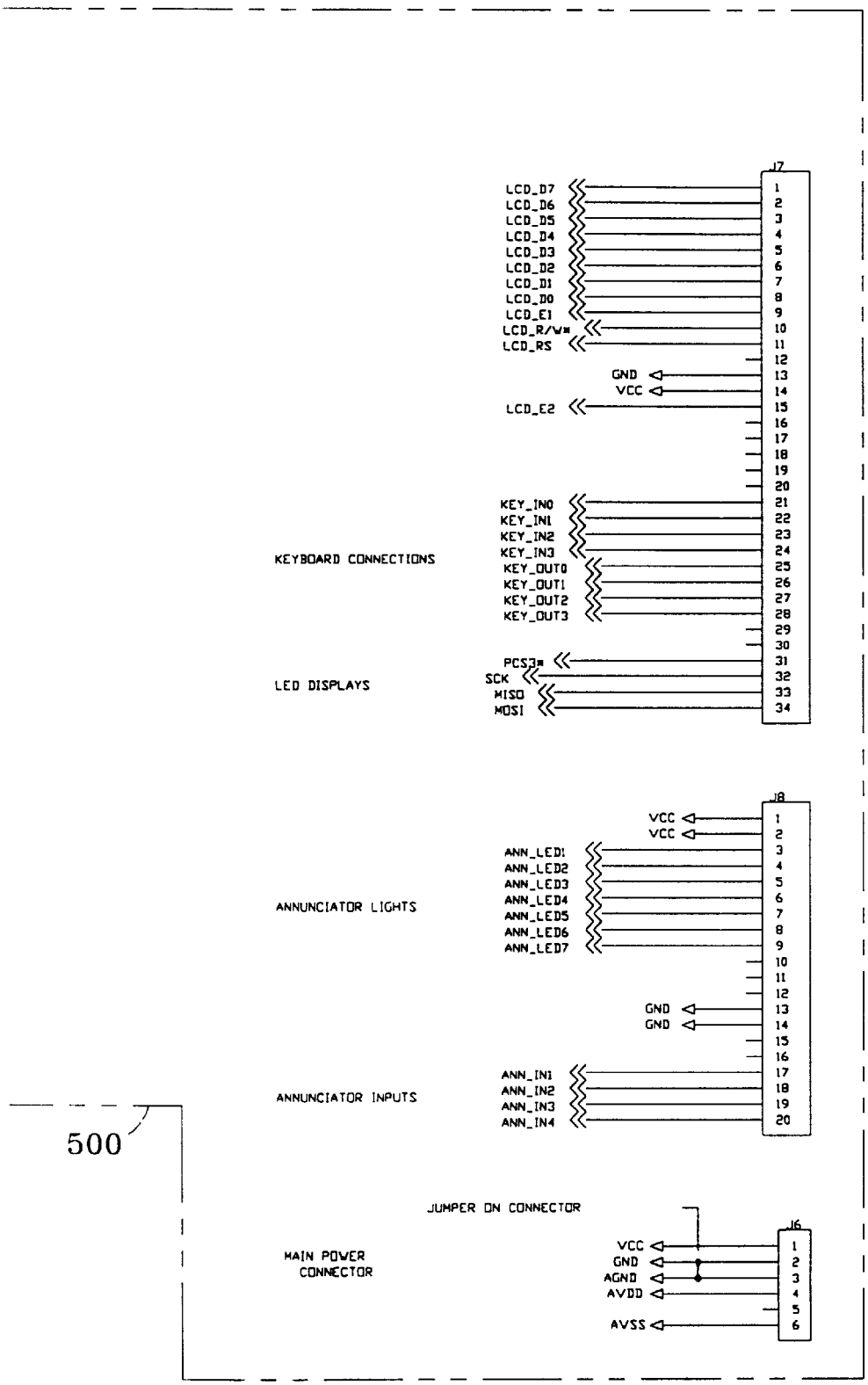

FIG. 5*g* shows the connectors provided for connecting the circuits of microprocessor board 500 to other components in electronic control system 52. As shown in FIG. 5*g*, a connector J1 provides connections for package temperature probe 2010. Connector J2 provides connections for second stage discharge probe 208. Connector J3 provides connections for package pressure transducer 2004. Connector J4 provides connections for second stage discharge pressure transducer 2006. Connector J11 provides an interface to relay board 400, as described previously with reference to FIG. 2, through Cable C1. Connector J5 provides connections for future expansion of input devices (general inputs 1–4) as described above. The various bus lines of microprocessor board 500 are connected to pins of a header JP2 which makes possible the connection of additional analog inputs for temperatures and pressures to the bus of microprocessor board 500, as is described below with reference to FIGS. 5*j* and 5*k*.

Connector P1 is provided for connecting microprocessor board 500 to modem 2011. Connector J10 is provided as part of network connection 2013 (shown in FIG. 2) to allow two-wire ARCnet communications, and a network expansion connector J12 can be optionally activated for network operation using an enhanced network communications protocol or a fiber optic interface.

Connector J7 provides connections to display board 2002. The connection of display board 2002 will be described in more detail later, with reference to FIG. 7. Connector J6 provides power connections for microprocessor board 500 to power supply 2018 (shown in FIG. 2). The power lines provided include Vcc (+5 VDC), AVdd (+12 VDC), AVss (−12 VDC), as well as ground and Agnd (both zero VDC). Connector J8 provides connections of microprocessor board 500 to annunciator board 600, which will be described in more detail later, with reference to FIG. 6.

Figure 5H:
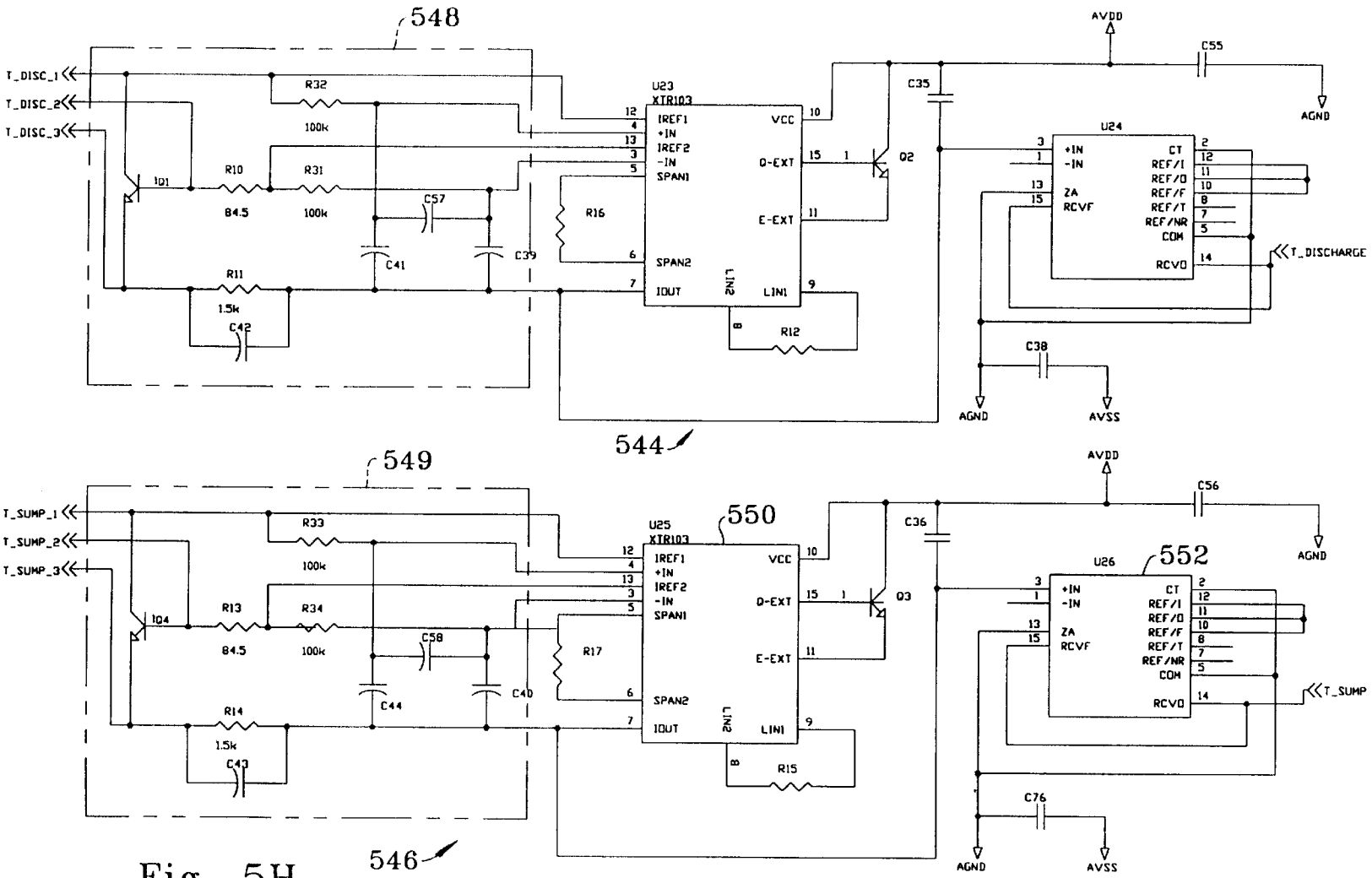
Figure 5I:
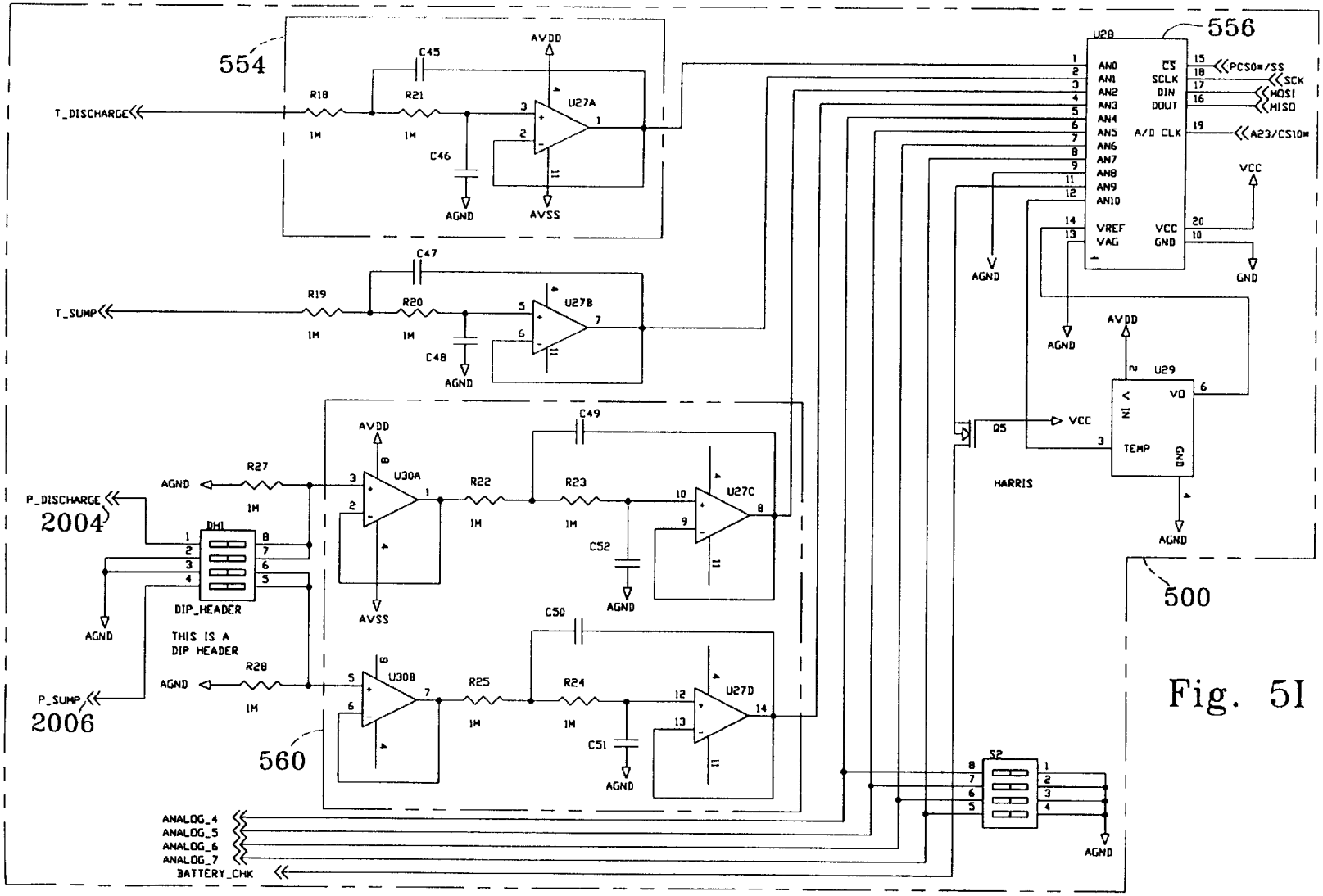

FIGS. 5*h* and 5*i* show conditioning circuits 544 and 546 provided for the resistance-type temperature devices associated with the system, that is, second stage discharge temperature probe 2008 and package temperature probe 2010 respectively. Persons knowledgeable about resistance temperature devices will appreciate that the design of these conditioning circuits may be varied depending on the characteristics of the resistance temperature device to be used. In the preferred embodiment, second stage discharge temperature probe 2008 and package temperature probe 2010 are each 100 ohm platinum resistance temperature sensors made by Minco. The operation and components of conditioning circuit 546 will be described in detail. As conditioning circuit 544 is substantially identical to conditioning circuit 546 in view of the use of the same resistance temperature device in both applications, only one detailed description, for circuit 544 of the conditioning circuits will be provided.

FIG. 5*h* is representative of the temperature measuring circuits. Circuit 544 contains components that are used with burr brown chips No. XTR103, referred to as item 550 and burr brown chip No. RCV420, referred to as item 552. It is common knowledge the function and application of these two chips. The part of the circuit labeled 548 contains resistor values that are used in conjunctions with chip 550 to control the temperature range that is being measured. Also in circuit 548 are included capacitors and other resistors that provide a filtering circuit to remove unwanted electrical noise from the circuit. The inputs to circuit 549 are T sump 1, T sump 2 and T sump 3. These three input connections are connected to a temperature probe that is of type RTD platinum 100 ohm. T sump 1, T sump 2 and T sump 3 are two of the leads that run directly to the temperature probe resistive element, and the third leads to a junction at one of the resistive connection points in the probe. The purpose of the junction is to remove the resistance that is in the cable that runs from this connection T sump 1, T sump 2 and T sump 3 to the temperature probe. The output of this circuit labeled, 546, is T sump and that output is a voltage that is directly related to the temperature measured from the RTD temperature probe connected to T sump 1, T sump 2 and T sump 3. This same circuit is used in four different circuits on the control, all of which function in the same fashion.

Referring now to FIG. 5*i*, the output T sump of RTD receiver 552 is then low-pass filtered by filter circuit 554 and transmitted to an analog-to-digital converter 556 so that system processor 502 can digitally monitor the second stage discharge temperature 2008 of compressor package 1002. An identical filter circuit is also provided for the package temperature 2006 as well as second stage inert temperature 2010C, and first stage discharge temperature 2010D, which is similarly transmitted to an analog-to-digital converter 556. The analog-to-digital converter 556 obtains a precision 5 VDC reference voltage from reference voltage generator circuit 558, which may be a Maxim MAX675CPA integrated circuit.

FIG. 5*i* also shows the connections of package pressure transducer 2004, package discharge pressure transducer 2006 to analog-to-digital converter 556. These connections similarly make the pressure readings sensed by these sensors available to system processor 502 in digital form. As shown in FIG. 5*i*, the output of package pressure transducer 2004 is transmitted through impedance matching and low pass filter circuit 560 to analog-to-digital converter 556, and the output of second stage pressure transducer 2006 is transmitted through impedance matching and low pass filter circuit 562 to analog-to-digital converter 556. The foregoing is the same for lube pressure 2010A and first stage discharge pressure 2010B. DIP header switch 564 is provided to allow creation of resistor dividers at the inputs to impedance matching and low pass filter circuits 560 and 562, respectively. This is accomplished by changing the position of DIP switches 2 and 3, respectively, and has the desirable effect of compensating for varying output voltages that may be created by different models of pressure transducers. In this way, it is possible to design a single microprocessor board 500 to work with at least two types of pressure transducers having different standard output voltage levels.

Figures 1, 5J:
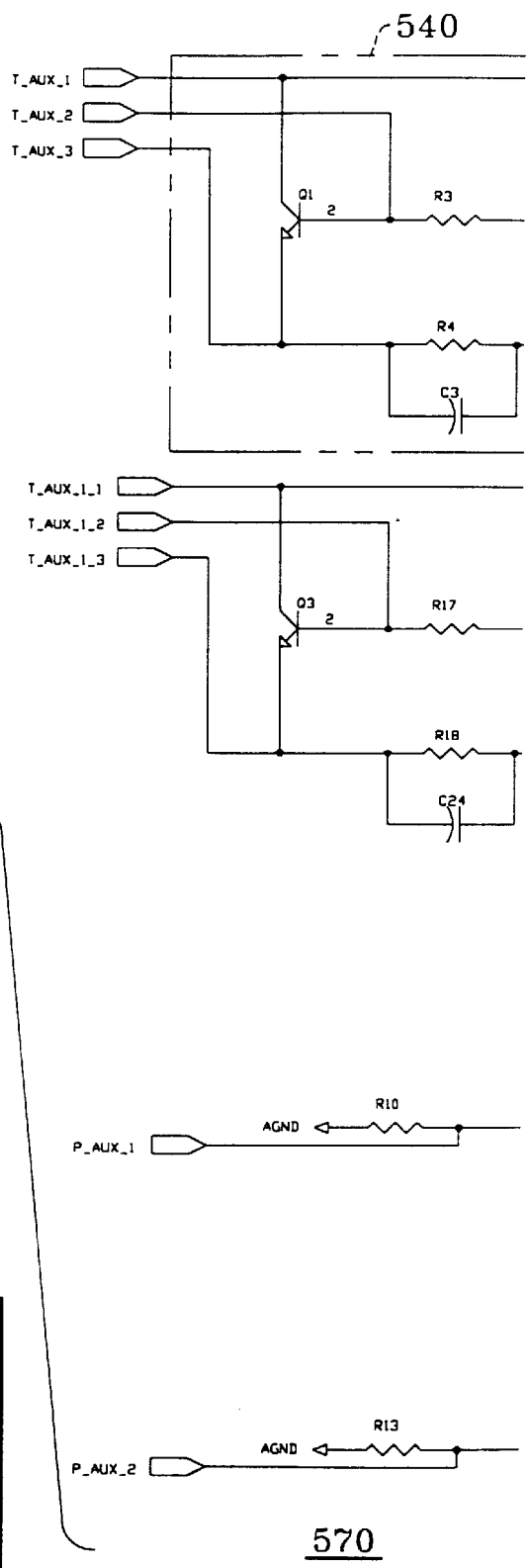
Figures 2, 5J:
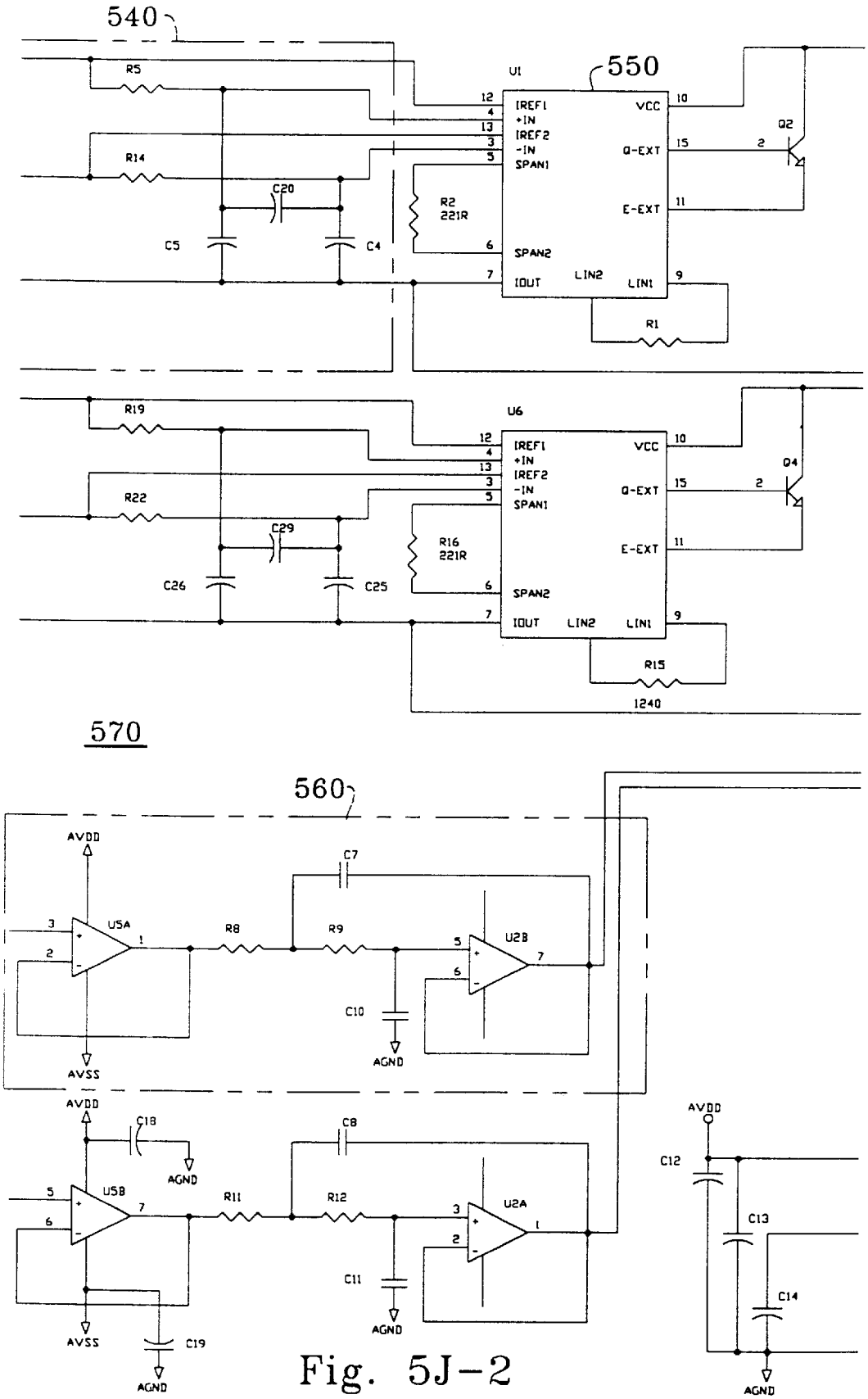
Figures 3, 5J:
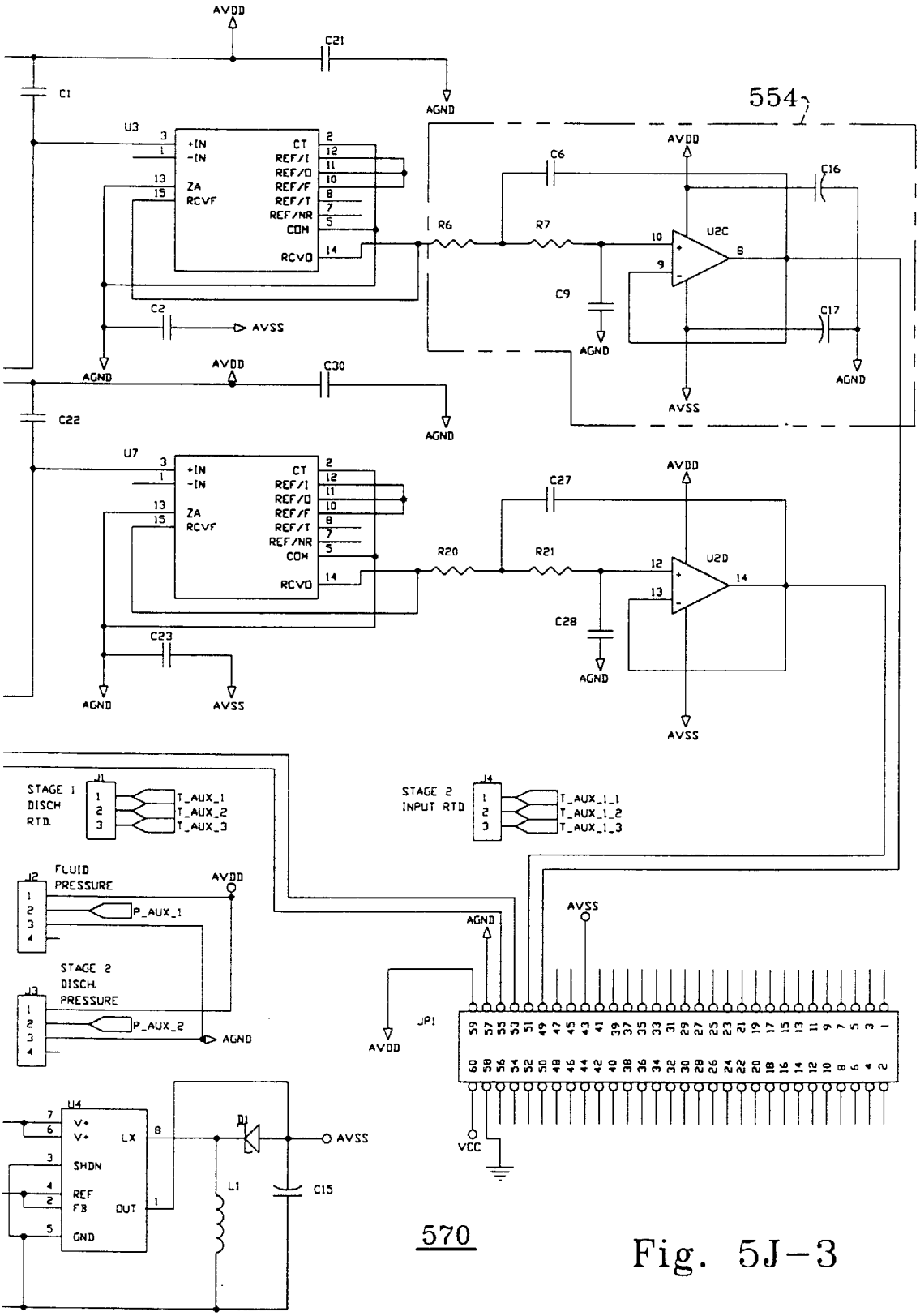

FIG. 5*j* shows the complete circuitry for a daughter board that attaches to the microprocessor board 500. This daughter board attaches to board 500 through the JP1 connector located on the daughter board to the JP2 connector on the main processor board. This circuit board provides four additional analog-in inputs, as mentioned earlier. These include two temperatures and two pressures. These temperatures and pressures are the lube pressure, which pressure transducer 2010A is attached to this board. The first stage compressor discharge pressure and pressure transducer 2010B is attached to this board. The Second stage compressor inlet temperature and temperature probe 2010C is attached to the board and first stage compressor discharge temperature and temperature probe 2010D is attached to the daughter board.

Referring to FIG. 5*j*, T auxiliary-1 is the first stage compressor discharge temperature and has the same circuit as mentioned before, circuit 548, using the same integrated circuits 550 and 552 as mentioned before. A signal is sent to circuit 554 which is the lowpass filter as mentioned before. P auxiliary 1, 2 and 3 are the second stage compressor temperature inputs and are wired to the same circuitry 548, the same chips, 550 and 552, which in turn are transmitted to the same type of lowpass filter as described before, circuit 554. Signals are routed to Pin 49 and 51 on header JP1 that connects to JP2 on board 500. The P auxiliary 1 is the lube pressure transducer input connection that is routed to circuit as described before, 560, which is a voltage buffering high impedance circuit with a lowpass filter attached to the output of it. P auxiliary 2 is the first stage compressor discharge pressure and it goes to the same type of circuit, 560, as described before. These signals are routed to header JP1 and 55 respectively. Also in this circuit is a circuit that provides for a negative supply voltage which is referenced as circuit 570, a conventional circuit using a maxim 786 chip which converts the +5 volts to a −12 volts. Included also on the circuit board are connectors J1A which is used for the first stage compressor discharge temperature probe, J2A, which is used for the lube pressure transducer connection, J3A, which is used for the first stage compressor discharge pressure and J4A which is used for stage 2 compressor inlet temperature. Thus, microprocessor board 500 provides the main control and processing circuitry of electronic control system 52.

Figures 1, 6:
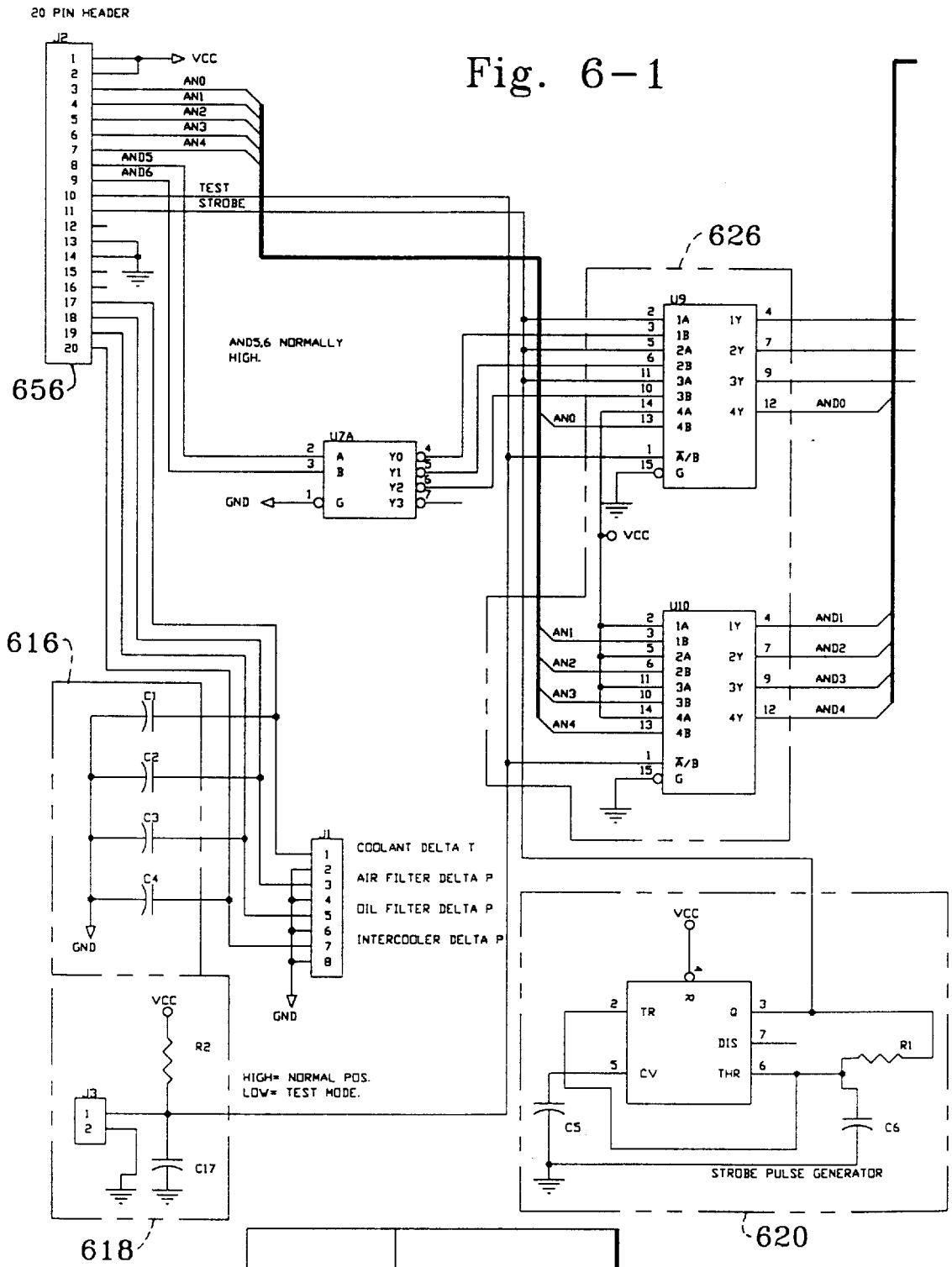
FIG. 6 is a schematic diagram of the annunciator board of the electronic control system useful with the present application.
Figures 2, 6:
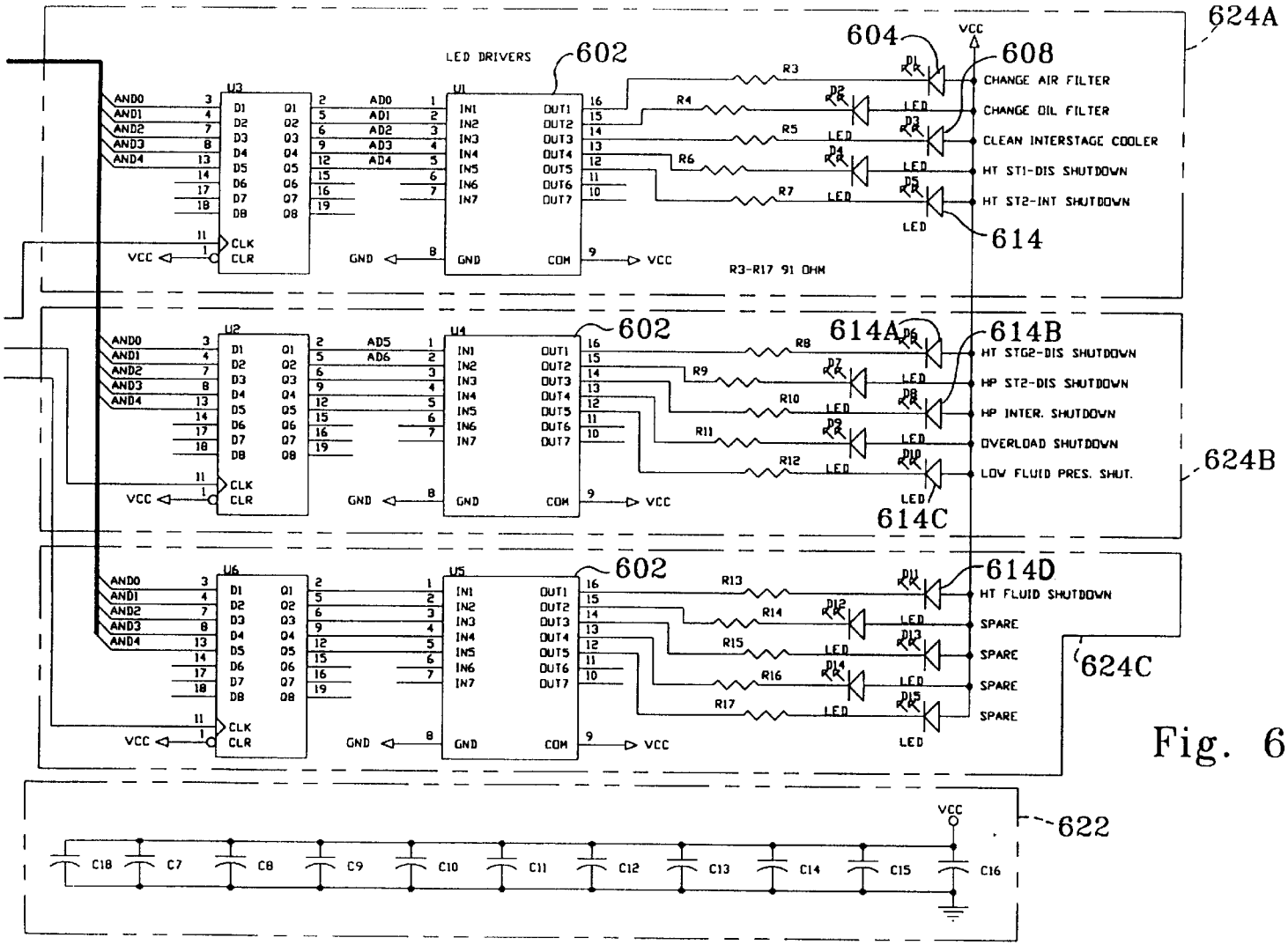

FIG. 6 is a schematic diagram of annunciator board 600 of electronic control system 52. Annunciator board 600 is constructed on a circuit board and includes integrated circuit driver 602 contained in circuit 624A, 624B and 624C. These circuits are used to drive banks of LEDs that are connected to circuit driver 602. The banks each contain five LEDs. This circuit board is connected to system 52, circuit board 500, by way of connector J8 on circuit board 500. J8 is connected through a cable to J2 on circuit board 600. Digital signals are passed through J2 such that five of the digital signals AN0, AN1, AN2, AN3 and AN4, contain the signal for the appropriate LED to be turned on. Digital signal AND5 and AND6 are connected to chip U7A which is a two to four multiplexer, which of only three outputs are used, and those are sent to circuit 626. The circuit 626 contains two chips which are two to one four channel multiplexers, one of these chips is used to select the bank of five LEDs that is to be addressed and the other chip transmits the signal for the appropriate LED to be turned on.

Annunciator board 600 is installed in housing 2036 so that LEDs 604 through 618 are visible from the outside of housing 2036. The location of the LEDs are preferably coordinated with a simplified pictorial schematic diagram of the oil free two stage compressor package system 50 applied to the outside of housing 2036 so that each LED appears in the part of the system schematic most relevant to that LED. For example, overload shutdown LED 612 may be located in a schematic representation of the compressor motor. High first stage discharge temperature LED 610 may be located in a schematic representation of the discharge pipe from first stage and high second stage inlet temperature shutdown LED 614 may be located in a pictorial representation of the compressor package showing the innerstage piping. Other shutdown LEDs 614A represents second stage discharge shutdown temperature, LED 618 represents second stage discharge pressure shutdown, LED 614B represents high pressure innerstage shutdown, LED 614C represents low fluid pressure shutdown and LED 614D represents high temperature fluid shutdown. These LEDs are located in the appropriate locations in the schematic representation of this compressor package.

Service indicated LEDs, such as LED 604, represent the location of the air filter and would indicate that the air filter would require servicing. LED 606 indicates that the oil filter would require servicing and LED 608 would indicate that the innerstage cooler requires servicing. Also, the colors of the LEDs may be chosen to indicate the severity of the problem represented by lighting of that LED. Shutdown indicators such as overloads represented by LED 612 and other shutdown are indicated by a red LED. The remaining LEDs, whose function is to indicate a need for maintenance in the near future, may use the color yellow.

Connector J1 provides inputs through J2 which in turn is connected to board 500 via J8. Inputs include delta pressure switches for this unit which also include the coolant delta temperature, the air filter delta pressure, the oil filter delta pressure and the innerstage cooler delta pressure. Circuit 618 on FIG. 6 represents the method used to test all the LEDs on this circuit board 600. A signal is sent to circuit 626 which provides a high input for all LEDs in all three banks and when the clock circuit represented by circuit 620 cycles this causes all the LEDs in all three banks represented in circuit 624A, 624B and 624C to turn on. This allows the end user to verify that all indicating lights are functioning properly. The bypass capacitor bank represented by circuit 622 provides voltage stabilization for VCC which is the voltage used on this circuit. Capacitors shown in circuit 616 provide bypassing to eliminate transient spikes that might be caused by delta pressure switches connected to connector J1.

Figure 7A:
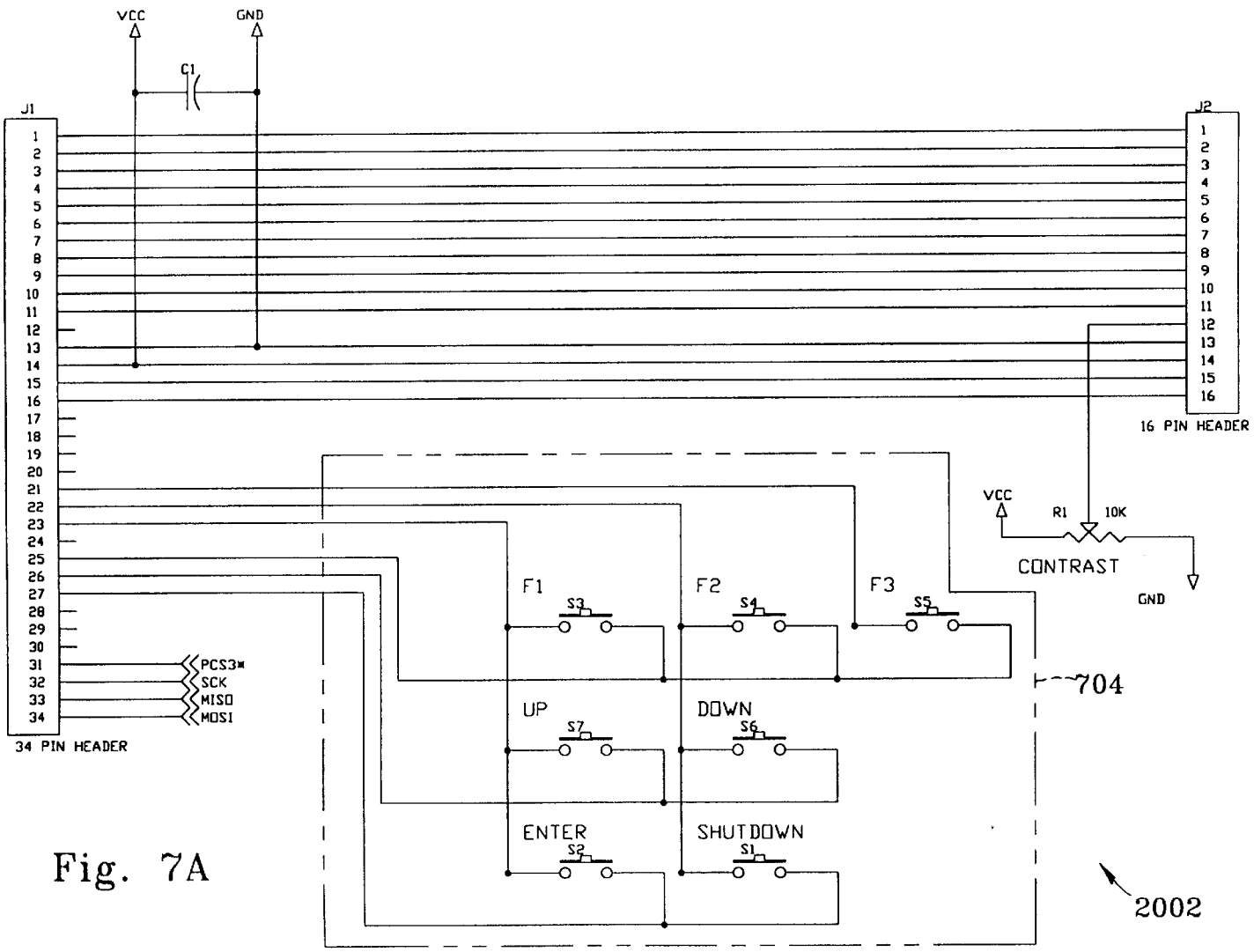
FIGS. 7*a* and 7*b* are a schematic diagram of the display board used in the invention.
Figure 7B:
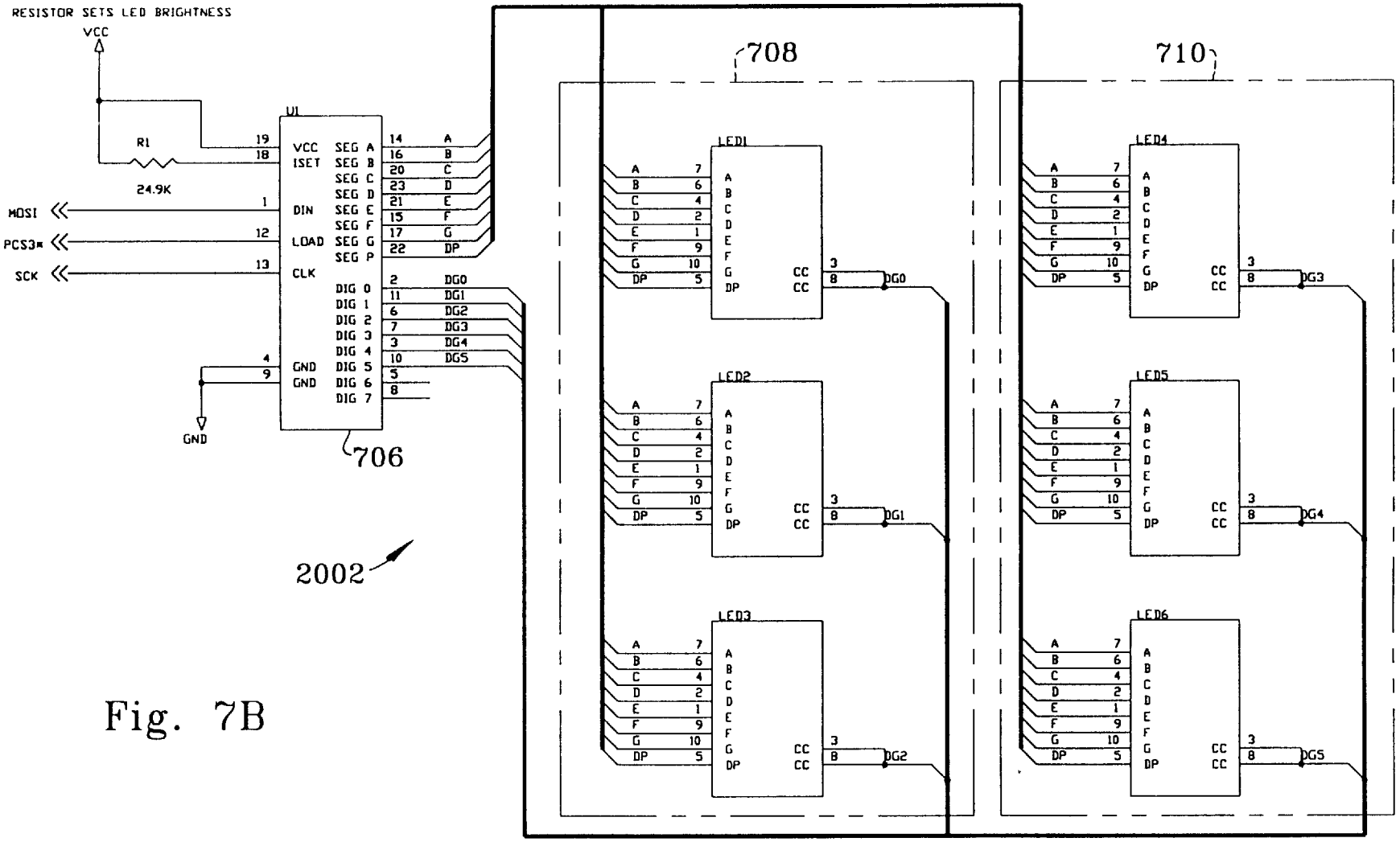

FIG. 7, consisting of FIGS. 7*a* and 7*b*, is a schematic diagram of display board 202. Referring first to FIG. 7*a*, this figure shows 34-pin connector J1 which connects display board 202 to microprocessor board 500 (as shown in FIG. 2). Pins 1–16 of connector J1 are connected directly to pins 1–16 of header J2, which is connected to display 702. Display 702 is preferably a LM 1190-SGL 4-line by 40-character backlit liquid crystal display unit manufactured by Solomon. Pins 13 and 14 are connected to ground and 5 VDC power, respectively, with a 33 uF filter capacitor connected between these power terminals.

A switch array 704, preferably including seven single pole, single throw miniature switches, is connected to pins of connector J1 in a matrix arrangement to allow polling of the seven switches by system processor 502. Switch array 704 is installed so that its switches are accessible from the front panel of housing 236 (shown in FIG. 2), and these switches are used by operators and maintenance personnel to control operation of the system and to select and store operating parameter values.

The seven switches are preferably assigned the following functions: up, down, enter, shutdown, and functions F1, F2, and F3. The shutdown button initiates an orderly programmed automatic shutdown sequence, in contrast to a shutdown initiated by pressing an emergency stop button which is also present in the system. This sequence will be described in more detail below with reference to FIG. 12.

The enter button indicates that data entry is complete and causes the system to act on the data entered. Data is entered using the up and down buttons, which can be manipulated to increment and decrement system operating parameter values. The function keys F1, F2, and F3 have variable effects depending on the operating function being performed at the time. Typically, the firmware of the system microprocessor will provide menu driven operation and display 702 will display a menu indicating the functions performed by F1, F2 and F3 at any given time.

Pins 31–34 of connector J1 are connected to additional components of display board 2002, which will be described with reference to FIG. 7*b*. As shown in FIG. 7*b*, appropriate pins of connector J1 are connected to allow system processor 502 to transmit serial data to control LED display driver 706. Display driver 706 may be a MAX 7219 CNG integrated circuit. Display driver 706 is connected to six seven-segment LED numeric digit displays, which are divided into two groups of three digits each: temperature display LEDs 708 and pressure display LEDs 710.

The inventors have found that it is desirable to constantly display, in an easily seen form, the compressor's output air pressure and output air temperature whenever the compressor package is operating. The connection of LED display driver 706 and its associated LEDs to system processor 502 allows processor 502 to maintain a constant numeric display of temperature and pressure, freeing display 702 for other uses.

Figure 8:
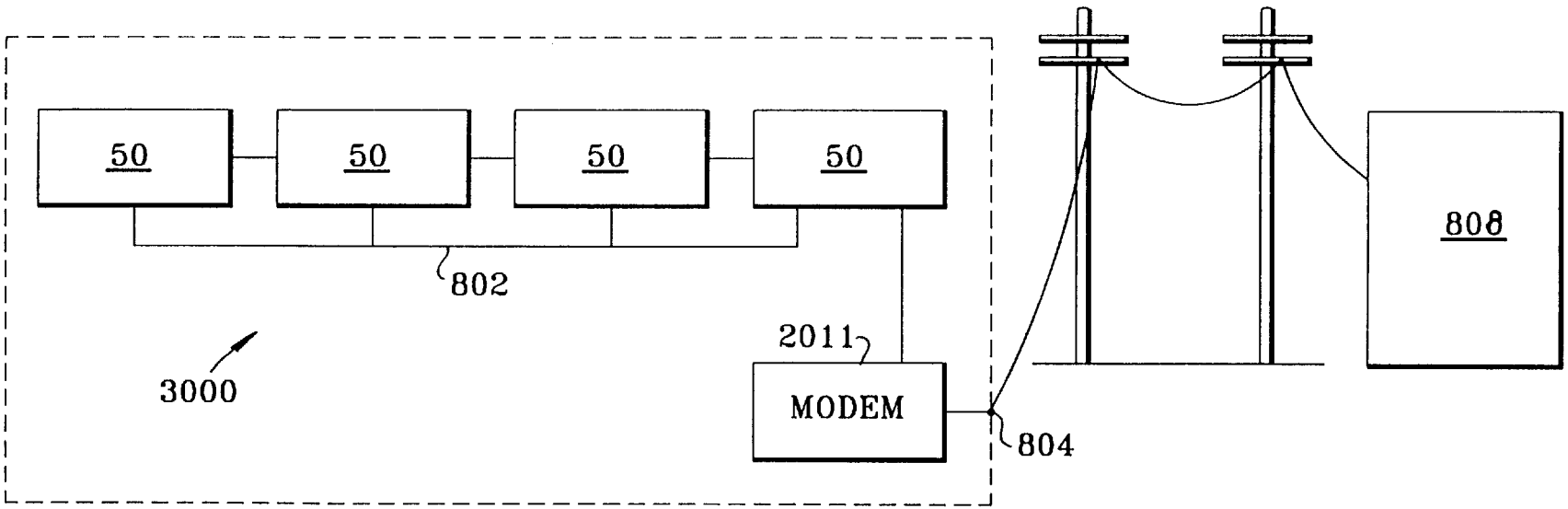
FIG. 8 is a block schematic diagram showing network and remote communications configurations using the compressor control system of the present invention.

FIG. 8 is a block schematic diagram showing a representative network and remote communications configuration for a plurality of compressor package systems 3000, presently preferably, up to nine (9) compressor packages. In FIG. 8, four compressor package system 3000 comprising four compressor packages 50, are shown in a network configuration, connected by network wiring 802. Network wiring 802 connects each of the compressor package systems 50 in a multidrop configuration according to the EIA RS-485 standard and carries information between the compressor package systems 50 using standard ARCnet protocol.

To permit remote monitoring and control of the network, one of the compressor package systems 50 is connected to modem 2011 which is connected to telephone jack 804. Telephone jack 804 is connected to telephone system 806 which provides a telephone line connection to remotely located personal computer 808. Modem 2011 operates to transfer information to personal computer 808 and to receive commands and control signals from personal computer 808 in the manner described above with reference to FIG. 2. When a plurality of compressor package systems 50 are connected in a network as shown, commands received via modem 2011 by the compressor package system 50 connected to modem 211 may be transmitted over the network to the other compressor package systems 50 in the network 3000 to provide remote control via modem of all functions of all the compressor packages 50 in the network 3000.

Modem 2011 permits remote monitoring of compressor package operation for diagnosing service problems, allowing a serviceman to be better prepared to fix the problem before leaving his shop. Remote monitoring and data retrieval can also be used for optimization of compressor package control. Data is stored in electronic control system 1004 and can be retrieved for fine tuning or evaluation of unload and load pressures, auto/dual timeout values, and multiple compressor package configurations. In addition, compressor package parameters can be configured from the remote site. After examining the data transmitted by compressor package system 3000, the remote operator can adjust operating parameters for improved compressor package operation. Finally, if any firmware problems are found in the field, the unique combination of this modem link and the flash memory provided in the embodiment of the present application permits updating the system on any one or all compressor packages firmware in the network 3000 immediately without any need for a service call. In addition, these features allow addition of special firmware options to any one or all of the compressor packages 50 as desired without an on-site visit.

Of course, the above-described uses of modem 2011 are not limited to network operation, and a modem 2011 can be provided on a single standalone compressor package system 50 to perform these same functions for a standalone system. Details of a representative modem communications software which could be used to remotely control one or more networked oil free two stage compressors is contained in U.S. patent application Ser. No. 09/163,704, of Centers et al. filed Sep. 30, 1998 entitled Systems and Methods for Remotely Controlling a Machine, the disclosure of which is herein incorporated by reference.

The operation of the control firmware on microprocessor board 500 provides significant advantages. The operation of this firmware is described in complete detail in the following flow charts and the documented source code in the appendix.

FLOWCHART DESCRIPTION

The Power Up Flow Charts

Figure 9:
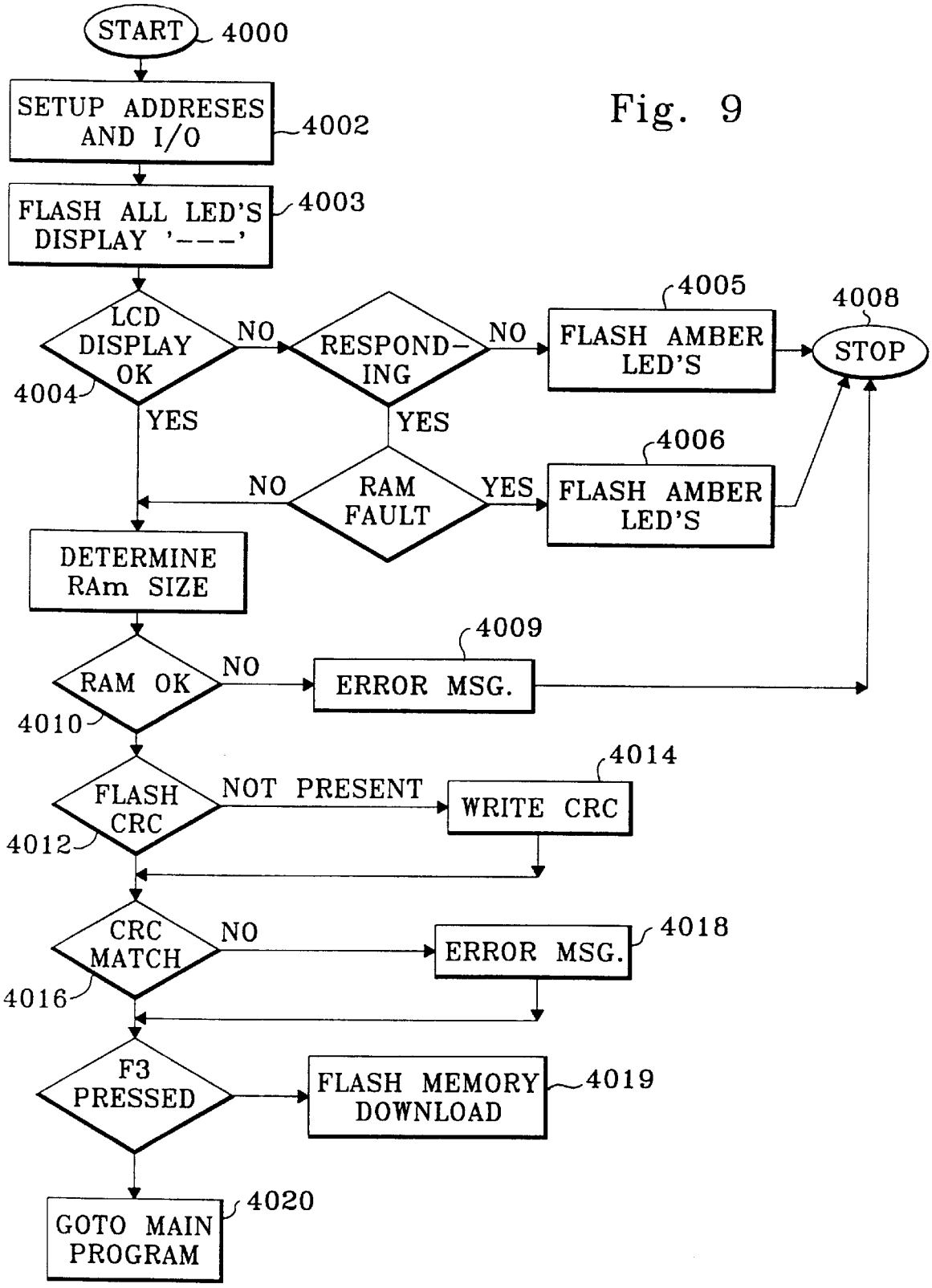
FIG. 9 is a flow diagram of the boot ROM sequence for a two stage oil free compressor package of the present application.

As illustrated in FIG. 9, at 4000, the program is started. At 4002, the microprocessor is setup to configure the addressing ranges and various timers. At 4003, the Annunciator Liquid Crystal Displays (LCD's) are turned on and the LED displays (temperature and pressure) are set for (' — — — ') indication, to show that the first part of the program has executed. At 4004, the LCD display module is tested to ensure it is active,. If there is no response at 4005, the Amber colored LED's are blinked, and program execution is halted, as the main display is not operational. At 4006, if the LCD responds, but shows a display RAM fault, the RED LED's are blinked at 4006 and the program halts. At 4008, the Program stop point for fatal faults, the main program will halt, if the main display (LCD) or RAM is faulty. At 4010, the RAM is tested over the size determined on at 4007 and halts at 4009 if there is an error. At 4012, the FLASH memory is given a checksum calculation, and if the FLASH did not have the values present at 4014, the value is written and the Software Write Protect (SWP) feature of the FLASH is set. Setting the SWP feature of the FLASH allows bulk programming of the FLASH and later SWP/Checksum placement. At 4016, the Checksum is compared to the stored value, an on a mis-match at 4018 the LCD screen shows an error Message. This is not a Fatal error, and the user is permitted to optionally continue under a caution. At 4019, if F3 key was held pushed on the keyboard, the program enters the download routine for the FLASH memory to load the board with a program from an external source via the MODEM port. At 4020, the BOOTROM sequence is ended, and a jump to the Main program in the FLASH memory is made.

The Main Program Flow Charts

Figures 1, 10:
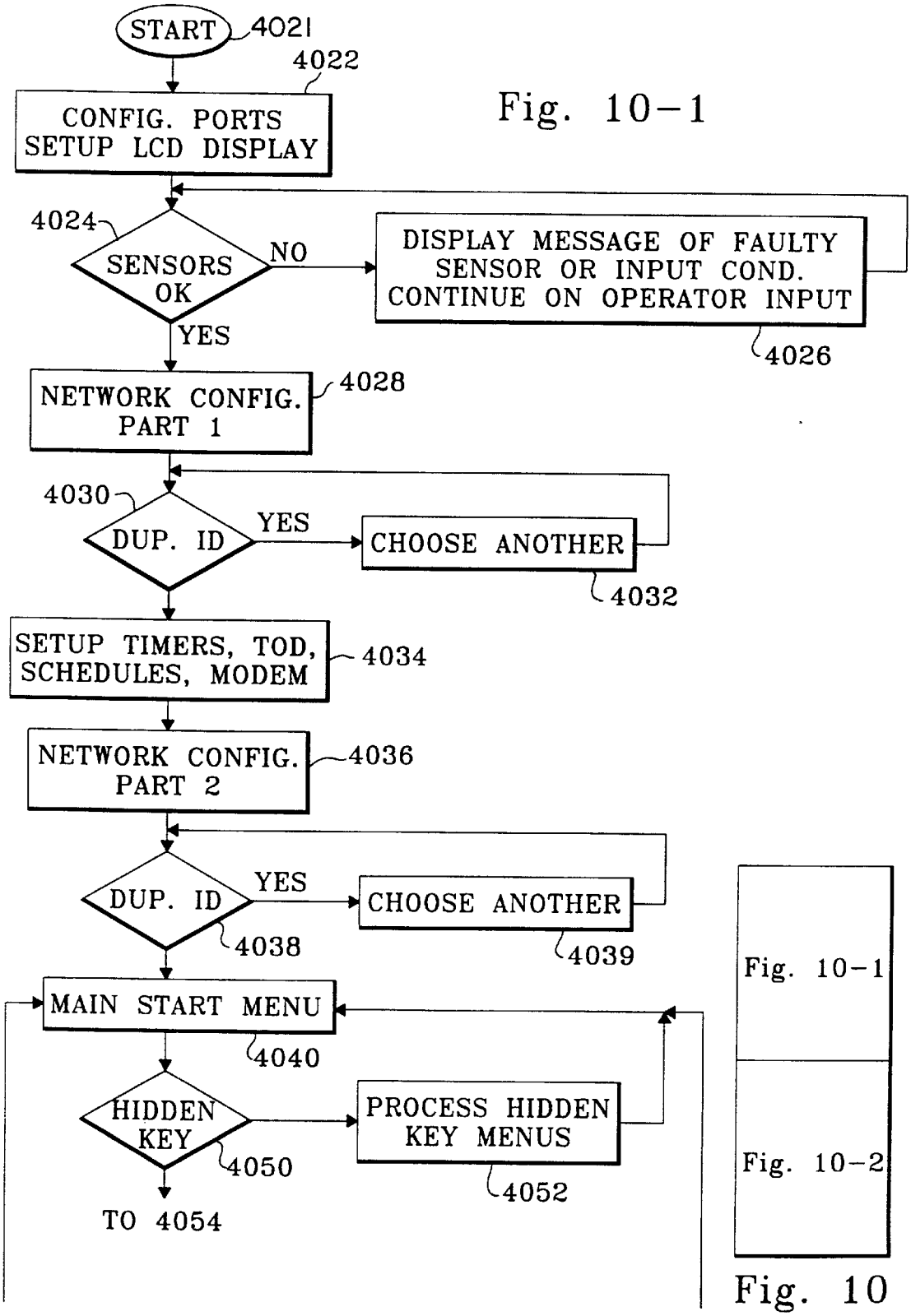
FIG. 10 is a flow diagram of the main computer program for a two stage oil free compressor package of the present application.
Figures 2, 10:
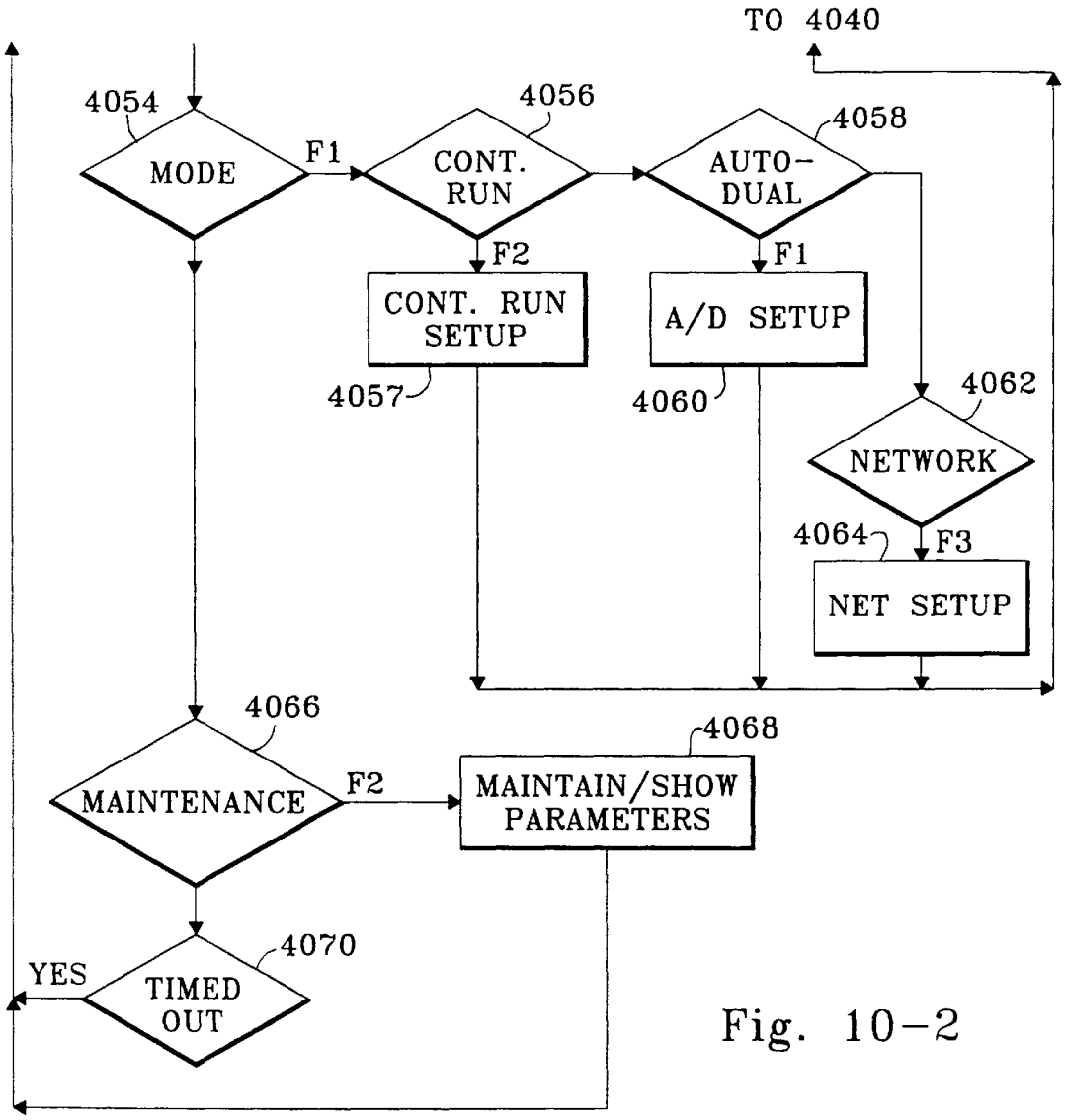

As Illustrated in FIG. 10 4021 is the starting point for the main program jumped to by the BOOTROM section of FIG.

10. At 4022, the Microprocessor (U1) is setup for the specific ports to be used, and the LCD display is powered up. At 4024, a loop is entered that tests the sensors for a valid input condition. In this loop, all inputs are tested, giving appropriate error messages at 4026 until all inputs are passed. Minor errors will allow machine operation (filter DP switches), but others are fatal, and the compressor package will not operate until they are cleared (Motor Overload, Temperature and pressure sensors). At 4028, the ARCNET network processor is initialized with a dummy number that is beyond the current list, and then tests for duplicate ID's at 4030. This is the first part of finding duplicates, and is valid in 3 or more system configurations. If a duplicate is found, the operator is notified to choose another ID at 4032. At 4034, the system timers, time and dates are set up, along with schedules and Modem configurations. Background operations that monitor the Network, Modem, Keyboard and sensor inputs are also started. At 4036, the Network restores the node number and tests again at 4038 and 4039. This test is effective for 2 node systems and higher. At 4040, the main menu is entered (Not running, idle state). If a compressor package start command is received, the compressor package will enter the run mode that was last selected. At 4050, if an input key sequence is entered that accesses the hidden key parameter menus, they are processed at 4052. At 4054, F1 on the operations menu selects the compressor package operating modes. Continuous Run at 4056, and 4057, Auto-Dual timed Stop at 4058 and 4060 and Network Mode at 4062 and 4064. At 4066, F2 selects the Maintenance menus that allows setup and configuration of parameters not covered under the Mode menus at 4068. At 4070, the display will revert to the Main Menu from any of the sub-menus, on time out (3 minutes).

The Hidden Menus Program Flow Charts

Figure 11:
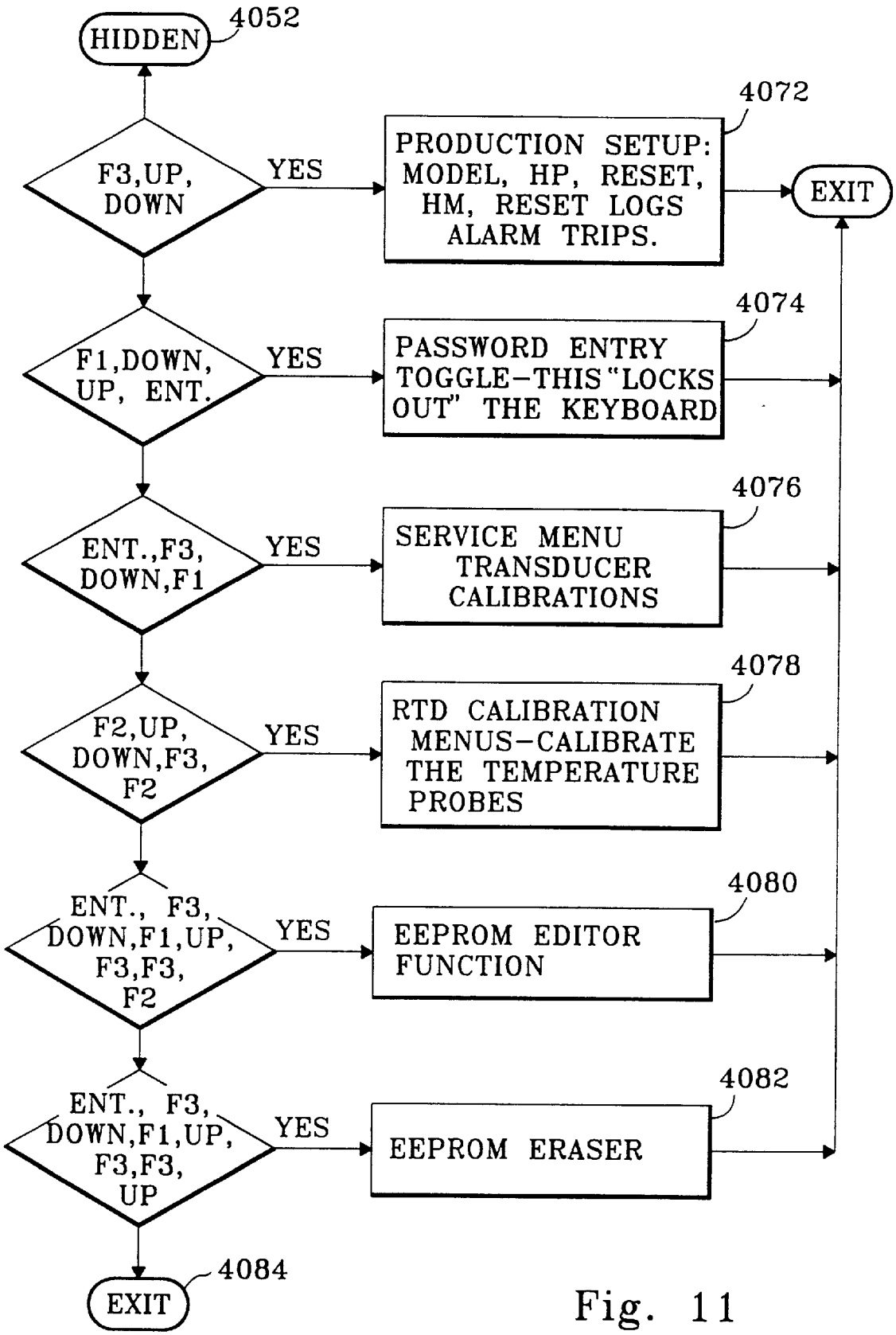
FIG. 11 is a flow diagram of the hidden key sequences for a computer program for a two stage oil free compressor package of the present application.

The hidden menus programs 4052 are illustrated in FIG. 11. At 4072, Production Setup is initiated by entering Model type, Horse power, Pressure ranges, allows reset of the hourmeters, allows reset of the Shutdown Log and Pressure and Temperature alarm points if different from the defaults. At 4074, the Keyboard Password Toggle is set. Setting the Keyboard Password Toggle makes the keyboard ignore inputs, until reset with the same sequence. This prevents passers by to alter the operating parameters. The Service Menu, for the calibration of the Pressure transducers is at 4076. At 4078, the calibration of the Temperature probes is allowed. An EDITOR that allows the operator to change the contents of the EEPROM directly is at 4080. Any location may be altered, and entry; menu carries a warning to that effect. At 4082, EEPROM eraser carries out a complete erasure of the EEPROM to a blank state. This is useful in case the contents are corrupted, or if the board is being reconfigured to a different model line. At 4084, if no key input sequences match, the result is no-operation, and return to the main menus.

The Mode of Operation Flowcharts

Figure 12:
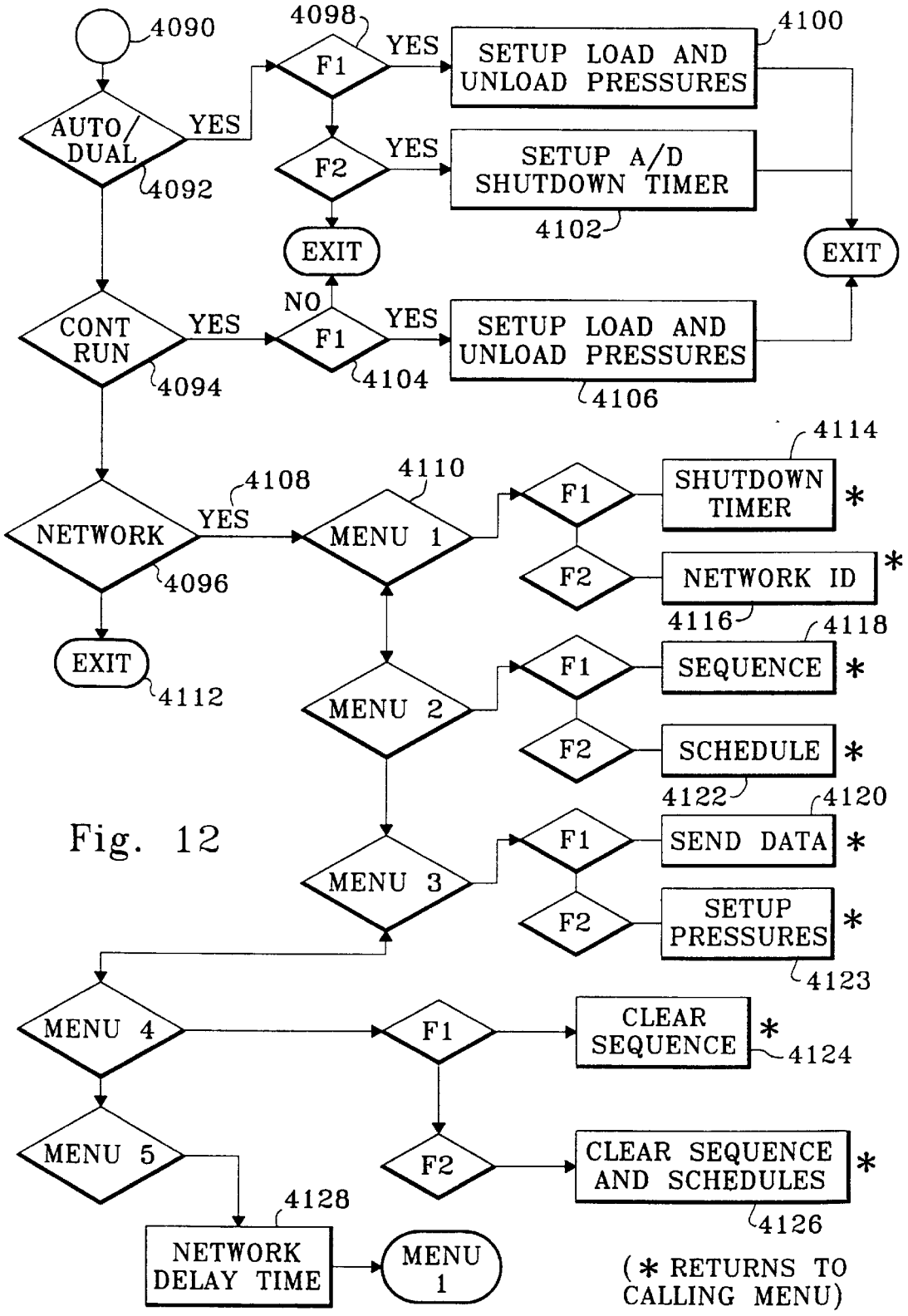
FIG. 12 is a flow diagram of the mode of operation for a computer program for a two stage oil free compressor package of the present application.

The mode of operation flowchart is illustrated in FIG. 12. This section is called from the Main Menu at 4090 and allows the operator to select the operating node of the compressor package to Auto/Dual at 4092. Continuous Run at 4094 and Network at 4096. At 4098, Auto Dual mode has 2 sub-menus to allow the setting of operating parameters. Pressing F1 at 4100 allows the setup of the load and unload pressures. Pressing F2 at 4102 allows setup of the auto-dual shutdown timer that sets how long the compressor package runs, after unloading for shutdown. At 4104, Continuous Run mode has one sub-menu, accessed by pressing F1 at 4106 to setup the load and unload pressures. As the compressor package does not shutdown, no further parameters are needed.

At 4108, the Network Mode, the most complex mode of operation, having 5 sub-menus to configure the parameters of operation is accessed. By using the UP and DOWN arrows at 4110 on the control panel, the various sub-sections are accessed. All the sub-menus in this section return to the higher calling menu, with the exception of Menu 5, which returns to Menu 1. At 4112, if no selection is made, the program exits to the Main running menus after 3 minutes. At 4114, Network Menu 1, F1, accesses the shutdown timer, that determines how long to run after a shutdown condition is reached. At 4116, Network Menu 1, F2, setup the Network ID to be used by that compressor package, in the range of A–F, with a special ID of '—' to remove the compressor package from the net. At 4118, Network Menu 2, F1, allows editing of the schedule sequences of 1–9. This editing feature allows the operator to select any order of actuation desired. At 4123, Network Menu 2, F2, allows the editing of schedules for the days of the week for a sequence change, up to 9 times may be programmed for each day. The sequence is referred to by its number as setup in the previous menus. At 4120, Network Menu 3, F1, allows the operator to broadcast the parameters that were entered in the various schedules above to ensure that all machines have the entered data. Otherwise data is sent from machine "A," and may not reflect changes that were entered via a different compressor package node. At 4122, Network Menu 3, F2, sets up the deadband pressure ranges for the networked compressor packages. These ranges are the Load and unload values for each compressor package on the net. At 4124 Network menu 4, F1, clears all sequences in the compressor package. At 4126 Network Menu 4, F2, clears all sequences and schedules from the system. At 4128, Network Menu 5 sets up the network delay time for that compressor package may be individually programmed. This specified how long to wait before passing the pointer to the next machine. This feature was incorporated to handle short lived transient pressures that may cause un-needed loading of shutdown compressor packages during a pressure drop.

The Maintenance Menus Flow Charts

Figure 13:
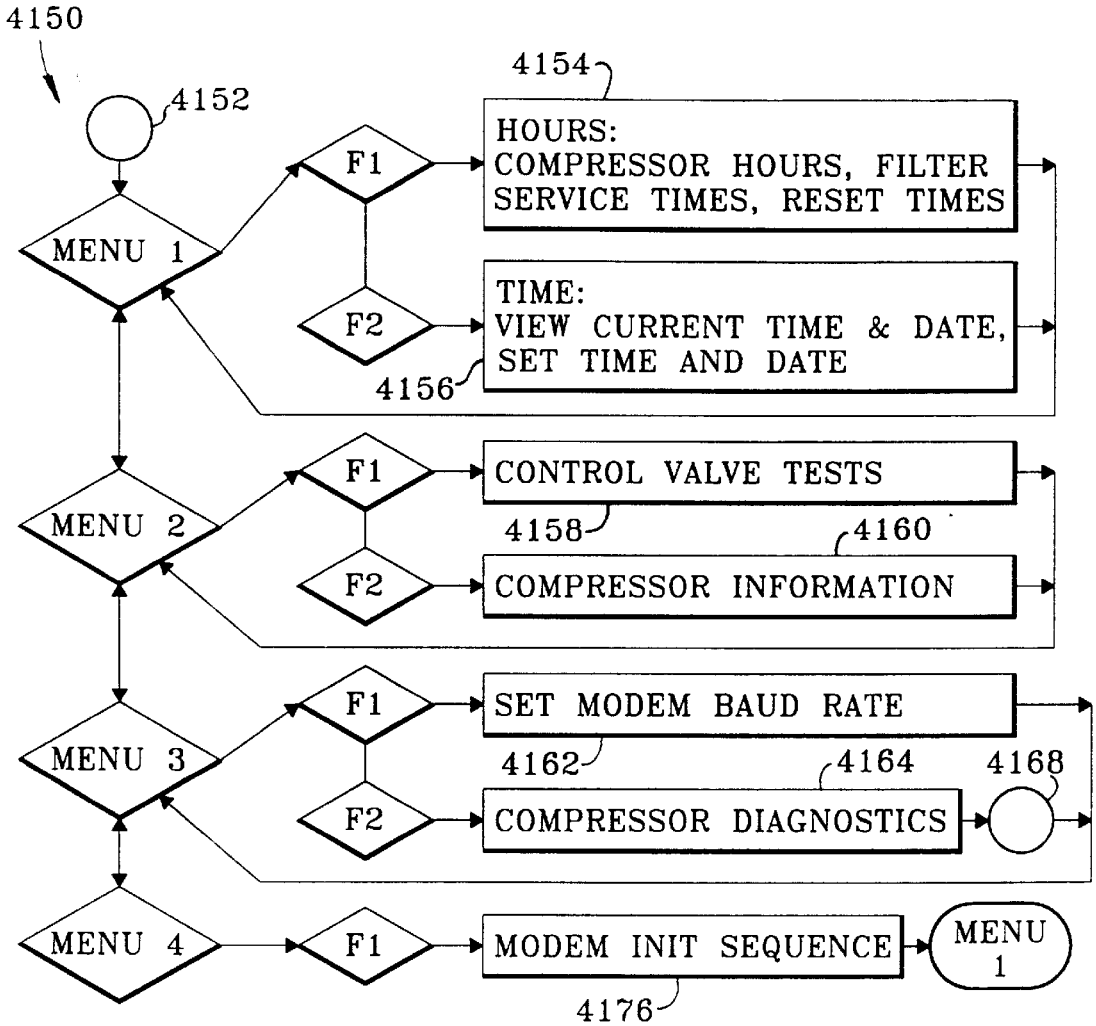
FIG. 13 is a flow diagram of the maintenance menu for a computer program for a two stage oil free compressor package of the present application.
Figure 13:
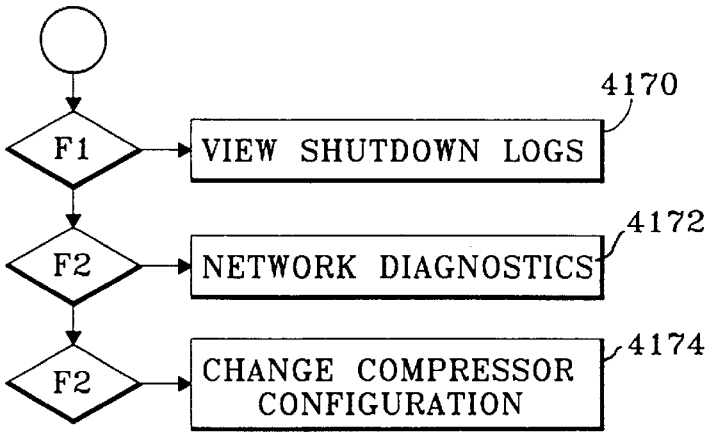

The maintenance menus flow charts 4150 are illustrated in FIG. 13. Entry to the Maintenance Menus sub-sections 1–4 is provided at 4152. At 4154, the Hours, Sub-menus, the setup viewing of the various hourmeters associated with the compressor package loaded and unloaded times, time on the fluid filters, air filters, etc. is allowed. This feature also allows the resetting of the service filter hourmeters to zero when the filters are changed. At 4156, the user is allowed to view or change the current time and date on the compressor package. Changing the date/time requires an extra response to ensure the change is requested. The Control Valve tests allows the user to verify the operation of the control valves on the air-end, by actuating the blow-down and unload solenoids at 4158. Compressor package information allows the operator to view the compressor package set parameters, capacity, horsepower, voltages, alarm trip points, etc. at 4160. The menu allows the operator to set the Modem Baud rate for modem communications at 4162. At 4164, the compressor package diagnostic menu, descends to 4168 to allow the user to view the shutdown logs at 4170 stored in the EEPROM in order of entry to a depth of 16 occurrences at 4172 to view the current status on the Network connection and evaluate the reliability of communications and at 4174 to change the compressor package operating parameters if changes are made to the motor type etc. At 4176, the menu allows editing of the Modem initialization string to configure the modem to the desired mode of operations.

The Background Operations (Interrupts) Flow Charts

Figure 14:
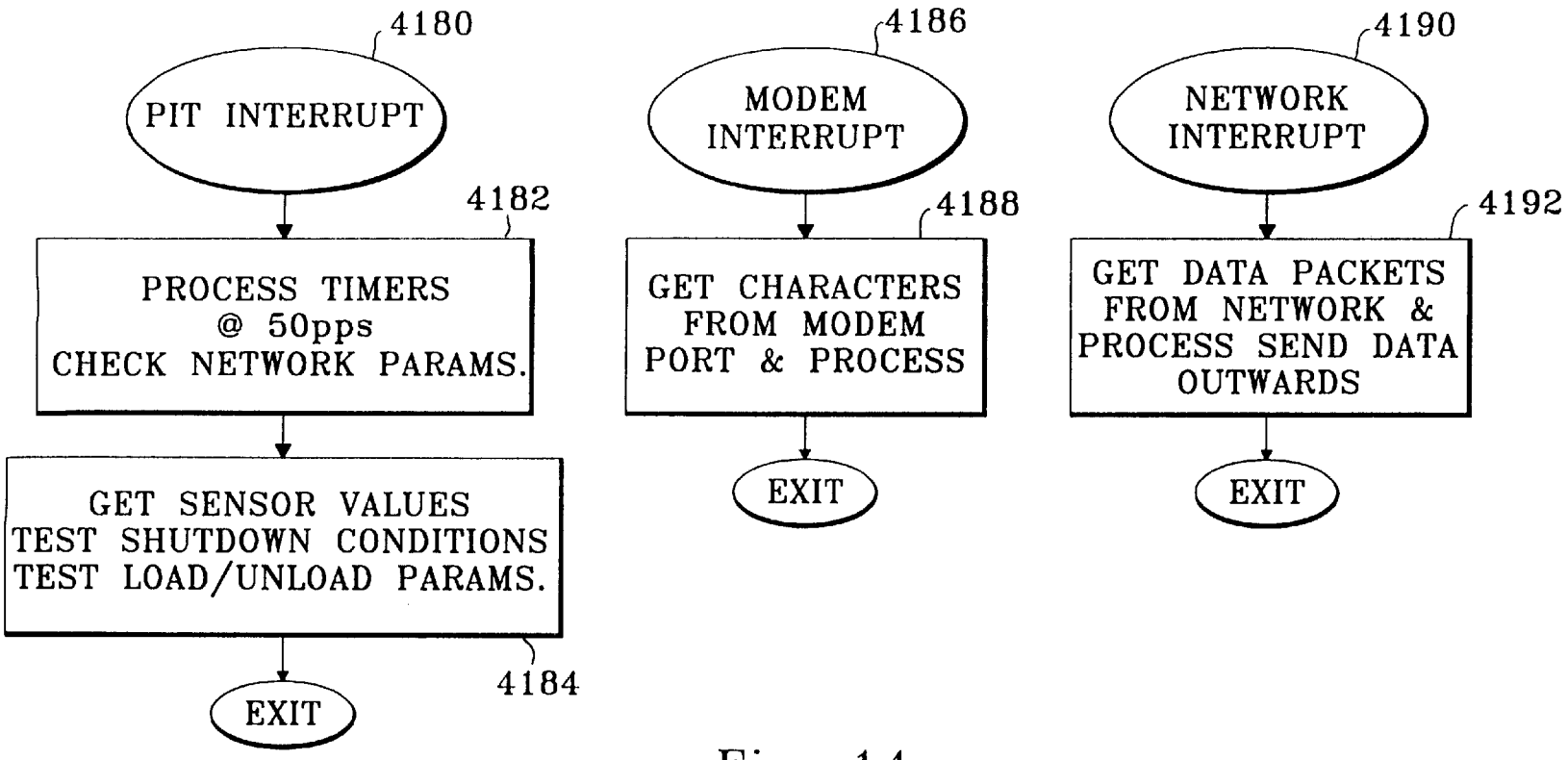
FIG. 14 is a flow diagram of the background operations of a computer program for a two stage oil free compressor package of the present application.

The background operations (interrupts) flow charts are illustrated in FIG. 14. The main timing interrupt routine 4180 calls several routines, the main one is the basic timer functions at 4182. These maintain the various times called from all parts of the program. These timers are of a countdown variety, and halt when reaching zero. Other timers are called every second to maintain the hourmeters for Loaded and Unloaded times as well as the filter times. Network parameters are calculated and tables maintained on active compressor packages and operating conditions. At 4184, called from the interrupt, are routines that read the Sensors, keyboard, and control the operating environments. Also, shutdown conditions are tested and activated as required. The running state is controlled according to the received data in regards to the pressure readings.

At 4186, Modem Interrupt, data or commands received through the modem port are routed through this routine at 4188. A character filter rejects bytes that are not part of a valid string, and the string is checked for proper format before being accepted. Appropriate responses are fed back on receipt of valid commands. At 4190, Network Interrupts, this routine accepts and transmits data through the ARCNET interface to other compressor packages at 4192. Complete operating parameters for each compressor package is transmitted and cached, for rapid determination by other routines.

While the systems and methods described herein constitute preferred embodiments of the invention, it is to be understood that the invention is not limited to these precise systems and methods and that changes may be made therein without departing from the scope of the invention which is defined in the appended claims.

What is claimed is:

1. An electronic control system for controlling the operation of at least one or a network of compressor packages, the system comprising:

at least one or a network of oil less, two stage screw compressor packages, operatively connected to a pressure system in which pressure is to be maintained within a predetermined range of possible pressures;

measuring means, operatively connected to the first and the second screw compressor stages, for determining the pressure exiting the first and the second compressor stages;

processing means, operatively connected to the measuring means for receiving signals from the measuring means, for comparing the determined pressure exiting the first screw compressor and the second screw compressor stages with the predetermined range of possible pressures; and means, operatively connected to the oil free, two stage screw compressor package and the processing means, for shutting down the screw compressor package before the screw compressor package is damaged.

2. The system of claim 1 wherein, if the air pressure exiting the first and the second compressor stages goes above the predetermined range of possible pressures, the control system will shut down the screw compressor package.

3. The system of claim 2 wherein, the air pressure exiting the first and the second screw compressor stages is established by computing a value by measuring the second stage screw compressor discharge pressure and the first stage screw compressor discharge pressure, such that when the second stage screw compressor discharge pressure is greater than about eighty psi (>80 psi) and the first stage screw compressor discharge pressure is less than about ten psi (<10 psi), for a period of about ten (10) seconds, an alarm is flagged and the control system shuts down the screw compressor package.

4. The system of claim 1 further comprising:

measuring means, operatively connected to the first and the second screw compressor stages, for determining the temperature of the gas exiting the first and the second screw compressor stages, wherein the processing means compares the determined temperature exiting the first screw compressor and the second screw compressor stages with a predetermined temperature limit; and means, operatively connected to the oil free, two stage screw compressor package and the processor means, for shutting the screw compressor package down before the package is damaged, if the exiting temperatures exceed such predetermined temperature.

5. The system of claim 4 wherein, the predetermined temperature limit of the air exiting the first screw compressor and the second screw compressor stages is set at about four hundred thirty five degrees Fahrenheit (435° F.).

6. The system of claim 4 wherein, the predetermined temperature limit of the air entering the second stage screw compressor and the screw compressor package discharge temperatures is set at about one hundred twenty degrees Fahrenheit (120° F.).

7. The system of claim 4 wherein, after shutting down the screw compressor package, the control system records which of the four measured temperatures was responsible for shutting down the screw compressor package, and at what time and date the shutdown occurred.

8. The system of claim 1 further comprising:

at least one cooling means, operatively positioned between the stage one screw compressor and the stage two screw compressor, for cooling the air prior to the air entering the second stage screw compressor;

at least a second cooling means, operatively positioned between the stage two screw compressor exit and the screw compressor package exit, for cooling the air prior to the air entering the end user air system;

means, operatively connected to each cooling means, for establishing a high predetermined temperature limit for the temperature of the air exiting each cooling means; and measuring means, operatively connected to each cooling means for measuring the temperature of the air exiting each cooling means; and means, operatively connected to each measuring means and the processor means, for shutting the screw compressor package down before the package is damaged, if either of the exiting temperatures exceed the predetermined high temperature limit.

9. The system of claim 1 further comprising:

lubricating oil containing means, operatively positioned in the stage one screw compressor and the stage two screw compressor, for lubricating parts isolated from each screw compressor compression chamber;

measuring means, operatively connected to the each lubricating oil containing means, for measuring the oil pressure thereof;

means, operatively connected to each lubricating oil containing means measuring means and to the processing means for establishing a range of operating oil pressures; and means, operatively connected to each measuring means and the processor means, for shutting the screw compressor package down before the package is damaged, if the oil pressure deviates from the predetermined oil pressure range.

10. The system of claim 1 further comprising:

means, operatively connected to the processing means, for measuring the pressure of the air exiting the screw compressor package after the second stage cooling means;

means, operatively connected to the processing means, for measuring the temperature of the air exiting the screw compressor package after the second stage cooling means;

means, operatively connected to the processing means, for establishing a range of screw compressor package discharge temperatures and pressures; and means, operatively connected to the package exiting temperature and pressure measuring means, for shutting down the screw compressor package if either the temperature or the pressure exceeds a predetermined limit.

11. The system of claim 10 wherein, the package discharge pressure is used to determine when to unload and load the two screw compressor stages.

12. A method for controlling a single or a network of oil less, two stage screw compressor packages, the method comprising the steps of:

providing at least one or a network of oil less, two stage screw compressor packages;

operatively connecting the at least one or a network of oil less, two stage screw compressor packages to a pressure system in which pressure is to be maintained within a predetermined range of possible pressures;

operatively connecting an electronic control system to at least one two stage screw compressor package;

controlling the operation of the at least one or the network of screw compressor packages by;

determining the pressure exiting the first and the second screw compressor stages;

comparing the determined pressure exiting the first screw compressor and the second screw compressor stages with the predetermined range of possible pressures; and if the determined pressure exiting either the first or the second screw compressor stages equals or exceeds the predetermined range of possible pressures, shutting down the screw compressor package before the screw compressor package is damaged.

13. The method of claim 12 wherein, the air pressure exiting the first and the second screw compressor stages is established by computing a value by measuring the second stage screw compressor discharge pressure and the first stage screw compressor discharge pressure, such that when the second stage screw compressor discharge pressure is greater than about eighty psi (>80 psi) and the first stage screw compressor discharge pressure is less than about ten psi (<10 psi) for a period of about ten (10) seconds, an alarm is activated and the control system shuts down the screw compressor package.

14. The method of claim 12 further comprising the steps of:

determining the temperature of the gas exiting the first and the second screw compressor stages;

comparing the determined temperature exiting the first screw compressor and the second screw compressor stages with a predetermined temperature limit; and shutting the screw compressor package down before the package is damaged, if the exiting temperatures exceed such predetermined temperature.

15. The method of claim 14 wherein, the predetermined temperature limit of the air exiting the first screw compressor and the second screw compressor stages is about four hundred thirty five degrees Fahrenheit (435° F.).

16. The method of claim 14 wherein the predetermined temperature limit of the air entering the second stage screw compressor and the screw compressor package discharge temperatures is about one hundred twenty degrees Fahrenheit (120° F.).

17. The method of claim 14 wherein, after shutting down the screw compressor package, the control system records which of the four measured temperatures was responsible for shutting down the screw compressor package, and at what time and date the shutdown occurred.

18. The method of claim 12 further comprising the steps of:

cooling the air prior to the air entering the second stage screw compressor by operatively positioning at least one cooling means between the stage one screw compressor and the stage two screw compressor;

cooling the air prior to the air entering the end user air system by operatively positioning at least a second cooling means between the stage two screw compressor exit and the screw compressor package exit;

establishing a high predetermined temperature limit for the temperature of the air exiting each cooling means;

measuring the temperature of the air exiting each cooling means by operatively connecting measuring means to each cooling means; and if the exiting temperatures exceed a predetermined temperature limit, shutting the screw compressor package down before the package is damaged.

19. The method of claim 12 further comprising the steps of:

operatively positioning lubricating oil containing means in the stage one screw compressor and the stage two screw compressor for lubricating parts isolated from each screw compressor compression chamber;

measuring the oil pressure of both the stage one screw compressor and the stage two screw compressors by operatively connecting measuring means to the each lubricating oil containing means;

establishing a range of predetermined operating oil pressures; and if the oil pressure deviates from the predetermined oil pressure range, shutting the screw compressor package down before the package is damaged.

20. The method of claim 12 further comprising the steps of:

measuring the pressure of the air exiting the screw compressor package after the second stage cooling means;

measuring the temperature of the air exiting the screw compressor package after the second stage cooling means;

establishing a range of screw compressor package discharge temperatures and pressures; and if either the temperature or the pressure exceeds a predetermined limit, shutting down the screw compressor package.

* * * * *